United States Patent [19]

McGee et al.

[11] 4,160,566

[45] Jul. 10, 1979

[54] MINING APPARATUS

[75] Inventors: Dean A. McGee, Oklahoma City; James E. Ingle, Edmond, both of Okla.; Alan J. Lane, Lexington, Mass.

[73] Assignee: Kerr-McGee Corporation, Oklahoma City, Okla.

[21] Appl. No.: 768,650

[22] Filed: Feb. 14, 1977

[51] Int. Cl.[2] ..... E21C 25/52; E21C 29/02

[52] U.S. Cl. ..... 299/30; 299/11; 299/18; 299/33; 299/71; 299/80

[58] Field of Search ..... 299/11, 19, 80, 18, 299/30, 33, 71; 175/94, 69, 66

[56] References Cited

U.S. PATENT DOCUMENTS

| | | | |
|---|---|---|---|
| B 425,345 | 1/1975 | Poundstone | 299/18 |
| 2,312,789 | 3/1943 | Appleby | 175/210 |
| 2,914,306 | 11/1959 | Failing | 175/210 |
| 3,334,945 | 8/1969 | Bartlett | 299/18 |
| 3,456,371 | 7/1969 | Graham et al. | 285/261 |
| 3,598,445 | 1/1971 | Winberg | 299/31 |
| 3,613,384 | 10/1971 | Jacobs | 61/85 |
| 3,776,594 | 12/1973 | Haspert | 299/19 |
| 3,778,107 | 12/1973 | Haspert | 299/30 |
| 3,797,589 | 3/1974 | Kellner et al. | 175/94 |
| 3,810,677 | 5/1974 | David | 299/18 |
| 3,861,748 | 1/1975 | Cass | 299/31 |
| 3,881,775 | 5/1975 | McPherson et al. | 299/18 |
| 3,907,366 | 9/1915 | Render | 299/18 |
| 3,922,016 | 11/1975 | Tyslauk | 299/56 |
| 4,003,062 | 1/1977 | Juctice et al. | 299/80 |
| 4,014,574 | 3/1977 | Todd | 299/18 |
| 4,032,195 | 6/1977 | Kilroy | 299/18 |
| 4,040,666 | 8/1977 | Uchida | 299/18 |

*Primary Examiner*—William Pate, III

*Attorney, Agent, or Firm*—William G. Addison

[57] ABSTRACT

An improved mining apparatus for excavating material, such as coal, for example, from an earth formation, such as a coal seam, for example, wherein a miner, having a forward and a rearward cutter, is guided through the coal seam and excavates a borehole therein, the borehole being filled with a working fluid during the operation of the miner, the working fluid facilitating the operation of the miner and providing a vehicle for removing the mined material. Substantially all of the operations of the miner are controlled from the earth's surface thereby eliminating the necessity and accompanying hazards and costs involved in utilizing personnel underground during the mining operations.

84 Claims, 21 Drawing Figures

MINING APPARATUS

BACKGROUND OF THE INVENTION

Field of the Invention

The present invention generally relates to mining apparatus for excavating material from an earth formation and, more particularly, but not by way of limitation, to a miner apparatus capable of operating within a borehole filled with a working fluid wherein substantially all of the operations of the mining apparatus are controlled from the earth's surfaces.

BRIEF DESCRIPTION OF THE DRAWINGS

FIG. 9 is a view of a portion of a coal seam illustrating one operational mode of the mining apparatus of the present invention.

DESCRIPTION OF THE PREFERRED EMBODIMENTS

Figure 1:
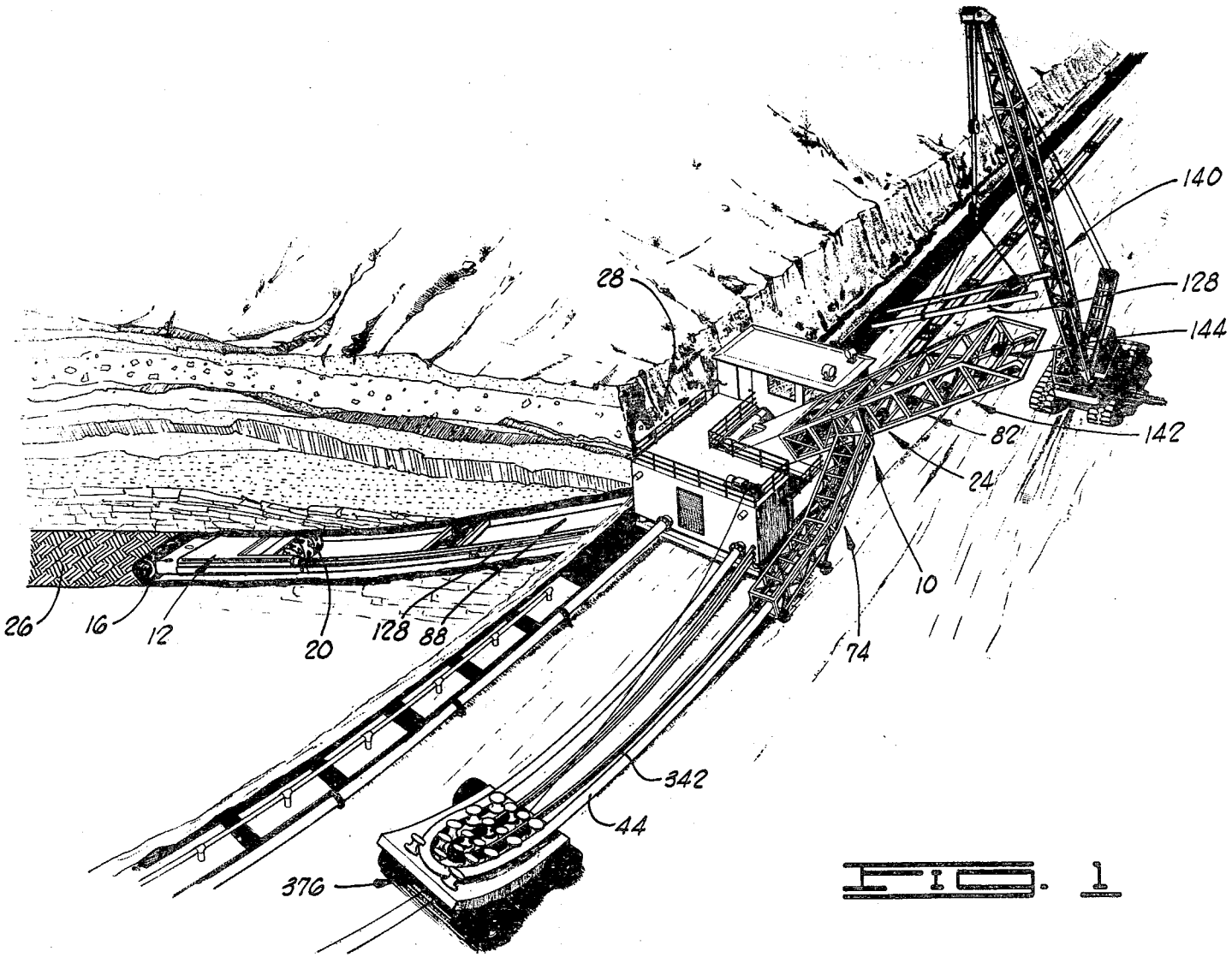
FIG. 1 is a diagrammatic view of the mining apparatus of the present invention.
Figure 2:
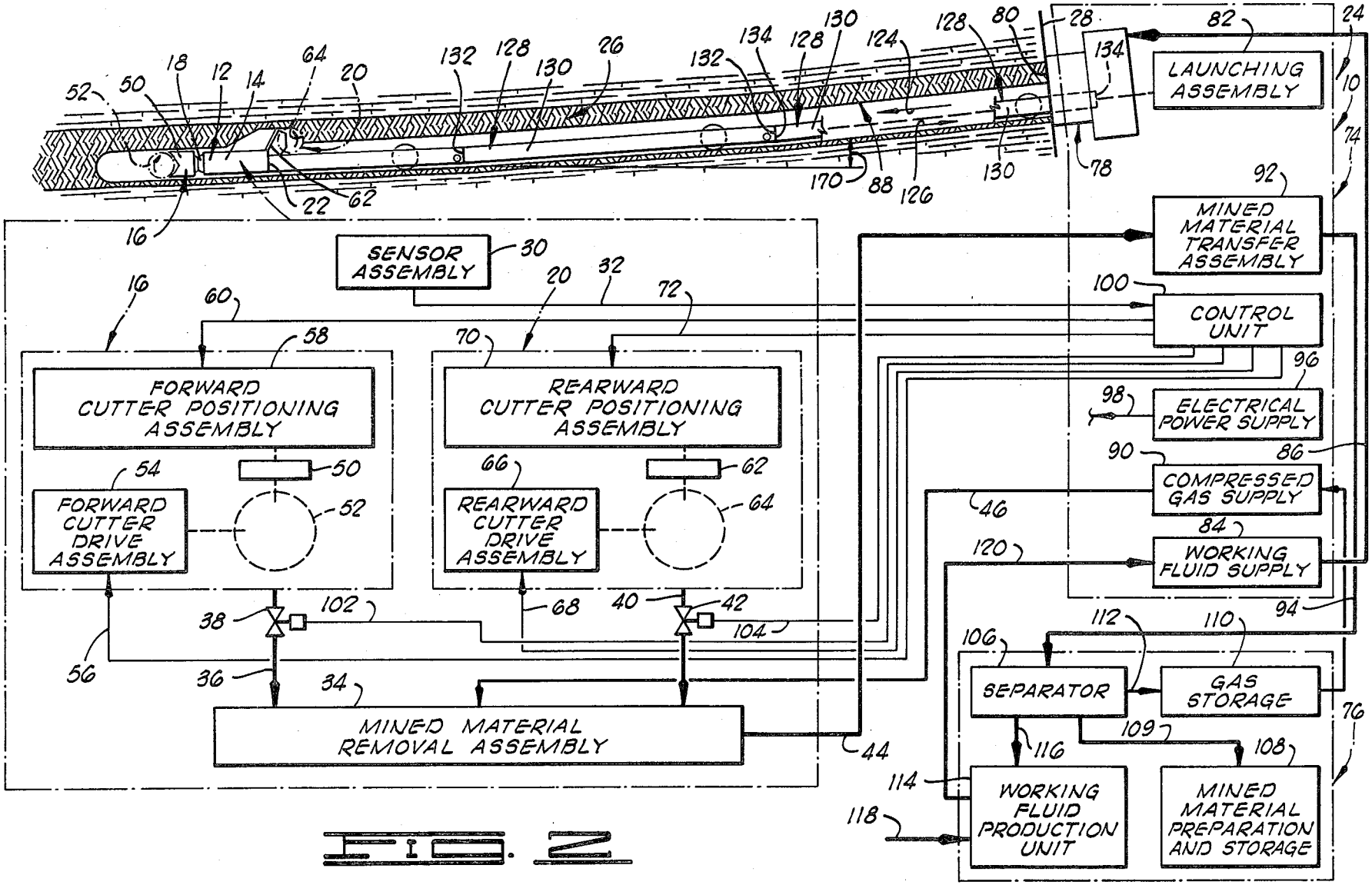
FIG. 2 is a diagrammatic, schematic view of the mining apparatus of FIG. 1.

Referring to the drawings in general and to FIGS. 1 and 2 in particular, diagrammatically and schematically shown therein and designated via the general reference numeral 10 is a mining apparatus constructed and operated in accordance with the present invention. In general, the mining apparatus 10 includes: a miner 12, having a frame 14, a forward cutter assembly 16 which is movably connected to a forward end 18 of the frame 14, and a rearward cutter assembly 20 (shown in dashed-lines in FIG. 1) which is movably connected to a rearward end 22 of the frame 14; and a surface assembly 24. The mining apparatus 10 is constructed and operated to excavatingly engage material in an earth formation and to remove the excavated material (sometimes referred to herein as the "mined material") from the earth formation. More particularly, the mining apparatus 10 is constructed and operated to excavatingly remove coal from a coal seam (diagrammatically shown in FIGS. 1 and 2 and designated therein via the general reference 26) which extends into the earth from a surface highwall 28 (sometimes referred to in the art as an "outcrop"), and the mining apparatus 10 is constructed such that all of the operations are remotely controlled from a remote location, such as the earth's surface or from a drift, for example, thereby eliminating the necessity and accompanying hazards and costs involved in utilizing personnel underground during the mining operations.

It should be noted that, although the mining apparatus 10 and the various components and assemblies thereof and the various methods are described herein in conjunction with the mining of coal from a coal seam, the various apparatus and methods of the present invention are not limited to this particular embodiment and the present invention may be utilized to excavatingly remove salt, gypsum, lignite, peat or some other material, for example. In addition, it should be noted that the terms "forward", "rearward", "upper", "lower" and other words describing the relative positions of various elements, assemblies and components of the present invention are utilized herein solely for the purpose of facilitating the description of the present invention and such terms are not to be construed to limit the present invention as defined in the claims.

The miner 12 includes: a sensor assembly 30 connected to miner 12 and constructed to sense and detect the coal seam 26 and to produce an output signal on a control line 32 indicating the detected position of the coal seam 26 (the sensor assembly 30, more particularly, may produce a plurality of output signals in some embodiments, as will be described in greater detail below); and a mined material removal assembly 34, which is connected to the forward cutter assembly 16 via a conduit 36, having a valve 38 interposed therein and disposed generally between the forward cutter assembly 16 and the mined material removal assembly 34, and which is connected to the rearward cutter assembly 20 via a conduit 40, having a valve 42 interposed therein and disposed generally between the rearward cutter assembly 20 and the mined material removal assembly 34, the mined material removal assembly 34 receiving the mined material via either the conduit 36 or the conduit 40 and discharging the mined material through a conduit 44. The mined material removal assembly 34 receives compressed gas via a conduit 46 and is constructed to inject the received compressed gas into the slurry of the mined material prior to discharging the slurry of the mined material and the compressed gas through the conduit 44. The compressed gas reduces the weight of the mined material in the conduit 44 (a bouyancy effect) and acts to create a pressure differential between the mined material in the conduit 44 and the material outside the tube, thereby resulting in the flow of the mined material through the conduit 44, the compressed gas acting to facilitate the pumping of the slurry through the conduit 44 (the term "gas" as used herein in conjunction with the gas received by the mined material removal assembly 34 includes air). It should be noted that, in one embodiment, a slurry pump is located at the surface for cooperating with the injected gas to effect the moving of the mined material to the surface, as will be described below in connection with the mined material transfer assembly.

The forward cutter assembly 16 includes: a forward cutter frame 50, which is movably connected to the forward end 18 of the frame 14; a forward cutter 52, which is mechanically connected to and rotatably mounted on the forward cutter frame 50, the forward cutter 52 being constructed and mounted on the forward cutter frame 50 for excavatingly engaging the material (coal) to be mined; a forward cutter drive assembly 54, which is mechanically connected to the forward cutter 52, the forward cutter drive assembly 54 rotatingly driving the forward cutter 52 in response to receiving a signal via a control line 56 (the signal received via the control line 56 may be hydraulic, pneumatic or electrical or a combination thereof); and a forward cutter positioning assembly 58, which is mechanically connected to the forward cutter frame 50 and which receives a signal via a control line 60 (the signal received via the control line 60 may be hydraulic, pneumatic or electrical or a combination thereof), the forward cutter positioning assembly 58 moving the forward cutter frame 50 and the forward cutter 52 in response to the signal received via the control line 60.

The rearward cutter assembly 20 includes: a rearward cutter frame 62, which is movably connected to the rearward end 22 of the frame 14; a rearward cutter 64, which is mechanically connected to and rotatably mounted on the rearward cutter frame 62, the rearward cutter 64 being constructed and mounted on the rearward cutter frame 62 for excavatingly engaging the material (coal) to be mined; a rearward cutter drive assembly 66, which is mechanically connected to the rearward cutter 64, the rearward cutter drive assembly 66 rotatingly driving the rearward cutter 64 in response to receiving a signal via a control line 68 (the signal received via the control line 68 may be hydraulic, pneumatic or electrical or a combination thereof); and a rearward cutter positioning assembly 70, which is mechanically connected to the rearward cutter frame 62 and which receives a signal via a control line 72 (the signal received via the control line 72 may be hydraulic, pneumatic or electrical or a combination thereof), the rearward cutter positioning assembly 70 moving the rearward cutter frame 62 and the rearward cutter 64 in response to the signal received via the control line 72.

The surface assembly 24 includes a surface unit 74, which is constructed to launch and force or drive the miner 12 into the coal seam 26 and to retrieve or withdraw the miner 12 from the coal seam 26 and, in general, to control the movement of the miner 12 through the coal seam 26; and an auxiliary assembly 76. The surface unit 74 includes: a caisson 78 having one end 80 sealingly engageable with a portion of the highwall 28 and being constructed such that the miner 12 and associated equipment are movable through the caisson 78 into and from the coal seam 26 during the operation of the mining apparatus 10; a launching assembly 82 for moving the miner 12 and associated equipment through the caisson 78 and through the coal seam 26; a working fluid supply 84 for passing a working fluid through a conduit 86 and into a borehole 88 formed through the coal seam 26 via the mine 12; a compressed gas supply 90 for supplying the compressed gas to the mined material removal assembly 34 via the conduit 46, one end of the conduit 46 being connected to the mined material removal assembly 34 and the opposite end of the conduit 46 being connected to the compressed gas supply 90; a mined material transfer assembly 92 for receiving the mined material passed from the mined material removal assembly 34 through the conduit 44 and passing or transferring the mined material through a conduit 94 to the auxiliary assembly 76 where the mined material is recovered, one end of the conduit 44 being connected to the mined material removal assembly 34 and the opposite end of the conduit 44 being connected to the mined material transfer assembly 92; an electrical power supply 96 for supplying the operating electrical power to the miner 12 via a cable 98; and a control unit 100, which receives the signal on the control line 32 provided via the sensor assembly 30 and provides the signal on the control line 60 in response thereto for positioning the forward cutter 52 to guide the miner 12 through the coal seam 26, the control unit 100 also providing the signals on the control lines 56, 68 and 72. The valves 38 and 42 each have opened and closed positions and the position of each of the valves 38 and 42 is remotely controllable in response to signals provided on control lines 102 and 104, respectively, the signals on the control lines 102 and 104 being provided via the control unit 100.

It should be noted that the gas injected into the slurry is the primary means for moving the slurry from the excavation site to the remote or surface location and, in one embodiment the mined material transfer assembly 92 includes an auxiliary slurry pump for pumping the mined material to the surface, the auxiliary slurry pump cooperating with the gas injection to effect the moving of the mined material to the surface. One of the reasons for including the slurry pump is that gas injection alone will not operate to move the slurry to the surface in all operational applications.

The auxiliary assembly 76 includes a separator 106, which receives the slurry comprising the working fluid, the mined material and the gas passed from the mined material transfer assembly 92 via the conduit 94, the slurry being separated in the separator 106. The mined material separated from the slurry is transferred to a mined material preparation and storage 108 via a conduit or a conveyor or other such material transfer means, generally indicated via the path 109. The gas separated from the slurry is passed to a gas storage 110 via a conduit 112 and the working fluid separated from the slurry is passed to a working fluid production unit 114 via a conduit 116. The working fluid production unit 114 also receives materials for producing the working fluid via a conduit 118 and the working fluid so produced along with the re-cycled working fluid received via the conduit 116 provides a reservoir of the working fluid, the working fluid being passable from the working fluid production unit 114 to the working fluid supply 84 via a conduit 120. The working fluid may be of the type commonly referred to in the art as "drill mud" and used in connection with the drilling of oil or gas wells and the like, or the working fluid may be water or water loaded with fine coal or other fluid suitable for supporting the walls of the borehole 88 and for conveying the mined material through the mined material removal assembly 34 and the mined material transfer assembly 92 during the operation of the mining apparatus 10 as described herein.

In general, the surface assembly 24 is located at the surface generally near the highwall 28 and, more particularly, the caisson 78 is positioned at a predetermined location along the highwall 28, the end 80 of the caisson 78 being positioned in sealing engagement with the highwall 28 with the launching assembly 82 being positioned near the end of the caisson 78, opposite the end 80 thereof. The working fluid supply 84 is placed in fluidic communication with the borehole 88 to be formed via the miner 12 or, more particularly, the conduit 86 is connected to the caisson 78 so the working fluid can be passed through a portion of the caisson 78 and into the borehole 88. The control lines 32, 56, 60, 68, 72, 102 and 104 are each connected to the control unit 100 and to the appropriate assemblies of the miner 12, as shown in FIG. 2 and described before, the cable 98 is connected to the miner 12 (not shown in FIGS. 1 and 2) and to the electrical power supply 96, the conduit 44 is connected to the mined material removal assembly 34 and the mined material transfer assembly 92, and the conduit 46 is connected to the mined material removal assembly 34 and the compressed gas supply 90. In short, all of the hydraulic, pneumatic and electrical control lines, cables and conduits are connected to the miner 12 and the surface unit 74 so the surface unit 74 is operatively connected to the miner 12 prior to launching the miner 12 into the coal seam 26.

The miner 12 is positioned in the launching assembly 82 and oriented such that the coal seam 26 initially is engaged via the forward cutter assembly 16 as the miner 12 is launched into the coal seam 26. The launching assembly 82 is constructed to engage the miner 12 and force the miner 12 into the coal seam 26, the miner 12 being forced through the caisson 78 and into the coal seam 26 in a general direction 124 via the launching assembly 82.

When the miner 12 initially is launched into the coal seam 26, the control unit 100 provides a signal on the control line 56 and the forward cutter drive assembly 54 rotatingly drives the forward cutter 52 in response to receiving the signal from the control unit 100 on the control line 56. In this operating mode, the control unit 100 provides a signal on the control line 102 and the valve 38 is positioned in the opened position in response to receiving the signal from the control unit 100 on the control line 102, thereby providing communication between the forward cutter assembly 16 and the mined material removal assembly 34 via the conduit 36. The control unit 100 provides a signal on the control line 104 and the valve 42 is positioned in the closed position in response to receiving this signal on the control line 104 in this operating mode of the miner 12, thereby interrupting communication between the rearward cutter assembly 20 and the mined material removal assembly 34. The control unit 100 provides a signal on the control line 68 and the rearward cutter drive assembly 66 is conditioned such that the rearward cutter 64 is not rotatingly driven as the miner 12 is moved through the coal seam 26 in the direction 124. The control unit 100 provides the signal on the control line 72 and the rearward cutter positioning assembly 70 is conditioned to move the rearward cutter frame 62 and the rearward cutter 64 connected thereto to a storage position wherein the rearward cutter 64 does not excavatingly engage the coal seam 26 as the miner 12 is into the intothe coal seam 26 in the direction 126. In summary, the control unit 100 is constructed to cause the rearward cutter assembly 20 to be positioned in the storage position and to cause the forward cutter 52 to be rotatingly driven via the forward cutter drive assembly 54 for excavatingly engaging the material (coal) to be mined when the miner 12 is being moved through the coal seam 26 in the direction 124.

Working fluid is passed into the borehole 88 from the working supply 84 via the conduit 86, and the borehole 88 substantially is filled with the working fluid. In the preferred mode, the working fluid is maintained in the borehole 88 under a hydrostatic pressure and the hydrostatic pressure of the working fluid acting against the walls formed in the coal seam 26 via the borehole 88 cooperates to support the walls formed via the borehole 88 against falls or collapses during the excavation of the material (coal) from the coal seam 26. The working fluid is continuously passed into the borehole 88 from the working fluid supply 84 to maintain the borehole 88 filled with the working fluid as the borehole 88 is enlarged via the excavation and removal of the mined material (coal), and the working fluid is prevented from escaping or leaking through the opening formed in the highwall 28 via the sealing engagement between the caisson 78 and the highwall 28, the caisson 78 being constructed to maintain the sealing engagement with the highwall 28 as the miner 12 is passed through the caisson 78 and into the coal seam 26. The working fluid in the borehole 88 also is utilized to provide a vehicle for moving the mined or excavated material from the borehole 88 to the surface in a manner to be described in greater detail below.

In this operating mode of the mining apparatus 10 when the miner 12 is being moved into and through the coal seam 26, the forward cutter 52 excavatingly engages the material (coal) to be mined and dislodges or disengages the material (coal) from the coal seam 26. The excavated material (coal) is suspended in the working fluid and the mined material (coal) and the working fluid form a slurry, the slurry of the mined material (coal) and the working fluid being moved via the forward cutter assembly 16 into the conduit 36 as the material is excavated from the coal seam 26 via the forward cutter 52. The slurry including the material (coal) excavated via the forward cutter 52 is passed through the conduit 36 into the mined material removal assembly 34 where compressed or pressurized gas, which may be air, methane, the exhaust from a diesel engine or some other gas or the like, for example, is injected into the slurry, the pressurized gas providing flotation assistance for maintaining the mined material (coal) suspended throughout the working fluid, thereby facilitating or assisting the pumping or moving of the slurry from the miner 12 to the surface assembly 24.

The slurry comprising the mined material (coal), the working fluid and the pressurized gas is passed from the mined material removal assembly 34 through the conduit 44 to the mined material transfer assembly 92 of the surface unit 74. The slurry received via the mined material transfer assembly 92 is passed to the separator 106 of the auxiliary assembly 76 via the conduit 94 wherein the slurry is separated into a working fluid component, a gas component, and a mined material (coal) component. The gas component is passed from the separator 106 into the gas storage 110 via the conduit 112 and thus the gas injected into the slurry is recovered for recycling back into the compressed gas supply 90 via the conduit 112. Make-up gas can be supplied to either the gas storage 110 or directly to the compressed gas supply 90 (not shown in FIGS. 1 and 2) for assuring a sufficient supply of gas in the event a sufficient supply is not recovered from the slurry in the separator 106 for recycling to the compressed gas supply 90. The working fluid component is passed from the separator 106 to the working fluid production unit 114 via the conduit 116 where the recovered working fluid is added to and mixed with make-up working fluid passed into the working fluid production unit 114 via the conduit 118, the working fluid produced and retained within the working fluid production unit 114 being passed to working fluid supply 84 via the conduit 120 for supplying the working fluid to be passed into the borehole 88 from the working fluid supply 84 via athe conduit 86. The mined material (coal) component is passed from the separtor 106 via the path 109 into the mined material preparation and storage 108.

As the miner 12 is forced into and through the coal seam 26 via the launching assembly 82 in the direction 124, the sensor assembly 30 senses or detects the coal seam 26 interface and provides the signal or signals on the control line 32 indicating the position of the coal seam 26 interface relative to the position of the sensor assembly 30, the output signal or signals provided via the sensor assembly 30 and indicating the position of the miner 12 relative to the coal seam 26 interface since the sensor assembly 30 is mounted on the miner 12. More particularly, the sensor assembly 30 is mounted on the miner 12 in a predetermined position relative to the forward cutter 52 and the frame 14 so the output signal or signals provided via the sensor assembly 30 indicate the position of frame 14 relative to the coal seam 26 interface.

The control unit 100 provides the output signal or signals on the control line 60 in response to the signals received from the sensor assembly 30 on the control line 32. The forward cutter positioning assembly 58 causes the forward cutter frame 50 and the forward cutter 52 connected thereto to be moved to predetermined positions in response to the signals received from the control unit 100 on the control line 60. More particularly, the forward cutter positioning assembly 58 moves the forward cutter frame 50 about a vertical and horizontal axes to position the forward cutter 52 in predetermined positions relative to the coal seam 26 interface. The sensor assembly 30, the control unit 100 and the forward cutter positioning assembly 58 cooperate to position the forward cutter 52 in predetermined positions for steering and guiding the miner 12 through the coal seam 26 in a manner such that the miner 12 maintains a substantially constant position relative to the coal seam 26 interface as the miner 12 is moved into and through the coal seam 26 in the direction 124.

When it is desired to withdraw the miner 12 from the borehole 88 in a withdrawal direction 126, the control unit 100 provides a signal to the forward cutter drive assembly 54 via the control line 56 and the forward cutter drive assembly 54 ceases driving the forward cutter 52 in response to the received signal on the control line 56 in this operating withdrawal mode of the mining apparatus 10. Then, the control unit 100 provides a signal to the rearward cutter positioning assembly 70 on the control line 72 and the rearward cutter positioning assembly 70 moves the rearward cutter frame 62 and the rearwrd cutter 64 connected thereto from the storage position to a material engaging position (diagrammatically shown in dashed-lines in FIG. 2) in response to receiving this signal on the control line 72. In the material engaging position of the rearward cutter assembly 20, the rearward cutter 64 is positioned to excavatingly engage a portion of the coal seam 26 which was not engaged via the forward cutter 52 during the movement of the miner 12 into and through the coal seam 26 in the direction 124. Thus, the rearward cutter 64 excavates additional material (coal) from the coal seam 26, thereby enlarging the borehole 88, as the miner 12 is withdrawn from the borehole 88 in the withdrawal direction 126. It should be noted that the rearward cutter 64 also is utilized to assist in withdrawing the miner 12 from the borehole 88 by effectively cutting the miner 12 out from the borehole 88 in the event the walls or roof or portions thereof formed in the coal seam 26 via the borehole 88 fall or collapse between the miner 12 and the surface.

Prior to providing the signal for positioning the rearward cutter 64 in the material engaging position, the control unit 100 provides a signal to the rearward cutter drive assembly 66 on the control line 68 and the rearward cutter drive assembly 66 rotatingly drives the rearward cutter 64. In this manner, the rearward cutter 64 excavatingly engages the coal seam 26 as the rearward cutter 64 is moved into the material engaging position (shown in dashed-lines in FIG. 2).

Further, before the rearward cutter assembly 20 is positioned in the material engaging position, the control unit 100 provides a signal on the control line 102 and the valve 38 is positioned in the closed position in response to receiving this signal provided on the control line 102, thereby interrupting communication between the forward cutter assembly 16 and the mined material removal assembly 34. The control unit 100 provides a signal on the control line 104 and the valve 42 is positioned in the opened position in response to receiving this signal on the control line 104, thereby establishing communication between the rearward cutter assembly 20 and the mined material removal assembly 34 via the conduit 40.

After the rearward cutter assembly 20 has been positioned in the material engaging position, the miner 12 is withdrawn from and through the coal seam 26 via the launching assembly 82 in the withdrawal direction 126. As the miner 12 is moved in the withdrawal direction 126, the rearward cutter 64 excavatingly engages the material (coal) to be mined and dislodges or disengages the material (coal) from the coal seam 26. The excavated material (coal) is suspended in the working fluid and the mined material (coal) and the working fluid form a slurry, the slurry of the mined material (coal) and the working fluid being moved via the rearward cutter assembly 20 into the conduit 40 as the material is excavated from the coal seam 26 via the rearward cutter 64. The slurry including the material (coal) excavated via the rearward cutter 64 is passed through the conduit 40 into the mined material removal assembly 34 where compressed or pressurized gas (or air) is injected into the slurry in a manner and for reasons described before with respect to the material (coal) excavated via the forward cutter assembly 16.

The miner 12 is steered into and through the coal seam 26 in the direction 124 via the sensor assembly 30, the control unit 100 and the forward cutter positioning assembly 58 in a manner generally described before. The control unit 100 is constructed to store the information received from the sensor 30 via the control line 32 and to store the information provided to forward cutter positioning assembly 58 via the control line 60 during the mode of operation where the miner 12 is driven into and through the coal seam 26 in the direction 124. During the withdrawal of the miner 12, the control unit 100 utilizes the information stored therein to produce signals on the control line 60 which cause the forward cutter positioning assembly 58 to move the forward cutter frame 50 and the forward cutter 52 connected thereto for steering and guiding of the miner 12 into and through the coal seam 26 in the withdrawal direction 126 along the substantially corresponding to the path followed by the miner 12 during the movement of the miner 12 into and through the coal seam 26 in the direction 124. Thus, during the withdrawal of the miner 12 in the withdrawal direction 126, the forward cutter positioning assembly 58, the forward cutter frame 50 and the forward cutter 52 cooperate to steer and guide the miner 12 along a path substantially corresponding to the path followed by the miner 12 during the movement of the miner 12 into and through the coal seam 26 in the direction 124. It should be noted that the forward cutter assembly 16 does not function to excavatingly engage the material (coal) while moving the miner 12 in the direction 126; however, the forward cutter assembly 16 does function to steer and guide the miner 12 along a path determined via the control unit 100 output signals on the control line 60 which are connected to and received by the forward cutter positioning assembly 58, the forwardly cutter positioning assembly 58 positioning the forward cutter frame 50 and the forward cutter 52 connected thereto in response to the output signals received on the control line 60 from the control unit 100.

The slurry comprising the material (coal) excavated via the rearward cutter 64, the pressurized gas and the working fluid is passed from the mined material removal assembly 34 through the conduit 44 to the mined material transfer assembly 92 of the surface unit 74. The working fluid, the material (coal) excavated via the rearward cutter 64 and the pressurized gas is recovered from the slurry in the separator 106 in a manner and for reasons like those described before with respect to the material (coal) excavated via the forward cutter assembly 16.

The mining apparatus 10 also includes a plurality of carriers 128, and each carrier 128 includes a carrier frame 130 having a forward end 132 and a rearward end 134. The forward end 132 of each carrier frame 130 is connectable either to the miner 12 or to the rearward end 134 of one of the carrier frames 130.

After the miner 12 has been moved a distance into and through the coal seam 26, the forward end 132 of the carrier frame 130 of one of the carriers 128 is connected to the miner 12. Then, the launching assembly 82 engages a portion of the carrier 128 which is connected to the miner 12 and the launching assembly 82 forces the engaged carrier 128 into the coal seam 26 or, more particularly, into the borehole 88, thereby forcing the miner 12 connected thereto into and through the coal seam 26 in the direction 124.

After the miner 12 and carrier 128 connected thereto has been forcibly moved a distance into and through the coal seam 26 via the launching assembly 82, the forward end 132 of another carrier frame 130 is connected to the rearward end 134 of the carrier frame 130 which is connected to the miner 12. Then, the launching assembly 82 engages a portion of the carrier 128 which has been connected to the carrier 128 connected to the miner 12 and the launching assembly 82 forces the engaged carrier 128 into the borehole 88, thereby forcing the miner 12 into and through the coal seam 26 in the directon 124.

The forward end 132 of additional carrier frames 130 sequentially are connected to the rearward end 132 of the prior connected carrier frame 130. The launching assembly 82 engages a portion of the last connected carrier frames 130 and forces the engaged carrier frame 130 and the carrier frames 130 and the miner 12, which are connected to the engaged carrier frame 130, into and through the coal seam 26 in the direction 124.

The carriers 128 are connected to the miner 12 and the miner 12 is forcibly moved into and through the coal seam 26 in the direction 124 via the force applied to last connected carrier 128 and transmitted to the miner 12 through the carriers 128 connected thereto. The connecting of additional carriers 128 in series to the miner 12 is repeated and continued until the miner 12 has been moved some predetermined distance through the coal seam 26.

After the miner 12 has been moved the predetermined distance into and through the coal seam 26 in the direction 124, the miner 12 is withdrawn from the borehole 88 and the rearward cutter 64 excavatingly engages the coal seam 26 for excavating additional material (coal) as the miner 12 is withdrawn in the withdrawal direction 126. During the withdrawal of the miner 12, the launching assembly 82 engages one of the carriers 128 and forces the engaged carrier 128 in the withdrawal direction 126, this force being transmitted to the miner 12 via the carriers 128 connected to the miner 12 for forcibly moving the miner 12 through the coal seam 26 in the withdrawal direction 126.

After the miner 12 and the carriers 128 connected thereto have been moved a predetermined distance in the withdrawal direction 126, the last connected carrier 128 is disconnected and the launching assembly 82 is positioned in engagement with the carrier 128, which was connected to the carrier 128 just disconnected. The carriers 128 are driven via the launching assembly 82 in the withdrawal direction 126 through the caisson 78 and, as each carrier 128 is driven through the launching assembly 82 in the withdrawal direction 126, the carrier 128 is disconnected and removed. The driving of the carriers 128 via the launching assembly 82 in the withdrawal direction 126 and the sequential disconnecting of the carriers 128 as the carriers 128 are passed or driven through the launching assembly 82 in the withdrawal direction 126 is continued until the miner 12 has been withdrawn from the borehole 88.

The particular number of carriers 128 utilized in a particular operation will depend upon the total length of the borehole 88 and the length of each of the individual carriers 128, between the forward and the rearward ends 132 and 134.

As diagrammatically shown in FIG. 1, the launching assembly 82 includes a portable crane 140 and a carrier track 142, in one embodiment. In this embodiment, the carrier track 142 compresses a plurality of structural members interconnected to a path for accommodating the carriers 128, the carrier track 142 having one open end 144 for receiving the carriers 128 and an opposite end (not shown) which is connected to the caisson 78. During the operation, each carrier 128 is loaded into the open end 144 of the carrier track 142 via the crane 140 and each carrier 128 then is guided through the carrier track 142 for connection to the miner 12 or to one of the previously connected carriers 128, in a manner described before.

It should be noted that, since the borehole 88 is filled with working fluid and the working fluid is sealed in the borehole 88 via the caisson 78, a hydrostatic head will exist on the forward cutter 52 and on the rearward cutter 64 during the cutting operations wherein the coal seam 26 is excavatingly engaged via the forward or the rearward cutters 52 or 64, and this hydrostatic head will exist on the forward cutter 52 even at the start of the operations where the miner 12 initially is launched into the coal seam 26. The hydrostatic pressure head on the forward and the rearward cutters 52 and 64 augments and facilitates the cutting operations.

Embodiment of FIGS. 3, 4, 5, 6, 7 and 8

Some of the operating modes of the mining apparatus 10 are diagrammatically illustrated in FIGS. 3, 4, 5, 6, 7 and 8 and, more particularly, some of the operating modes of the miner 12 are diagrammatically illustrated in FIGS. 3, 4, 5, 6, 7, and 8 with respect to the movement of the miner 12 into and through coal seams.

Figure 3:
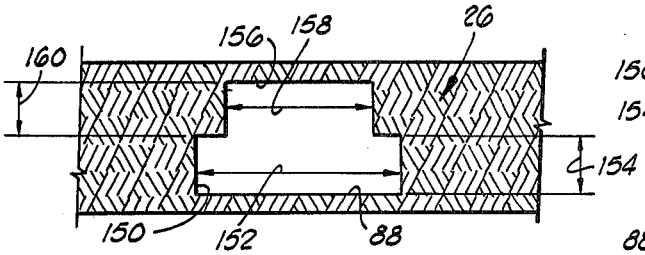
FIG. 3 is a diagrammatic, sectional view of a portion of a coal seam showing a borehold formed therein via the miner of the mining apparatus of FIGS. 1 and 2.
Figure 5:
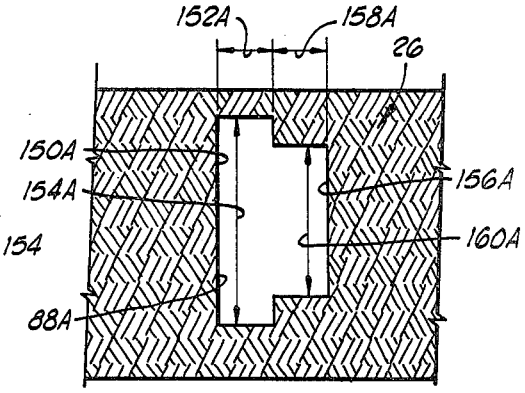
FIG. 5 is a view similar to FIG. 3, but showing the borehole formed via the mining apparatus of the present invention in another operational mode of the miner.
Figure 4:
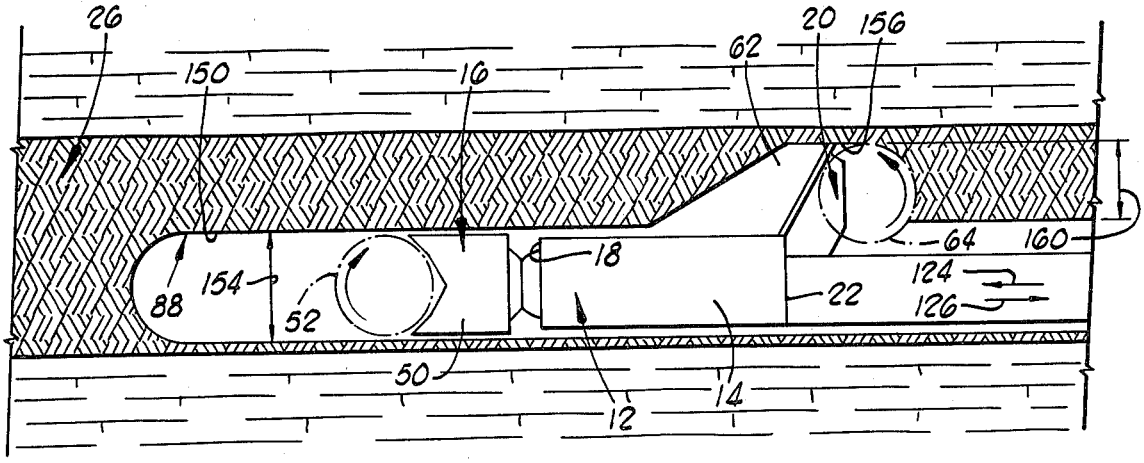
FIG. 4 is a diagrammatic, schematic view showing a portion of the coal seam and illustrating the forming of a borehole in the coal seam via the miner of the mining apparatus of FIGS. 1 and 2, the miner being schematically shown disposed in the borehole.

By operating the mining apparatus 10 in a manner generally described before with respect to FIGS. 1 and 2 and with the miner 12 oriented in the position as diagrammatically shown in FIGS. 1 and 2, the forward cutter 52, more particularly, will excavate forward forard cutter borehole 150, as shown in FIGS. 3 and 4, as the miner 12 is moved into and through the coal seam 26 in the direction 124. The forward cutter 52 has a cutting length which is sized to excavate the forward cutter borehole 150 having a width 152, and the forward cutter 52 has a cutting diameter which is sized to excavate the forward cutter borehole 150 having a height 154. In this particular operating mode, the rearward cutter 64 is positionable in a material engaging position for excavating a rearward cutter borehole 156 as the miner 12 is moved through the coal seam 26 in the withdrawal direction 126, as shown in FIGS. 3 and 4. The rearward cutter 64 has a cutting length which is sized to excavate the rearward cutter borehole 156 having a width 158, and the rearward cutter 64 has a cutting diameter which is sized to excavate the rearward cutter borehole 156 having a height 160. The rearward cutting assembly 20 is positionable in the material engaging position such that the rearward cutter 64 excavates the rearward cutter borehole 156 and a portion of the rearward cutter borehole 156 intersects a portion of the forward cutter borehole 150, the forward and the rearward cutter boreholes 150 and 156 cooperating to define the borehole 88 excavated via the miner 12 during the movement of the miner 12 into and the withdrawal of the miner 12 from the coal seam 26.

In one preferred embodiment, the rearward cutter 64 has a cutting length which is smaller than the cutting length of the forward cutter 52, and thus the width 152 of the forward cutter borehole 150 is larger than the width 158 of the rearward cutter borehole 156. One of the reasons for sizing the cutting length of the forward cutter 52 to be larger than the cutting length of the rearward cutter 64 is to permit the rearward cutter assembly 20 to be positioned in a storage position such that the rearward cutter assembly 20 does not interfere with the movement of the miner 12 as the miner 12 is moved through the coal seam 26 in the direction 124, in a manner which will be described in greater detail below in connection with construction and operation of the preferred embodiments of the miner 12. Also, it should be noted that the rearward cutter 64 preferably has a cutting diameter which is larger than the height 158 of the rearward cutter borehole 156. In the material engaging position, a portion of the rearward cutter 64 is disposed within a portion of the forward cutter borehole 150, as shown in FIG. 4, so the rearward cutter borehole 156 intersects a portion of the forward cutter borehole 150 and the forward and the rearward cutter boreholes 150 and 156 define the single borehole 88.

The overall height of the borehole 88, which is excavated in a manner illustrated in FIG. 2, is the combined heights 154 and 160, and the combined heights 154 and 160 is limited via the size of the cutting diameters of the forward and the rearward cutters 52 and 64. Thus, the overall height of the borehole 88 is limited via the practical design limitations controlling the cutting diameters of the forward and the rearward cutters 52 and 64. Although the cutting lengths of the forward and the rearward cutters 52 and 64 are limited via practical design limitations, the cutting lengths of the forward and the rearward cutters 52 and 64 are each larger than combined cutting diameters of the forward and the rearward cutters 52 and 64 in most practical designs.

In some instances, the coal seam 26 may be thicker or, in other words, have a height larger than the height contemplated via the miner 12 operation illustrated in FIGS. 3 and 4. In this particular application, the miner 12 is constructed such that the miner 12 can be rotated ninety degrees (90°) with respect to the orientation of the miner 12 illustrated in FIGS. 2 and 4 and associated with the operation illustrated in FIGS. 3 and 4, and, in this position, the miner 12 can be moved into and withdrawn from the coal seam 26, the miner 12 excavating the forward cutter borehole 150A and the rearward cutter borehole 156A through the coal seam 26 which are oriented in a manner illustrated in FIG. 5. When the miner 12 is operated in the manner illustrated in FIG. 5 the forward cutter borehole 150A has a width 152A and a height 154A, the width 152A being defined via the cutting diameter of the forward cutter 52 and the height 154A being defined via the cutting length of the forward cutter 52. Further, when the miner 12 is operated in the manner illustrated in FIG. 5 the rearward cutter borehole 156A has a width 158A and height 160A, the width 158A being essentially defined via the cutting diameter of the rearward cutter 64 (a portion of the rearward cutter 64 being disposed within a portion of the forward cutter borehole 150A in the material engaging position, for reasons described before) and the height 160A being defined via the cutting length of the rearward cutter 64.

Assuming the forward cutter 52 has a cutting diameter of about 3.0 feet and a cutting length of about 11.0 feet, for example, and assuming the rearward cutter 64 has a cutting diameter of about 3.0 feet and a cutting length of about 8.5 feet, for example, the forward cutter borehole 150 will have a width 152 of about 11.0 feet and a height 154 of about 3.0 feet, and the rearward cutter borehole 156 will have a width 158 of about 8.5 feet and a height 160 of about 2.5 feet, the height 160 being slightly less than the cutting diameter of the rearward cutter 64 for reasons described before. Utilizing a forward cutter 52 and a rearward cutter 64 having the same dimension just described in the operational embodiment illustrated in FIG. 5, the forward cutter borehole 150A will have a width 152A of about 3.0 feet and a height 154A of about 11.0 feet, and the rearward cutter borehole 156A will have a width 158A of about 2.5 feet and a height 160A of about 8.5 feet.

Figure 6:
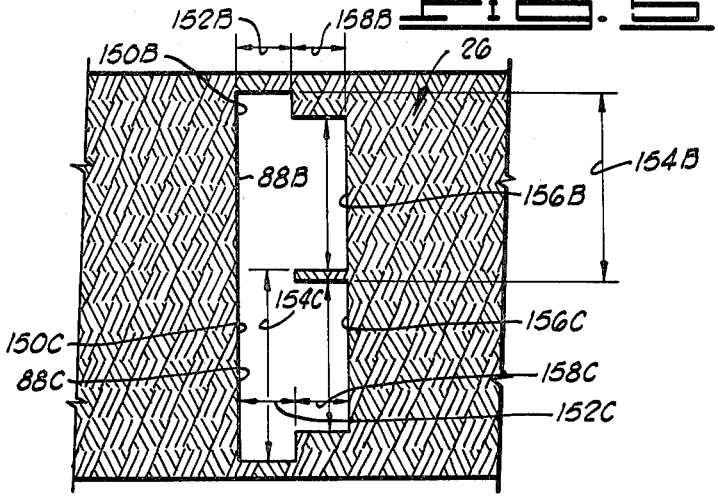
FIG. 6 is a view similar to FIGS. 3 and 5, but showing the borehole formed via the mining apparatus of the present invention in yet another operational mode of the miner.
Figure 8:
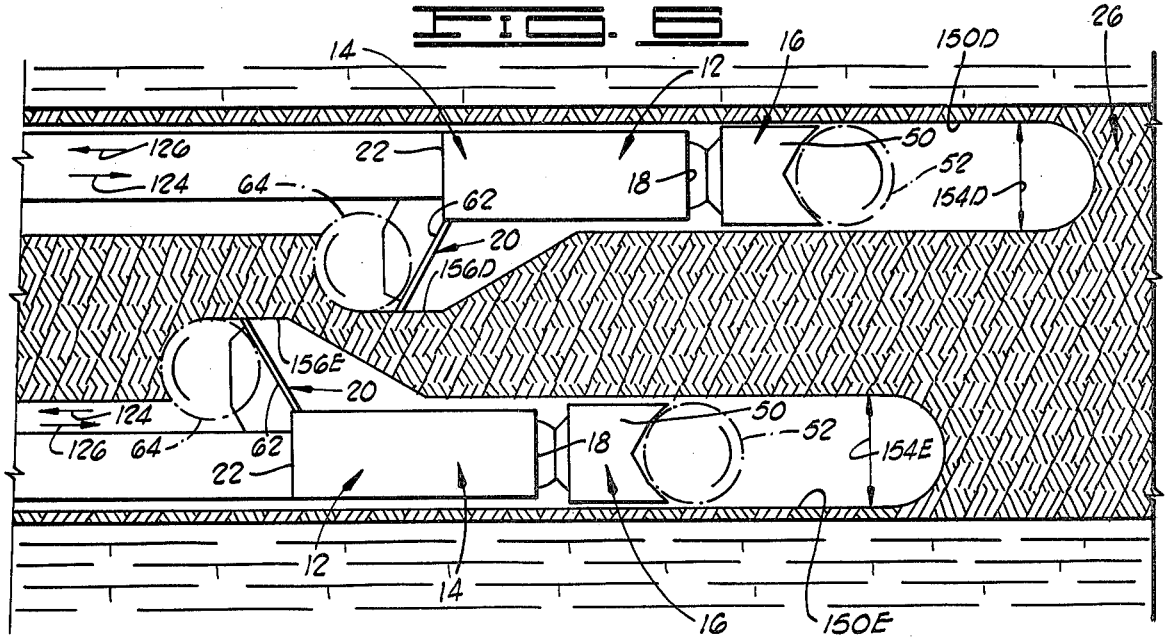
FIG. 8 is a view similar to FIG. 4, but showing two boreholes formed in the coal seam via the mining apparatus of the present invention, the miner being shown schematically disposed in each borehole.
Figure 12:
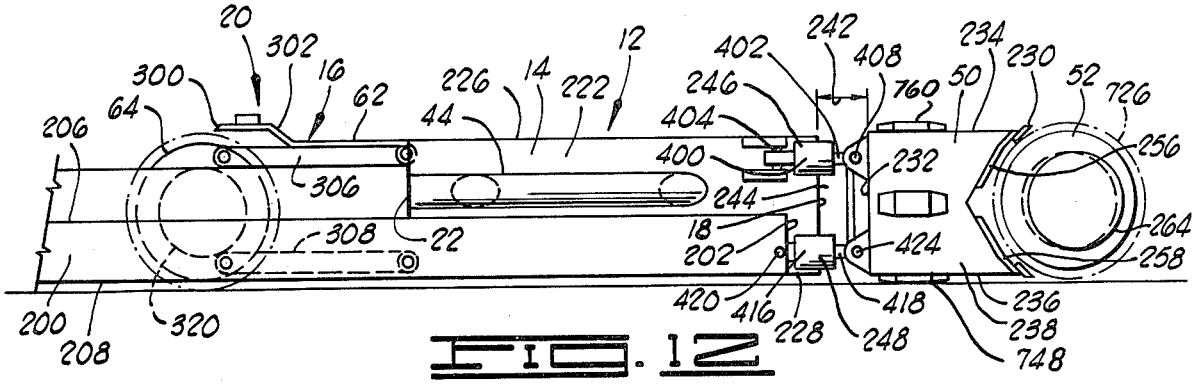
FIG. 12 is a side elevational view of the miner of FIGS. 10 and 11 showing the opposite side of the miner relative to the side of the miner shown in FIG. 10.

One other operational mode is illustrated in FIG. 6 wherein the miner 12 is oriented in a manner described before in connection with FIG. 5. In this position, the miner 12 is driven into the coal seam 26 in a manner forming a first forward cutter borehole 150B and then the miner 12 is withdrawn from the coal seam 26 in a manner forming a first rearward cutter borehole 156B, the boreholes 150B and 156B cooperating to form the first borehole 88B. After the first borehole 88B has been formed, the miner 12 is repositioned and driven into the coal seam 26 in a manner forming a second forward cutter borehole 150C and then the miner 12 is withdrawn from the coal seam 26 in a manner forming a second rearward cutter borehole 156C, the boreholes 150C and 156C cooperating to form the second borehole 88C. The miner 12, more particularly, is positioned such that a portion of the second forward cutter borehole 150C intersects a portion of the first cutter borehole 150B and such that the second borehole 88C is disposed generally below the first borehole 88B, the first borehole 88B being oriented and passing generally along the roof of the coal seam 26 and the second borehole 88C being oriented and passing generally along the floor or bottom of the coal seam 26, as shown in FIG. 6. When the miner 12 is operated in a manner illustrated in FIG. 6 and assuming the forward and the rearward cutters 52 and 64 each have dimensions substantially the same as described before in connection with the example associated with FIG. 5, the miner 12 can be operated in a manner illustrated in FIG. 6 to form a borehole having an overall height of about 22.0 feet (the combination of the heights 154B and 154C), which may be desirable in some applications where the coal seam 26 is of a sufficient thickness.

Figure 7:
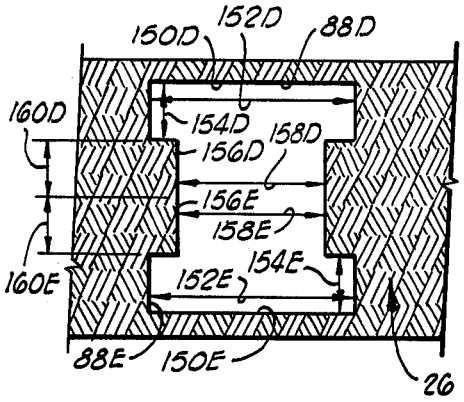
FIG. 7 is a view similar to FIGS. 3, 5 and 6, but showing the borehole formed via the mining apparatus of the present invention in still another operational mode of the miner.
Figure 8:
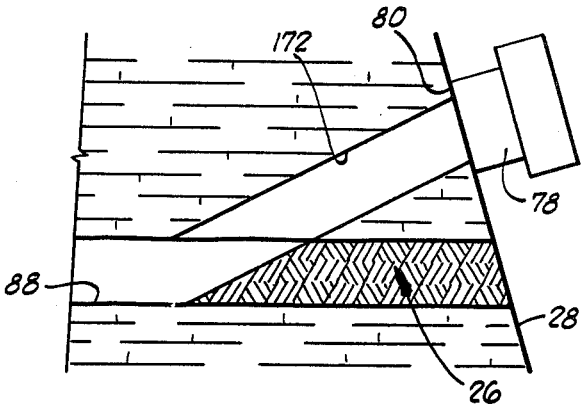

One further operational mode is illustrated in FIGS. 6 and 7 wherein the miner 12 is oriented and disposed in an inverted position (rotated about one hundred and eighty degrees [180°] with respect to the orientation of the miner 12 illustrated in FIGS. 1, 2, 3, and 4). In this inverted position of the miner 12, the miner 12 is moved into the coal seam 26 in a manner forming a first forward cutter borehole 150D, and the miner 12 is withdrawn from the coal seam 26 in a manner forming a first rearward cutter borehole 156D, the first boreholes 150D and 156D cooperating to define the first borehole 88D. The first borehole 88D is formed generally along the roof of the coal seam 26. After the first borehole 88D has been formed in the coal seam 26, the miner 12 then is oriented in the position illustrated in FIGS. 1, 2, 3 and 4, and, in this position, the miner 12 position is driven into the coal seam 26 in a manner forming the second forward cutter borehole 150E, the miner 12 being withdrawn through the coal seam 26 in a manner forming the second rearward cutter borehole 156E and the second boreholes 150E and 156E cooperating to define the second borehole 88E. More particularly, the miner 12 is positioned such that the second borehole 88E is formed generally near the floor or bottom of the coal seam 26 and such that the second rearward cutter borehole 156E intersects the first rearward cutter borehole 156D, the boreholes 88D and 88E cooperating to define a single continuous borehole extending through the coal seam 26, as shown more clearly in FIG. 7.

Thus, assuming the miner 12 has a forward cutter 52 having a cutting diameter of about 3.0 feet and a cutting length of about 11.0 feet and assuming the miner 12 has a rearward cutter 64 having a cutting diameter of about 3.0 feet and a cutting length of about 8.5 feet, the miner 12 can be oriented and operated in a manner illustrated in FIGS. 1, 2, 3, and 4 to excavate coal seams having a thickness or height of between about 3.0 feet to about 6.0 feet by controlling the position of the rearward cutter 64, the rearward cutter 64 being positioned in the storage position during the withdrawal of the miner 12 from the coal seam, the rearward cutter 64 being positioned in the storage position during the withdrawal of the miner 12 when excavating coal seams having a height of about 3.0 feet and the rearward cutter 64 being fully extended and positioned in the material engaging position during the withdrawal of the miner 12 when excavating coal seams having a height of about 6.0 feet. Further, assuming these same dimensions, the miner 12 can be oriented and operated in a manner illustrated in FIG. 6 to excavate coal seams having a height between about 11.0 feet and 22.0 feet. In addition, the miner 12 can be positioned and operated in a manner illustrated in FIGS. 7 and 8 to excavate coal seams having a height between about 6.0 feet and about 12.0 feet.

Embodiment of FIG. 9

The mining apparatus 10 of the present invention is constructed and operated such that the borehole 88 formed through the coal seam 26 is filled with working fluid and the working fluid is maintained within the borehole 88 under a hydrostatic pressure during the excavation of the coal seam 26, for reasons described before. If the coal seam 26 passes through the earth at a dip 170 (shown in FIGS. 1 and 2), it has been found that the working fluid is maintained under a sufficient hydrostatic pressure when the dip 170 is at least about five degrees (5°).

When utilizing the mining apparatus 10 of the present invention to excavate coal from a coal seam 26 which has a dip 170 of less than about five degrees (5°), the caisson 78 is positioned above the coal seam 26 and, in this position, the caisson 78 is sealingly engaged with the highwall 28. Thus, the miner 12 is launched into the highwall 28 and the adjacent earth formation at a position generally above the coal seam 26, the miner 12 being forced through the earth formation along a path which gradually slopes downwardly into the underlying coal seam 26, as shown in FIG. 9. In the embodiment shown in FIG. 9, a borehole 172 first is formed through a portion of the earth formation generally above the coal seam 26, the borehole 172 being formed along a path which gradually slopes in a downward direction. The gradually sloping borehole 172 intersects the coal seam 26 and thus the miner 12 is driven through the earth formation in a manner forming the borehole 172 and then the miner 12 is driven into and subsequently withdrawn from the coal seam 26 in a manner described before with respect to FIGS. 1 and 2. The working fluid fills the borehole 172 and the borehole 88 and, since the borehole 172 slopes downwardly into the coal seam 26, the working fluid maintained within the borehole 172 functions to maintain the working fluid within the borehole 88 under the required hydrostatic pressure, the method of operation illustrated in FIG. 9 providing one method for substantially assuring a positive fluid head on the portions of the coal seam 26 excavated via the miner 12.

Embodiment of FIGS. 10, 11, 12, 13, 14, 15, 16, 17 and 18

Referring more particularly to the construction of the miner 12, the miner 12 includes: a first beam 200, having a forward end 202, a rearward end 204, an upper surface 206 and a lower surface 208; and a second beam 210, having a forward end 212, a rearward end 214, an upper surface 216 and a lower surface 218, the second beam 210 being spaced a distance 220 from the first beam 200 and extending generally parallel with respect to the disposition of the first beam 200. The frame 14 also has a first side 222, a second side 224, an upper side 226 and a lower side 228. The distance 220 is sized such that the first beam 200 is disposed near one of the walls formed in the coal seam 26 via the borehole 88 and such that the second beam 210 is disposed near another wall formed in the coal seam 26 via the borehole 88 during the operation as the miner 12 is moved into and withdrawn from the coal seam 26. The spacing of the first and second beams 200 and 210 in this manner substantially protects the beams 200 and 210 from "roof falls" where a portion of the roof formed in the coal seam 26 via the borehole 88 collapses and falls into the borehole 88, since such falls generally occur near the mid-portion of the borehole roof rather than near the sides.

The frame 14 is disposed and supported generally between the first and the second beams 200 and 210 with the first side 222 of the frame 14 being disposed generally adjacent a portion of the first beam 200, generally near the forward end 202 of the first beam 200, and the second side 224 of the frame 14 being disposed generally adjacent a portion of the second beam 210, generally near the forward end 212 of the second beam 210. In this position, the first beam 200 is secured to the first side 222 of the frame 14 and the second beam 210 is secured to the second side 224 of the frame 14, the lower side 228 of the frame 14 being disposed in a plane generally coplanar with respect to the planar disposition of the lower surfaces 208 and 218 of the first and the second beams 200 and 210, respectively.

In the assembled position of the frame 14 and the first and the second beams 200 and 202, the forward end 18 of the frame 14 extends a distance beyond the forward ends 202 and 212 of the first and the second beams 200 and 210, respectively, and the rearward end 22 of the frame 14 is disposed generally between the forward ends 202 and 212 and the rearward ends 204 and 214 of the first and second beams 200 and 210, respectively. Further, in the assembled position of the frame 14 and the first and the second beams 200 and 210, the upper side 226 of the frame 14 is spaced a distance above the upper surfaces 206 and 216 of the first and the second beams 200 and 210, respectively.

The forward cutter frame 50 has a forward end 230, a rearward end 232, an upper side 234, a lower side 236, a first side 238 and a second side 240. The rearward end 232 of the forward cutter frame 50 is positioned generally near and spaced a distance 242 from the forward end 18 of the frame 14. The rearward end 232 of the forward cutter frame 50 is movably connected to the forward end 18 of the frame 14 via a universal connection 244, a portion of the universal connection 244 being connected to the rearward end 232 of the forward cutter frame 50 and a portion of the universal connection 244 being connected to the forward end 18 of the frame 14. The forward cutter frame 50 is movably positionable about axes defined by centerlines extending through the center of the pivotal connection between the frame 14 and the forward cutter frame 50 provided by the universal connection 244.

The forward cutter positioning assembly 58 includes a first steering cylinder 246, a second steering cylinder 248, a third steering cylinder 250, a fourth steering cylinder 252 and a roll cylinder 254. Each of the cylinders 246, 248, 250, 252 and 254 are connected to the frame 14 and to the forward cutter frame 50 and operated in a manner for movably positioning the forward cutter frame 50 with respect to the frame 14 generally about pivotal axes defined via the universal connection 244. The steering cylinders 246, 248, 250 and 252 and the roll cylinder 254 are each operated to position the forward cutter frame 50 in predetermined positions with respect to the frame 14 and with respect to pivotal axes defined via the universal connection 244 as the miner 12 is launched into and through the coal seam 26 in the direction 124 and as the miner 12 is withdrawn through the coal seam in the withdrawal direction 126, in a manner to be described in greater detail below.

The forward end 230 of the forward cutter frame 50 includes an inclined upper moldboard 256 and an inclined lower moldboard 258, the upper and the lower moldboards 256 and 258 each extending in a direction generally toward a central portion of the forward end 230 and in a direction generally from the forward end 230 toward the rearward end 232 of the forward cutter frame 50. The upper moldboard 256 extends a distance above the upper surface 234 the forward cutter frame 50 and the lower moldboard 258 extends a distance below the lower surface 236 of the forward cutter frame 50.

An opening 260 (shown in FIG. 13) is formed through a central portion of the forward end 230 of the forward cutter frame 50 and a passageway 262 is disposed within the forward cutter frame 50, one end of the passageway 262 being connected to the forward end 230 and encompassing the opening 260 formed in the forward end 230 and the opposite end of the passage 262 being connected to the rearward end 232 of the forward cutter frame 50. The passageway 262 extends through a central portion of the forward cutter frame 50 generally between the first and the second sides 238 and 240 and generally between the upper and the lower sides 234 and 236, for reasons to be made more apparent below.

In one embodiment, a plurality of spaced bars or rods (not shown) are secured to the forward end 230, each of the bars or rods extending across the opening 260 and cooperating to form a filter for restricting the size of the particles of mined material passing through the opening 260 and into the passageway 262. The forward cutter 52 operates to continually engage and crush the large particles of mined material until such particles have been crushed to a size sufficiently small to pass through the filter formed via the bars or rods and into the passageway 262.

The forward cutter 52 is disposed generally near the forward end 230 of the forward cutter frame 50 and the forward cutter 52 is journally mounted on the forward end 230 of the forward cutter frame 50.

The forward cutter 52 includes a cutter shaft 264 having a first flight of vanes 266 extending a distance generally radially from the cutter shaft 264 and extending helically about the cutter shaft 264 in generally clockwise direction, and a second flight of vanes 268 extending a distance generally radially from the cutter shaft 264 and extending helically about the cutter shaft 264 in a generally counterclockwise direction. The first flight of vanes 266 is oriented about the cutter shaft 264 to engage and move the excavated material (coal) generally toward the central portion of the forward end 230 in a direction generally from the first side 238 toward the second side 240, and the second flight of vanes 268 is oriented about the cutter shaft to engage and move the excavated material (coal) generally toward a central portion of the forward end 230 in a direction generally from the second side 240 toward the first side 238. Thus, the first and the second flights of vanes 266 and 268 are oriented to engage and move the excavated material (coal) into the opening 260 formed in the forward end 230 of the forward cutter frame 50, the excavated material (coal) being moved into the opening 260 and through the passageway 262 as the miner 12 is being moved into and through the coal seam 26 in the direction 124. It should be noted that the vanes 266 and 268 act in the nature of pump during the operation of the forward cutter 52 for moving the slurry comprising the mined material and the working fluid into and through the passageway 262.

The upper moldboard 256 and the moldboard 258 are each oriented with respect to the forward cutter 52 such that the upper and the lower moldboards 256 and 258 cooperate to encompass a portion of the forward cutter 52 in a mounted position of the forward cutter 52 on the forward cutter frame 50. The upper moldboard 256 and the lower moldboard 258 are each sized with respect to the diameter of the forward cutter 52 such that a space 269 exists between the outermost end of the upper moldboard 256 and the adjacent portion of the coal seam 26 formed via the borehole 88 and such that a space 271 exists between the outmost end of the lower moldboard 258 and the adjacent portion of the coal seam 26 formed via the borehole 88. The spaces 269 and 271 form orifices between the moldboards 256 and 258 and adjacent portions of the coal seam. During the operation of the miner 12, the working fluid passes through the orifices formed via the spaces 269 and 271 between the moldboards 269 and 271 and the adjacent portions of the coal seam 26 formed via the borehole 88 and into the area generally about the forward cutter 52, the working fluid operating to facilitate the removal of the mined material in a manner described before. As the working fluid passes through the spaces 269 and 271, a pressure drop is created across the orifices formed via the spaces 269 and 271 and the pressure of the working fluid on one side of the orifices in a direction generally from the forward end 230 toward the rearward end 232 of the forward cutter frame 50 is greater than the pressure of the working fluid on the other side of the orifices in a direction generally from the rearward end 232 toward the forward end 230 of the forward cutter frame 50. This differential pressure drop across the orifices formed via the spaces 269 and 271 results in a component of force acting against the end face of the portion of the coal seam 26 formed via the borehole 88 which is excavatingly engaged via the forward cutter 52 and this component of force facilitates the cutting the material to be mined via the forward cutter 52. Further, the flow of the working fluid through the spaces 269 and 271 tends to move all of the mined material into the mined material removal system 34 and thus substantially reduces any loss of mined material as a result of leaving such lost mined material in the borehole 88.

In addition to the foregoing, the upper and the lower moldboards 256 and 258 cooperate with the forward end 230 of the forward cutter frame 50 to retain the material (coal) excavated via the forward cutter 52 within a space generally defined via the forward end 230 of the forward cutter frame 50 and the portion of the coal seam 26 which is being excavatingly engaged via the forward cutter 52. Thus, the forward end 230 of the forward cutter frame 50 is shaped to cooperate with the forward cutter 52 to assure that substantially all of the material (coal) excavatingly dislodged via the forward cutter 52 is moved into and through the passageway 262 as the miner 12 is moved in the direction 124 through the coal seam 26, the movement of the miner 12 through the coal seam 26 in the direction 124 cooperating with the forward cutter 52 to cause the material (coal) excavatingly dislodged via the forward cutter 52 to be moved through the passageway 262 in the forward cutter frame 50.

The universal connection 244 includes a spherically shaped member 270, having an outer surface 272, which is secured to the rearward end 232 of the forward cutter frame 50 at a position generally midway between the first and the second sides 238 and 240 of the forward cutter frame 50. A passageway 274 is formed through a central portion of the member 270 (shown in FIG. 13), one end of the passageway 274 intersecting one portion of the spherically shaped member 270 and forming an opening 276 in the outer surface 272 of the member 270 and the opposite end of the passageway 274 intersecting a portion of the member 270 and forming an opening 278 extending through the outer surface 272 of the member 270. The member 270 is oriented on the forward end 230 such that the opening 276 is generally aligned with the passageway 262 extending through the forward cutter frame 50. One portion of the passageway 274, generally near the opening 278, is enlarged with respect to the remaining portion of the passageway 274 and thus the opening 278 is larger than the opening 276, for reasons which wll be made more apparent below.

Figure 13:
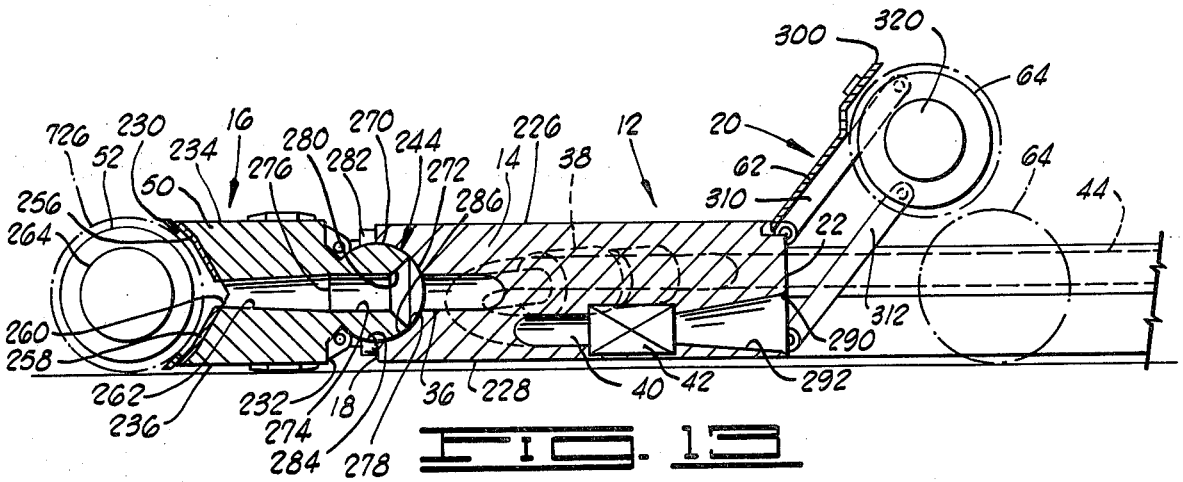
FIG. 13 is a sectional view of the miner shown in FIGS. 10, 11 and 12.

A housing 282 is connected to the forward end 18 of the frame 14 and an opening 284 is formed through the housing 282, the opening 284 being shaped to journally or bearingly engage a portion of the outer surface 272 of the member 270. An opening 286 formed in a central portion of the forward end 18 of the frame 14 and the opening 286 is shaped to journally or bearingly engage a portion of the outer surface 272 of the member 270. In the assembled position, as shown in FIG. 13, a portion of the member 270, generally opposite the portion of the member 270 which is connected to the forward cutter frame 50, is disposed in the opening 286 and the housing 282 extends about a portion of the member 270 or, more particularly the member 270 extends through the opening 284 formed in the housing 282. The opening 284 is aligned with the opening 286 in the frame 14 and the openings 284 and 286 cooperate to provide a bearing surface for engaging the member 270 as the member 270 is moved about axes defined via the universal connection 244. The housing 282 engages the member 270 and secures the member 270 in a connected position to the frame 14 while allowing the member 270 to be pivotally moved about the axes defined via the universal connection 244 during the operation of the miner 12.

The conduit 36 is disposed within a portion of the frame 14 and one end of the conduit 36 is supported generally adjacent the opening 278 formed through the member 270, the conduit 36 being in fluidic communication with the passageway 274 formed through the member 270 via the opening 278. The enlarged portion 280 of the passageway 274 is sized such that the opening 278 is larger than the opening through the conduit 36 and thus the enlarged portion 280 operates to maintain fluidic communication between the passageway 274 and the conduit 36 as the member 270 is pivotally moved about axes defined via the universal connection 244 during the operation of the miner 12.

Figure 11:
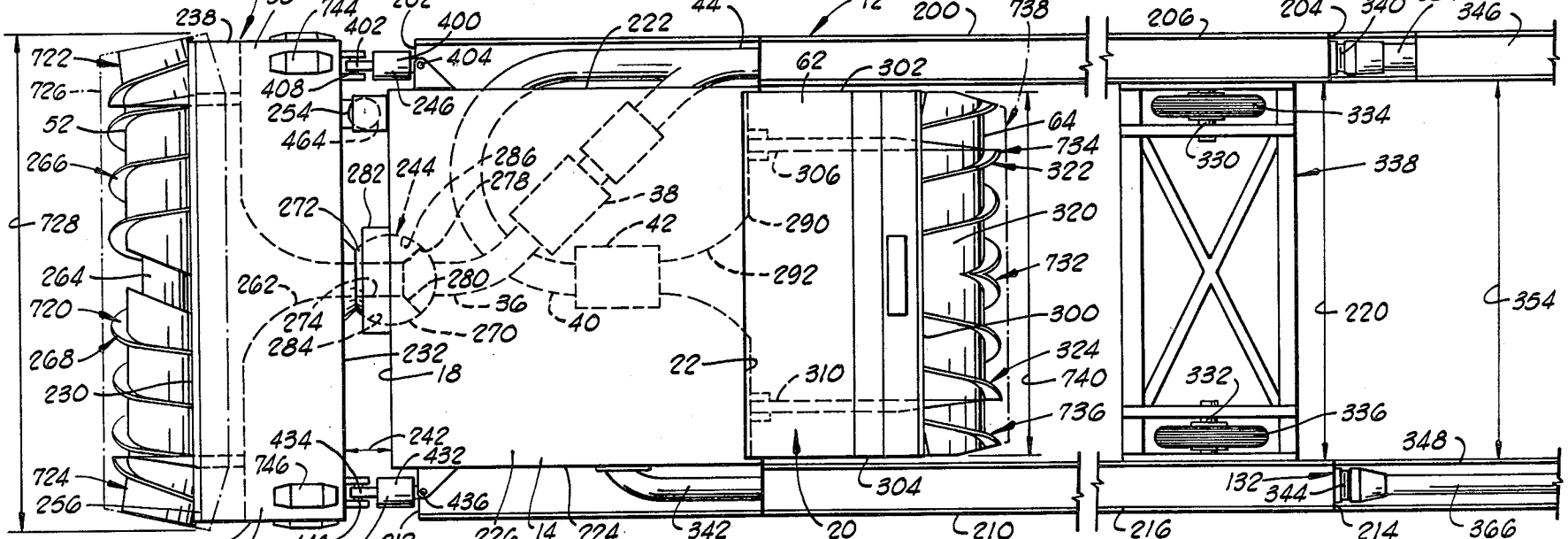
FIG. 11 is a plan view of the miner of FIG. 10.

As shown more clearly in FIG. 11, the conduit 36 extends through the frame 14 and the end of the conduit 36, generally opposite the end of the conduit 36 which is disposed near the universal connection 244, is connected to the conduit 44, a portion of the conduit 36 extending through the first side 222 of the frame 14. An opening 290 is formed through a central portion of the rearward end 22 of the frame 14, generally midway between the first and the second sides 222 and 224 of the frame 14. The conduit 40 and the valve 42 interposed in the conduit 40 are each disposed within a portion of the frame 14. A portion 292 of the conduit 40 is enlarged with respect to the remaining portion of the conduit 40 and the enlarged end portion of the conduit 40 is connected to the rearward end 22 of the frame 40, the conduit 40 being oriented such that the opening formed through the enlarged end portion of the conduit 40 is in fluidic communication with the opening 292 formed through the rearward end 22 of the frame 14. The end of the conduit 40, opposite the end connected to the rearward end 22 of the frame 14, extends through a portion of the frame 14 and passes through the second side 222 of the frame 14, the end of the conduit 40, opposite the end of the conduit 40 connected to the rearward end 22 of the frame 14, is connected to the conduit 44. Thus, the opening 290 and the conduit 40 provide a passageway which extends through a portion of the frame 14 and is connected to the conduit 44, the passageway provided via the opening 290 and the conduit 40 providing communication between the rearward end 22 of the frame 14 and the conduit 44, for reasons which will be made more apparent below.

One end of the rearward cutter frame 62 is pivotally connected to the rearward end 22 of the frame 14, and the rearward cutter frame 62 extends a distance generally from the rearward end 22 of the frame 14 terminating with an outer most end 300. The rearward cutter frame 62 has a first side 302 and a second side 304 and the rearward cutter frame 62 is disposed generally between the first and the second beams 200 and 210, the first side 302 of the rearward cutter frame 62 being disposed generally near the first beam 200 and the second side 304 of the rearward cutter frame 62 being disposed generally near the second beam 210 in the storage position of the rearward cutter assembly 20 (shown in dashed-lines in FIGS. 10 and 13).

The rearward cutter 64 is pivotally connected to the rearward end 22 of the frame 14 and disposed generally between the first and the second beams 200 and 210. More particularly, the rearward cutter assembly 20 includes a first pair of pivot arms 306 and 308. One end of the pivot arm 306 is pivotally connected to the rearward end 22 of the frame 14 and the opposite end of the pivot arm 306 is pivotally connected to the rearward cutter 64. One end of the pivot arm 308 is pivotally connected to the rearward end 22 of the frame 14 and the opposite end of the pivot arm 308 is pivotally connected to the rearward cutter 64.

The rearward cutter assembly 20 also includes a second pair of pivot arms 310 and 312. One end of the pivot arm 310 is pivotally connected to the rearward end 22 of the frame 14 and the opposite end of the pivot arm 310 is connected to the rearward cutter 64. One end of the pivot arm 312 is pivotally connected to the rearward end 22 of the frame 14 and the opposite end of the pivot arm is pivotally connected to the rearward cutter 64.

The pivot arms 306, 308, 310 and 312 cooperate to pivotally secure the rearward cutter 64 to the rearward end 22 of the frame 14. The pivot arms 306, 308, 310, and 312 are disposed generally between the first and the second beams 200 and 210 and, in the storage position of the rearward cutter assembly 20, the pivot arms 306, 308, 310 and 312 each extend a distance from the rearward end 22 of the frame 14 and each is disposed generally between the first and the second beams 200 and 210. In one embodiment, the rearward cutter frame 62 is secured to the pivot arms 306 and 310 and, in this embodiment, the pivot arms 306 and 310 structurally support the rearward cutter frame 62 and pivotally connect the rearward cutter frame 62 to the frame 14. A pair of rear cylinders 316 and 318 are connected to the rearward end 22 of the frame 14 and to the rearward cutter frame 62 for pivotally moving the rearward cutter assembly 32 to a storage position and to a material engaging position.

The rearward cutter 64 includes a cutter shaft 320 having a first flight of vanes 322 extending a distance generally radially from the cutter shaft 320 and extending helically about the cutter shaft 320 in a generally counterclockwise direction, and a second flight of vanes 324 extending a distance generally radially from the cutter shaft 320 and extending helically about the cutter shaft 320 in generally a clockwise direction. The first flight of vanes 322 is oriented about the cutter shaft 320 to engage and move the excavated material (coal) generally toward a central portion of the rearward end 22 of the frame 14 in a direction generally from the first side 222 toward the second side 224, and the second flight of vanes 324 is oriented about the cutter shaft 320 to engage and move the excavated material (coal) generally toward the central portion of the rearward end 22 in a direction generally from the second side 224 toward the first side 222. Thus, the first and the second flights of vanes 322 and 324 are oriented to engage and move the excavated material (coal into the opening 290 formed in the rearward 22 of the frame 14, the excavated material (coal) being moved into the opening 290 and through the passageway defined via the conduit 40 as the miner 12 is being moved through the coal seam 26 in the withdrawal directin 126.

One end of an axle 330 is connected to the first beam 200, generally near the rearward end 204 thereof, and one end of an axle 332 is connected to the second beam 210, generally near the rearward end 214 thereof, the axles 330 and 332 being disposed generally near the rearward ends 204 and 214. A first wheel 334 is bearingly mounted on the axle 330 and disposed generally near the first beam 200. A second wheel 336 is bearingly mounted on the axle 332 and disposed generally near the second beam 210. The wheels 334 and 336 cooperate to reduce friction and to rollingly support the rearward end of the miner 12.

A framework 338 is disposed between the first and the second beams 200 and 210, generally near the rearward ends 204 and 214. One end of the framework 338 is connected to the first beam 200 and the opposite end of the framework 338 is connected to the second beam 210. The framework 338 structurally supports the rearward end portions of the first and the second beams 200 and 210 in the spaced-apart relationship.

The conduit 44 extends along the first beam 200 and terminates with a threaded end 340, which is disposed generally near the rearward end 204 of the first beam 200. One end of a conduit 342 is connected to the frame 14 and the conduit 342 extends along the second beam 210 terminating with a threaded end 344, which is disposed generally near the rearward end 214 of the second beam 210. The various control lines 32, 56, 60, 68, 72, 98, 102 and 104 extend through conduit 342 from the remote unit 74 to various components and assemblies of the miner 12.

Figure 14:
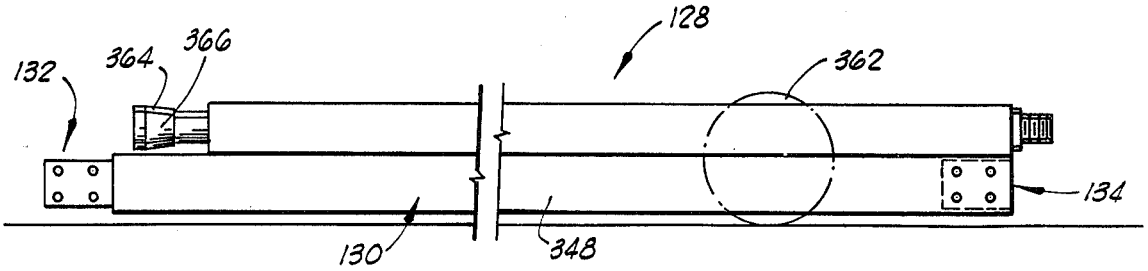
FIG. 14 is a side elevational view of a typical carrier.
Figure 15:
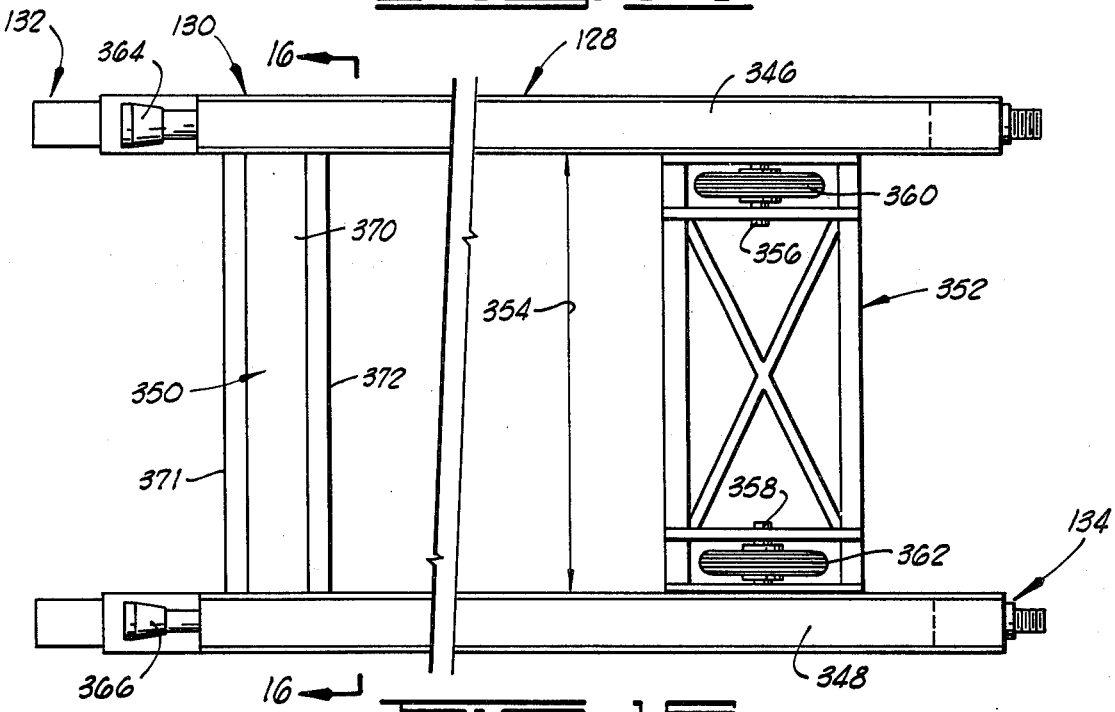
FIG. 15 is a plan view of the carrier of FIG. 14.
Figure 16:
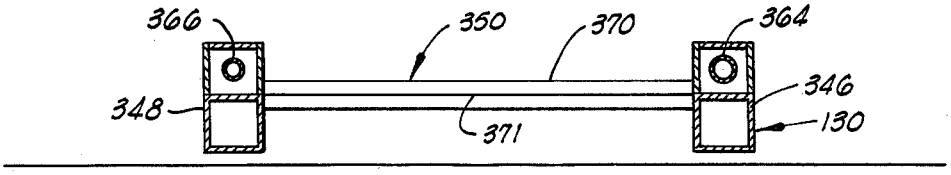
FIG. 16 is a sectional view of the carrier of FIGS. 14 and 15, taken substantially along the lines 16—16 of FIG. 15.

As shown more clearly in FIGS. 14, 15 and 16 and in one embodiment, the carriers 128 are each constructed in a similar manner and each carrier 128 includes a first carrier beam 346 and a second carrier beam 348 (only one typical carrier 128 being shown in detail in FIGS. 14, 15 and 16 for clarity). An auxiliary cutter 350 is connected to each carrer beams 346 and 348, and the auxiliary cutter 350 is disposed between the carrier beams 346 and 348 generally near the forward end 132, the forward ends of the carrier beams 346 and 348 forming the forward end 132 of the carrier. A carrier framework 352 is disposed between the carrier beams 346 and 348, generally near the rearward end 134, the rearward end 134 being formed via the rearward ends of the carrier beams 346 and 348. One end of the carrier framework 352 is connected to the first carrier beam 346 and the opposite end of the carrier framework 352 is connected to the second carrier beam 348. The auxiliary cutter 350 and the carrier framework 352 cooperate to structurally support the first and the second beams 346 and 348 in a spaced-apart relationship with the first carrier beam 346 being disposed in a generally parallel extending relationship with respect to the second carrier beam 348 and the first carrier beam 346 spaced a distance 354 from the second carrier beam.

One end of an axle 356 is connected to the first carrier beam 346, generally near the rearward end 134, and the opposite end of the axle 356 is connected to the second carrier beam 348, generally near the rearward end 134. A first wheel 360 is bearingly mounted on the axle 356 and disposed generally near the first carrier beam 346. A second wheel 362 is bearingly mounted on the axle 358 and disposed generally near the second carrier beam 348. The wheels 360 and 362 cooperate to reduce friction and to rollingly support each of the carriers 128.

A conduit 364 is disposed on the first carrier beam 346 and the conduit 364 extends along the first carrier beam 346 with one end of the conduit 364 being disposed near the forward end 132 and the opposite end of the conduit 364 being disposed near the rearward end 134. The end of the conduit 364 disposed near the forward end 132 (shown in FIGS. 14, 15 and 16) is adapted to be connected to the end 340 of the conduit 44 on the miner 12 or to the end of another conduit 364 disposed near the rearward end 134 of one of the other carriers 128. The end of the conduit 364 disposed near the rearward end 134 of the carrier 128 (shown in FIGS. 14, 15 and 16) is adapted to be connected to the end of another conduit 364 disposed near the forward end 132 of one of the other carriers 128.

A conduit 366 is disposed on the second carrier beam 348 and the conduit 366 extends along the second carrier beam 348 with one end of the conduit 366 being disposed near the forward end 132 and the opposite end of the conduit 366 being disposed near the rearward end 134. The end of the conduit disposed near the forward end 132 of the carrier 128 (shown in FIGS. 14, 15 and 16) is adapted to be connected to the end 344 of the conduit 342 on the miner 12 or to the end of another conduit 366 disposed near the rearward end 134 of one of the other carriers 128. The end of the conduit 366 disposed near the rearward end 134 of the carrier 128 (shown in FIGS. 14, 15 and 16) is adapted to be connected to the end of another conduit 364 disposed near the forward end 132 of one of the other carriers 128.

As shown more clearly in FIGS. 15 and 16, the auxiliary cutter 350 comprises a cutting bar 370 with one end connected to the first carrier beam 346 and the opposite end connected to the second carrier beam 348. A cutting blade or edge 371 is formed on one side of the cutting bar 370 and another cutting blade or edge 372 is formed on an opposite side of the cutting bar 370. The cutting blades 371 and 372 each extend between the carrier beams 346 and 348. The cutting blades 371 and 372 provide an additional cutting means for facilitating the moving of the mining apparatus 10 into the borehole 88 and the withdrawal of the mining apparatus 10 from the borehole 88 in the event a portion of the coal seam 26 collapses into the borehole 88 while the mining apparatus 10 is disposed in the borehole 88.

In an assembled position with one or more carriers 128 connected to the miner 12, the conduit 44 on the miner 12 is connected to and in fluidic communication with the surface unit 74 via the interconnected conduits 364 on the carriers 128 and the conduit 342 is connected to the surface unit 74 via the interconnected conduits 366 on the carriers 128. In an operational embodiment as diagrammatically illustrated in FIGS. 1 and 2, the conduit 364 on the last connected carrier 128 is connected to the mined material transfer assembly 92 via additional conduits (not specifically shown in the drawings, but diagrammatically illustrated in FIG. 2). Further, in an operational embodiment, the conduit 366 on the last connected carrier 128 is connected to the control unit 100 and to the electrical power supply 96 via additional conduits (not shown).

It should be noted that the conduit 46 connected between the compressed gas supply 90 and the mined material removal assembly 34 preferrably includes a plurality of interconnected conduits (not shown) with one of the interconnected conduits (not shown) being disposed on each carrier 128 and interconnected in a manner similar to that described before with respect to the conduits 364 and 366. In one other embodiment, the various interconnected conduits comprising the conduit 46 can be disposed within the conduits 366 and 342 along with the various control lines 32, 56, 60, 68, 72, 98, 102 and 104.

In yet another embodiment, the conduit 44 is constructed of a flexible material and the flexible conduit 44 is fed into the borehole 88 along with the driving of the miner 12 and carriers 128 into the borehole 88. In this embodiment, portions of the conduit 44 are connected to each carrier 128 after such carrier 128 is either connected to the miner 12 or to one of the other carriers 128, and the flexible conduit 44 is passed through a tension assembly 376 (one embodiment of a tension assembly 376 being shown in FIG. 1, for example) which is interposed between a supply source of the flexible conduit 44 (not shown) and the connection of the flexible conduit 44 to the last connected carrier 128, the tension assembly 376 being constructed to maintain a predetermined tension on the portions of the conduit being connected to the carriers 128 and to facilitate the feeding of the flexible conduit 44 into the borehole 88. As illustrated in FIG. 1, the tension assembly 376 also can be utilized to feed the conduit 342 (the conduit 342 being constructed of a flexible material in a manner just described with respect to the conduit 44) or, in the alternative, the tension assembly 376 can be utilized to feed the control lines 32, 56, 60, 68, 72, 98, 102 and 104 into the conduit 342 and into the various interconnected conduits 366 on the carriers 128, as the miner 12 and the carriers 128 are moved into the borehole 88.

In one embodiment, the carrier beams 346 and 348 are constructed to include enclosed, fluid-tight, void compartment or spaces, the enclosed compartments not being shown in the drawings. The void compartments (filled with air or the like) produce a buoyant effect which acts to effectively reduce the weight of the carriers 346 and 348 when emersed in the drilling fluid, thereby effectively reducing the normal forces and the friction forces associated with the carriers 128 during the operation of the miner 12. The construction of the carriers 128 in the manner just described enables the miner 12 to be utilized for boring holes having greater lengths as compared to a mining apparatus having carriers which do not include the enclosed, void, fluid-tight compartments.

Figure 17A:
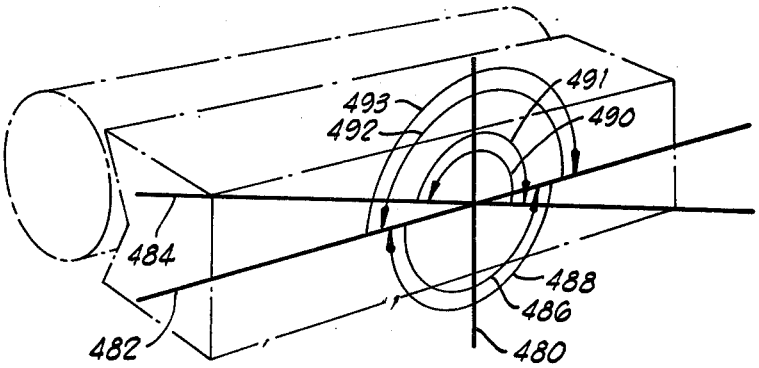
FIG. 17A is a diagrammatic view illustrating a portion of the operation of the forward cutter positioning assembly of the mining apparatus of the present invention.
Figure 10:
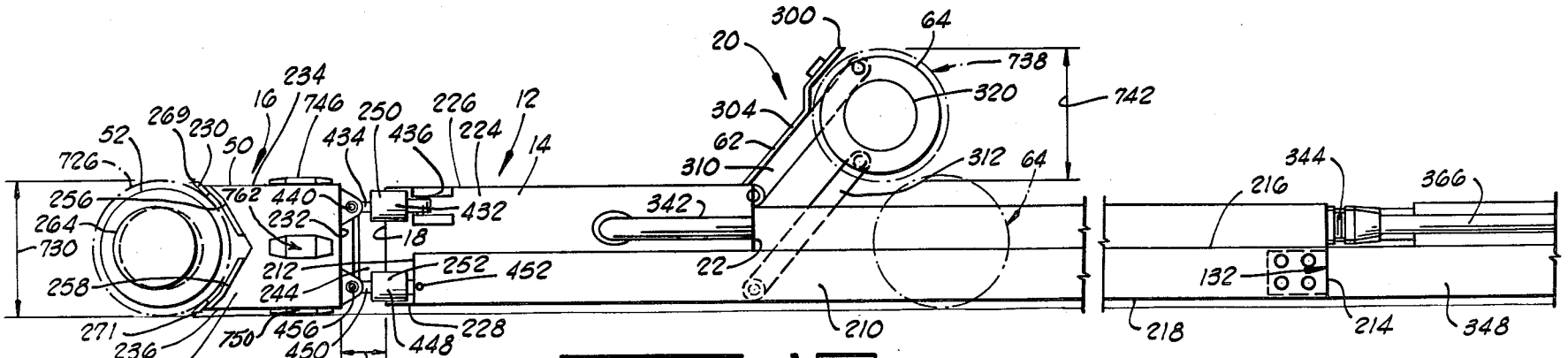
FIG. 10 is a side elevational view of the miner of the mining apparatus of FIGS. 1 and 2, showing the rearward cutter assembly in a material engaging position in solid lines and showing a portion of the rearward cutting assembly in a storage position in dashed-lines, a portion of one of the carriers being shown in FIG. 10.
Figure 17:
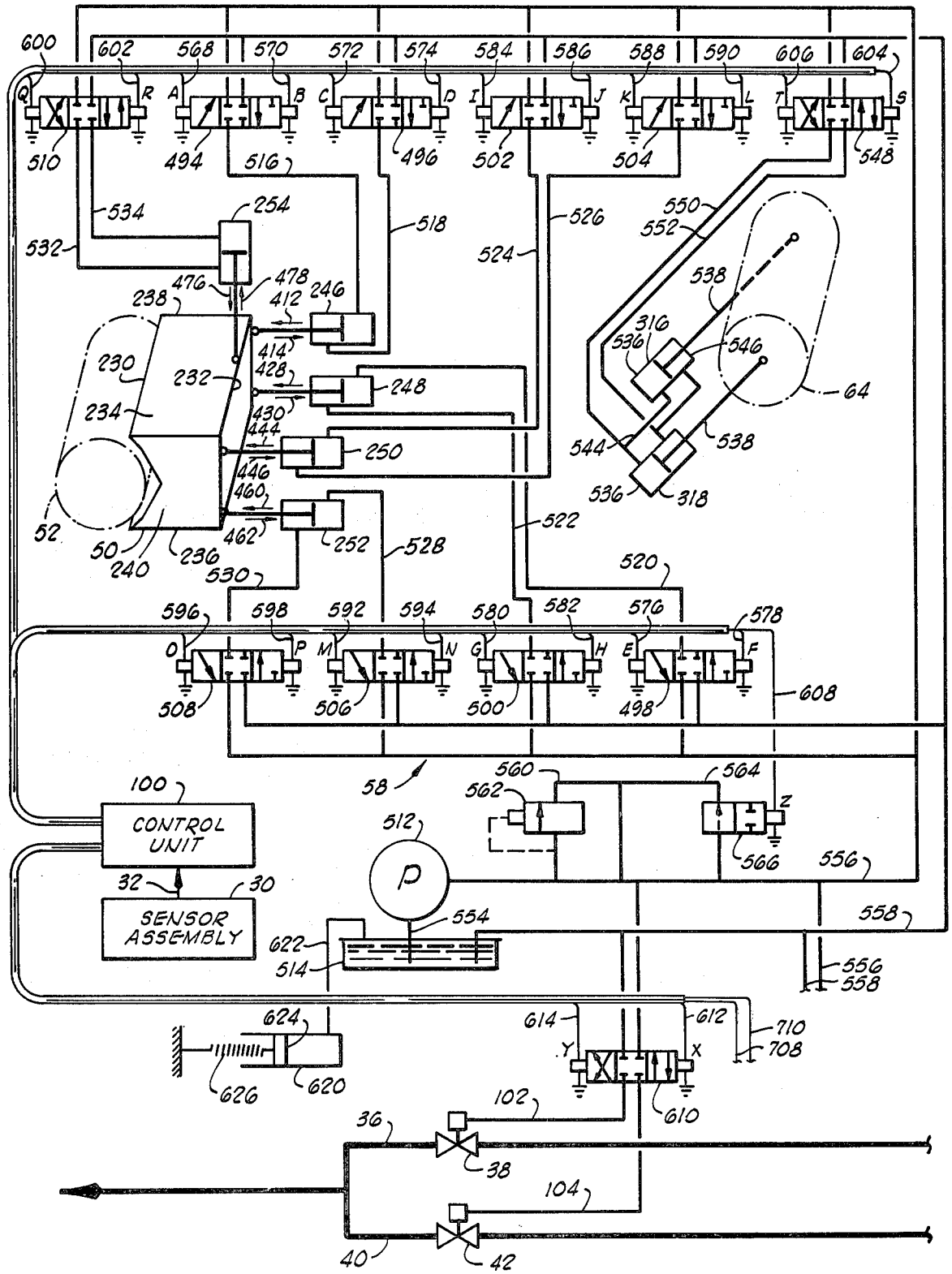
FIG. 17 is a schematic view showing some of the controls of the mining apparatus of the present invention.

One preferred embodiment of the forward cutter positioning assembly 58 is shown in detail in FIGS. 17 and 17A and, in this embodiment, the forward cutter positioning assembly 58 includes: the first steering cylinder 246, the second steering cylinder 248, the third steering cylinder 250, the fourth steering cylinder 252 and the roll cylinder 254. The description of the embodiment shown in FIGS. 17 and 17A assumes that the miner 12 is operating in one plane generally normal to the miner 12 as diagrammatically shown in FIGS. 1 and 2. However, the operation of the mining apparatus 10 in other orientations as described before will be apparent to those skilled in the art from the following descriptions.

The first steering cylinder 246, more particularly, comprises a hydraulically actuated type of cylinder and includes a cylinder base 400 and a piston rod 402 (shown in FIGS. 11 and 12), the piston rod 402 being movably mounted within the cylinder base 400 such that the piston rod 402 is moved outwardly a distance from the cylinder base 400 in one actuated condition of the first steering cylinder 246 and such that the piston rod 402 is moved inwardly a distance into the cylinder base 400 in one other actuated condition of the first steering cylinder 246. The cylinder base 400 is pivotally connected to the frame 14 via a shaft 404, generally near the forward end 18 and generally near the first side 222 of the frame 14, the opposite ends of the shaft 404 each being securedly connected to the frame 14 and pivotally connected to the cylinder base 404 such that the cylinder base 404 is pivotally movable relative to the frame 14 about an axis generally defined via the centerline of the shaft 404. The end of the piston rod 402, opposite the end of the piston rod 402 which is connected to the cylinder base 400, is pivotally connected to the forward cutter frame 50 via a shaft 408, generally near the rearward end 232 and generally near the first side 238 and generally near the upper side 234 of the forward cutter frame 50, the piston rod 402 being pivotally movable relative to the forward cutter frame 50 about an axis generally defined via the centerline axis of the shaft 408. Thus, in one actuated position of the first steering cylinder 246, the piston rod 402 is moved outwardly a distance from the cylinder base 400 and, in this actuated condition, the first steering cylinder 246 exerts a force 412 in the generally forward direction on the rearward end 232 of the forward cutter frame 50 generally near the upper side 334 and generally near the first side 238 of the forward cutter frame 50. In the one other actuated condition of the first steering cylinder 246, the piston rod 402 is moved inwardly a distance into the cylinder base 400 and, in this actuated condition, the first steering cylinder 246 exerts a force 414 on the rearward end 232 of the forward cutter frame 50, generally near the upper side 234 and generally near the first side 238 of the forward cutter frame 50.

The second steering cylinder 248, more particularly, comprises a hydraulically actuated type of cylinder and includes a cylinder base 416 and a piston rod 418, the piston rod 418 being movably mounted within the cylinder base 416 such that the piston rod 418 is moved outwardly a distance from the cylinder base 416 in one actuated condition of the second steering cylinder 248, and such that the piston rod 418 is moved inwardly a distance into the cylinder base 416 in the other actuated condition of the second steering cylinder 248. The cylinder base 416 is pivotally connected to the frame 14 via a shaft 420, generally near the forward end 18 and generally near the first side 222 and generally near the lower side 228 of the frame 14. Thus, the cylinder base 416 is pivotally movable relative to the frame 14 about an axis which generally corresponds to the centerline axis of the shaft 420, the shaft 420 being securedly connected to the frame 14 and pivotally connected to the cylinder base 416. The end of the piston rod 418, opposite the end of the piston rod 418 which is movably connected to the cylinder base 416, is pivotally connected to the rearward end 232 of the forward cutter frame 50, generally near the first side 238 and generally near the lower side 236 of the forward cutter frame 50, the piston rod 418 being pivotally connected to the forward cutter frame 50 via a shaft 424 such that the second steering cylinder 248 is movable relative to the forward cutter frame 50 about an axis generally corresponding to the centerline axis of the shaft 424. The second steering cylinder 248 is disposed generally below and spaced a distance from the first steering cylinder 246.

Thus, in one actuated position of the second steering cylinder 248, the piston rod 418 is moved outwardly a distance from the cylinder base 416 and, in this actuated condition, the second steering cylinder 248 exerts a force 428 in the generally forward direction on the rearward end 232 of the forward cutter frame 50, generally near the lower side 236 and generally near the first side 238 of the forward cutter frame 50. In the one other actuated condition of the second steering cylinder 248, the piston rod 418 is moved inwardly a distance into the cylinder base 416 and, in this actuated condition, the second steering cylinder 248 exerts a force 430 in the generally rearward direction on the rearward end 232 of the forward cutter frame 50, generally near the lower side 236 and generally near the first side 238 of the forward cutter frame 50.

The third steering cylinder 250, more particularly, comprises a hydraulically actuated type of cylinder and includes a cylinder base 432 and a piston rod 434, the piston rod 434 being movably mounted within the cylinder base 432 such that the piston rod 434 is moved outwardly a distance from the cylinder base 432 in one actuated condition of the third steering cylinder 250 and such that the piston rod 434 is moved inwardly a distance into the cylinder base 432 in one other actuated condition of the third steering cylinder 250. The cylinder base 432 is pivotally connected to the frame 14, generally near the second side 224 and generally near the forward end 18 and generally near the upper side 226 of the frame 14, via a shaft 436, the shaft 436 being securedly connected to the frame 14 and pivotally connected to the cylinder base 432, such that the third steering cylinder 250 is pivotally movable with respect to the frame 14 about an axis generally defined via the centerline axis of the shaft 436. The end of the piston rod 434, opposite the end of the piston rod 434 which is movably mounted within the cylinder base 432, is pivotally connected to the rearward end 232 of the forward cutter frame 50, generally near the second side 240 and generally near the upper side 234 of the forward cutter frame 50, via a shaft 440, the shaft 440 being securedly connected to the forward cutter frame 42 and pivotally connected to the piston rod 434 such that the forward cutter frame 50 is movable with respect to the frame 14 about an axis generally defined via the centerline axis of the shaft 440.

Thus, in one actuated position of the third steering cylinder 250, the piston rod 434 is moved outwardly a distance from the cylinder base 432 and, in this actuated condition, the third steering cylinder 250 exerts a force 444 in the generally forward direction on the rearward end 232 of the forward cutter frame 50, generally near the upper side 234 and generally near the second side 240 of the forward cutter frame 50. In the one other actuated condition of the third steering cylinder 250, the piston rod 434 is moved inwardly a distance into the cylinder base 432 and, in this actuated condition, the third steering cylinder 250 exerts a force 446 in the generally rearward direction on the rearward end 46 of the forward cutter frame 50, generally near the upper side 234 and generally near the second side 240 of the forward cutter frame 50.

The fourth steering cylinder 252, more particularly, comprises a hydraulically actuated type of cylinder and includes a cylinder base 448 and a piston rod 450, the piston rod 450 being movably mounted within the cylinder base 448 such that the piston rod 450 is moved outwardly a distance from the cylinder base 448 in one actuated condition of the fourth steering cylinder 252 and such that the piston rod 450 is moved inwardly a distance into the cylinder base 448 in one other actuated condition of the fourth steering cylinder 252.

The cylinder base 448 is connected to the frame 14 generally near the lower side 228 and generally near the forward end 18 and generally near the second side 224 of the frame 14, via a shaft 452, the shaft 452 being securedly connected to the frame 14 and journally connected to the cylinder base 448 such that the forward cutter frame 50 is movable relative to the frame 14 about an axis generally defined via the centerline axis of the shaft 452. The end of the piston rod 450, opposite the end of the piston rod 450 which is movably connected to the cylinder base 448, is pivotally connected to the rearward end 232 of the forward cutter frame 50, generally near the lower side 236 and generally near the second side 240 of the forward cutter frame 50, via a shaft 456, the shaft 456 being securedly connected to the forward cutter frame 50 and journally connected to the piston rod 450 such that the forward cutter frame 50 is movable relative to the frame 14 about an axis generally defined via the centerline axis of the shaft 456.

Thus, in one actuated condition of the fourth steering cylinder 252, the piston rod 450 is moved outwardly a distance from the cylinder base 448 and, in this actuated condition, the fourth steering cylinder 252 exerts a force 460 on the rearward end 232 of the forward cutter frame 50, generally near the lower side 236 and generally near the second side 240 of the forward cutter frame 50. In the one other actuated condition of the fourth steering cylinder 252, the piston rod 450 is moved inwardly a distance into the cylinder base 448 and, in this actuated condition, the fourth steering cylinder 252 exerts a force 462 in the generally rearward direction on the rearward end 232 of the forward cutter frame 50, generally near the lower side 236 and generally near the second side 240 of the forward cutter frame 50.

The roll cylinder, 254 more particularly, comprises a hydraulically actuated type of cylinder and includes a cylinder base 464 and a piston rod 466, the piston rod 466 being movably mounted within the cylinder base 464 such that the piston rod 466 is moved outwardly a distance from the cylinder base 464 in one actuated condition of the roll cylinder 254 and such that the piston rod 466 is moved a distance inwardly into the cylinder base 464 in one other actuated condition of the roll cylinder 254. The cylinder base 464 is pivotally connected to the forward end 18 of the frame 14 generally near the first side 222 and generally between the upper and the lower sides 226 and 228 of the frame 14, via a shaft 468, the shaft 468 being securedly connected to the frame 14 and journally connected to the cylinder base 464 such that the roll cylinder 254 is movable relative to the frame 14 about an axis generally defined via the centerline axis of the shaft 468. The end of the piston rod 466, opposite the end of the piston rod 466 which is movably connected to the cylinder base 464, is pivotally connected to the rearward end 232 of the forward cutter frame 50, generally near the first side 238 and generally between the upper and the lower sides 234 and 236 of the forward cutter frame 50, via a shaft 472, the shaft 472 being securedly connected to the forward cutter frame 50 and journally connected to the piston rod 466 such that the roll cylinder 254 is movable relative to the forward cutter frame 50 about an axis generally corresponding to the centerline axis of the shaft 472.

Thus, in one actuated condition of the roll cylinder 254, the piston rod 466 is moved outwardly a distance from the cylinder base 464 and, in this actuated condition, the roll cylinder 254 exerts a force 476 in a direction generally from the upper side 234 toward the lower side 236 of the forward cutter frame 50 (or, in other words, in a generally vertically downwardly direction)

on the rearward end 232 of the forward cutter frame 50, generally near the first side 238 and generally between the upper and the lower sides 234 and 236 of the forward cutter frame 50. In the one other actuated condition of the roll cylinder 254, the piston rod 466 is moved a distance inwardly into the cylinder base 464 and, in this actuated condition, the roll cylinder 254 exerts a force 478 in a direction generally from the lower side 236 toward the upper side 234 of the forward cutter frame 50 (or, in other words, in a generally vertically upwardly direction) on the rearward end 232 of the forward cutter frame 50, generally near the first side 238 and generally between the upper and the lower sides 234 and 236 of the forward cutter frame 50.

The forward cutter frame 50 is connected to the frame 14 via the universal connection 244 such that the forward cutter frame 50 is movable relative to the frame 14 about a vertical axis 480 (FIG. 17A) extending generally vertically through a center of the pivotal connection between the forward cutter frame 50 and the frame 14 provided by the universal connection 244. The forward cutter frame 50 is movable with respect to the frame 14 about a first horizontal axis 492 (FIG. 17A) 484 which extends horizontally through a center of the pivotal connection formed between the forward cutter frame 50 and the frame 14 via the universal connection 244, the first horizontal axis 482 extending in a horizontal plane generally perpendicular to the vertical axis 480 and extending in a direction generally between the first and the second sides 238 and 240 of the forward cutter frame 50. The forward cutter frame 50 is movable with respect to the frame 14 about a second horizontal axis 482 (FIG. 17A) extending through a center of the pivotal connection between the forward cutter frame 50 and the frame 14 provided via the universal connection 244, the second horizontal axis 482 extending in a generally horizontal plane between the forward and the rearward ends 230 and 232 of the forward cutter frame 50 and being generally perpendicular with respect to the first horizontal axis 482 and with respect to the vertical axis 480.

Thus, the forward cutter frame 50 is pivotally connected to the frame 14 via the universal connection 244 such that the forward cutter frame 50 is movable in a first direction 486 (FIG. 17A) and a second direction 488 (FIG. 17A) relative to the vertical axis 480 in the first horizontal axis 482. The forward cutter frame 50 is movable with respect to the frame 14 in a first direction 490 (FIG. 17A) in a second direction 491 (FIG. 17A) with respect to the second horizontal axis 484 and the vertical axis 482. Also, the forward cutter frame 50 is movable with respect to the frame 14 in a first direction 492 (FIG. 17A) and in a second direction 493 (FIG. 17A) with respect to the first horizontal axis 482 and the vertical axis 480.

The forward cutter frame 50 is controllably movable with respect to the frame 14 via the forward cutter positioning assembly 58 for orienting the forward cutter frame 50 in predetermined positions relative to the frame 14 during the operation of the mining apparatus 10, as generally described before in connection with FIGS. 1 and 2. In the embodiment of the forward cutter positioning assembly 58 shown in FIGS. 17 and 17A, the forward cutter positioning assembly 58, more particularly, includes nine control valves 494, 496, 498, 500, 502, 504, 506, 508 and 510 is connected to a pump 512 and to a reservoir 514.

The pump 512 is connected to the first steering cylinder 246 via the control valve 494, the first steering cylinder 246 being connected to the control valve 494 via a conduit 516. The control valve 494 is a solenoid-operated type of control valve having a de-energized position, one energized position (designated in FIG. 17 via the reference "A") wherein fluidic communication is established between the first steering cylinder 10 and the reservoir 514 via the conduit 516 and one other energized position (designated by the reference "B" in FIG. 17) wherein fluidic communication is established between the first steering cylinder 10 and the pump 512 via the conduit 516.

The pump 512 also is connected to the first steering cylinder 246 via the control valve 496, the first steering cylinder 246 being connected to the control valve 496 via a conduit 518. The control valve 496 is a solenoid-operated type of control valve having a de-energized position, one energized position (designated by the reference "G" in FIG. 17) wherein fluidic communication is established between the first steering cylinder 246 and the reservoir 514 via the conduit 518 and one other energized position (designated via the reference "D" in FIG. 17) wherein fluidic communication is established between the first steering cylinder 10 and the pump 512 via the conduit 518.

The second steering cylinder 248 is connected to the control valve 498 via a conduit 520. The control valve 498 is a solenoid-operated type of control valve having a de-energized position, one energized position (designated via the reference "E" in FIG. 17) wherein fluidic communication is established between the second steering cylinder 248 in the reservoir 514 via the conduit 520 and one other energized position (designated via the reference "F" in FIG. 17) wherein fluidiic communication is established between the second steering cylinder 248 and the pump 512 via the conduit 520.

The pump 512 also is connected to the second steering cylinder 248 via the control valve 500, the second steering cylinder 248 being connected to the control valve 500 via a conduit 522. The control valve 500 is a solenoid-operated type of control valve having a de-energized position, one energized position (designated via the reference "G" in FIG. 17) wherein the fluidic communication is established between the second steering cylinder 248 and the reservoir 514 via the conduit 522 and one other energized position (designated via the reference "H" in FIG. 17) wherein fluidic communication is established between the second steering cylinder 248 and the pump 512 via the conduit 522.

The pump 512 is connected to the third steering cylinder 250 via the control valve 502, the third steering cylinder 250 being connected to the control valve 502 via a conduit 524. The control valve 502 is a solenoid-operated type of control valve having a de-energized position, one energized position (designated via the reference "I" in FIG. 17) wherein fluidic communication is established between the third steering cylinder 250 and the reservoir 514 via the conduit 524 and one other energized position (designated via the reference "J" in FIG. 17) wherein fluidic communication is established between the third steering cylinder 250 and the pump 512 via the conduit 524.

The pump 512 also is connected to the third steering cylinder 250 via the control valve 504, the third steering cylinder 250 being connected to the control valve 504 via a conduit 526. The control valve 504 is a solenoid-operated type of control valve having a de-energized position, one energized position (designated via the reference "K" in FIG. 17) wherein fluidic communication is established between the third steering cylinder 250 and the reservoir 514 via the conduit 526 and one other energized position (designated via the reference "L" in FIG. 17) wherein fluidic communication is established between the third steering cylinder 250 and the pump 512 via the conduit 526.

The pump 512 is connected to the fourth steering cylinder 252 via the control valve 506, the fourth steering cylinder 252 being connected to the control valve 506 via a conduit 528. The control valve 506 is a solenoid-operated type of control valve having a de-energized position, one energized position (designated via the reference "M" in FIG. 17) wherein fluidic communication is established between the fourth steering cylinder 252 and the reservoir 514 via the conduit 528 and one other energized position (designated via the reference "N" in FIG. 17) wherein fluidic communication is established between the fourth steering cylinder 40 and the pump 512 via the conduit 528.

The pump 512 also is connected to the fourth steering cylinder 252 via the control valve 508, the fourth steering cylinder 252 being connected to the control valve 508 via a conduit 530. The control valve 508 is a solenoid-operated type of control valve having a de-energized position, one energized position (designated via the reference "O" in FIG. 17) wherein fluidic communication is established between the fourth steering cylinder 252 and the reservoir 514 via the conduit 530 and one other energized position (designated via the reference "P" in FIG. 17) wherein fluidic communication is established between the fourth steering cylinder 252 and the pump 512 via the conduit 530.

The pump 512 is connected to the roll cylinder 254 via the control valve 510, the roll cylinder 254 being connected to the control valve 510 via a pair of conduits 532 and 534. The control valve 510 is a solenoid-operated type of control valve having a de-energized position, one energized position (designated via the reference "Q" in FIG. 17) wherein fluidic communication is established between the pump 512 and one portion of the roll cylinder 254 via the conduit 534, the other portion of the roll cylinder 50 being connected to the reservoir 514 via the conduit 532 in the energized position "Q" of the control valve 510. The control valve 510 also has one other energized position (designated via the reference "R" in FIG. 17) wherein fluidic communication is established between one portion of the roll cylinder 254 and the pump via the conduit 532 and wherein fluidic communication is established between one other portion of the roll cylinder 254 and the reservoir 514 via the conduit 534.

In the embodiment of the invention shown in FIG. 17, the rearward cutter positioning assembly 70, more particularly, comprises the rear cylinders 316 and 318, each of the rear cylinders 316 and 318 comprising a hydraulically actuated type of cylinder and including a cylinder base 536 and a piston rod 538. Each of the piston rods 538 is movably mounted within one of the cylinder bases 536 such that each of the piston rods 538 is moved outwardly a distance from one of the cylinder bases 536 in one actuated condition of the rear cylinders 316 and 318 and such that each of the piston rods 538 is moved inwardly a distance into one of the cylinder bases 536 in one other actuated condition of the rear cylinders 316 and 318. Each of the cylinder bases 536 is pivotally connected to the rearward end 22 of the frame 14 and the ends of each of the piston rods 538, opposite the ends of the piston rods 538 connected to the cylinder bases 536, is pivotally connected to the rearward cutter frame 62. In one actuated position of the rear cylinders 316 and 318, the piston rods 538 are each moved outwardly a distance from one of the cylinder bases 536 and, in this actuated condition, the rear cylinders 316 and 318 each exert a force on the rearward cutter frame 62 pivoting the rearward cutter frame 62 in the first direction 314 and moving the rearward cutter frame 62 generally toward the material engaging position. In the one other actuated condition of the rear cylinders 316 and 318, the piston rods 538 are each moved inwardly a distance into one of the cylinder bases 586 and, this actuated condition, the rear cylinders 316 and 318 exert a force on the rearward cutter frame 62 causing the rearward cutter frame 62 to be pivotally moved in the second direction 315 relative to the frame 14 for moving the rearward cutter frame 62 and the rearward cutter 64 connected thereto to the storage position.

The rear cylinders 316 nd 318 are connected in hydraulic parallel via conduits 544 and 546 for simultaneous actuating movement. One portion of each of the rear cylinders 316 and 318 is connected to a control valve 548 via a conduit 550, the conduit 550 being connected to the conduit 544, and one other portion of each of the rear cylinders 316 and 318 is connected to the control valve 548 via a conduit 552, the conduit 552 being connected to the conduit 546. The control valve 548 is a solenoid-operated type of control valve having a de-energized position, one energized position (designated via the reference "S" in FIG. 17) wherein fluidic communication is established between each of the rear cylinders 316 and 318 and the pump 514 via the conduits 550 and 554 and wherein fluidic communication is established between each of the rear cylinders 80 and 90 and the reservoir 514 via the conduits 552 and 546, and one other energized position (designated via the reference "T" in FIG. 17) wherein fluidic communication is established between each of the rear cylinders 316 and 318 and the pump 512 via the conduits 552 and 546 and wherein fluidic communication is established between each of the rear cylinders 316 and 318 and the reservoir 514 via the conduits 550 and 544. The control valve 548 is connected to the rear cylinders 316 and 318, to the pump 512 and to the reservoir 514, such that when the control valve 548 is energized in the energized position "S" each of the piston rods 538 is moved outwardly a distance from one of the cylinder bases 536 causing the rearward cutter frame 62 and the rearward cutter 64 connected thereto to be pivotally moved in the first direction 314, thereby moving the rearward cutter frame 62 and the rearward cutter 64 connected thereto in a direction generally toward the material engaging position. Further, when the control valve 548 is energized in the energized position "T", each of the piston rods 538 is moved inwardly a distance into one of the cylinder bases 536, thereby pivoting the rearward cutter frame 62 and the rearward cutter 64 connected thereto in the second direction 315 generally toward the storage position of the rearward cutter assembly 20.

As shown in FIG. 17, the pump 512 is connected to the reservoir 514 via a conduit 554, thereby establishing fluidic communication between the suction side of the pump 512 and the reservoir 514 via the conduit 554, and the discharge side of the pump 512 is connected to each of the control valves 494, 496, 498 500, 502, 504, 506, 508, 510 and 548 via a conduit 556. The reservor 514 is connected to each of the control valves 494, 496, 498, 500, 502, 504, 506, 508, 510 and 548 via a conduit 558.

One end of a conduit 560 is connected to the conduit 556 and the opposite end of the conduit 560 is connected to the conduit 558, the conduit 560 being connected in series between the discharge side of the pump 512 and the reservoir 514 via the conduit 560. The pressure relief valve 562 is connected to the discharge side of the pump 512 and constructed to sense the pressure of the fluid passed from the pump 512 through the conduit 556 during the operation of the miner 12, the pressure relief valve 562 being constructed such that the pressure relief valve 562 is actuated and moved to the opened position is response to sensing a fluid pressure in excess of a predetermined maximum pressure level. Thus, the pressure relief valve 562 operates to bypass the fluid discharged from the pump 512 back into the reservoir 514 when the pressure of the fluid being discharged from the pump 512 exceeds the predetermined maximum pressure level.

One end of a conduit 564 is connected to the conduit 566 and the opposite end of the conduit 564 is connected to the conduit 560 generally between the pressure relief valve 562 and the connection between the conduit 560 and the reservoir 514. The control valve 566 is a solenoid-operated type of control valve having a de-energized position (indicated in dashed-lines in FIG. 17) wherein fluidic communication is established between the discharge side of the pump 512 and the reservoir 514 via the control valve 566 and the conduits 564 and 560 and, in this de-energized position of the control valve 566, the fluid discharged from the pump 512 is bypassed back into the reservoir 514. The control valve 566 also has an energized position (designated by the reference "Z" in FIG. 17) wherein fluidic communication through the conduit 564 is interrupted. Thus, in the energized position "Z" of the control valve 566, the fluid discharged from the pump 512 through the conduit 556 is passed to the control valves 494, 496, 498, 500, 502, 504, 506, 508, 510 and 548, the control valve 566 functioning as a safety valve for bypassing the fluid discharged from the pump 512 back into the reservoir 514 until the control valve 566 is energized and positioned in the "Z" position.

The control valve 494 is connected to the control unit 100 via a conductor 568 and the control valve 494 is conditioned in the energized position "A" in response to receiving a signal from the control unit 100 via the conductor 568. The control valve 494 also is connected to the control unit 100 via a conductor 570 and the control valve 494 is conditioned in the energized position "B" in response to receiving a signal from the control unit 100 via the conductor 570.

The control valve 496 is connected to the control unit 100 via a conductor 572 and the control valve 496 is conditioned in the energized position "C" in response to receiving a signal from the control unit 100 via a conductor 572. The control valve 496 also is connected to the control unit 100 via a conductor 574 and a control valve 496 is conditioned in the energized position "D" in response to receiving a signal from the control unit 100 via the conductor 574.

The control valve 498 is connected to the control unit 100 via a conductor 576 and the control valve 498 is conditioned in the energized position "E" in response to receiving a signal from the control unit 100 via a conductor 576. The control valve 498 also is connected to the control unit 100 via a conductor 578 and the control valve 498 is conditioned in the energized position "F" in response to receiving a signal from the control unit 100 via the conductor 578.

The control valve 500 is connected to the control unit 100 via a conductor 580 and the control valve 500 is conditioned in the energized position "G" in response to receiving a signal from the control unit 100 via the conductor 580. The control valve 500 also is connected to the control unit 100 via a conductor 582 and the control valve 500 is conditioned in the energized position "H" in response to receiving a signal from the control unit 100 via the conductor 582.

The control valve 502 is connected to the control unit 100 via a conductor 584 and the control valve 502 is conditioned in the energized position "I" in response to receiving a signal via the conductor 584. The control valve 502 also is connected to the control unit 100 by a conductor 586 and the control valve 502 is conditioned in the energized position "J" in response to receiving a signal from the control unit 100 via the conductor 586.

The control valve 504 is connected to the control unit 100 via a conductor 588 and the control valve 504 is conditioned in the energized position "K" in response to receiving a signal from the control unit 100 via the conductor 588. The control valve 504 also is connected to the control unit 100 via a conductor 590 and the control valve 504 is conditioned in the energized position "L" in response to receiving a signal from the control unit 100 via the conductor 590.

The control valve 506 is connected to the control unit 100 via a conductor 592 and the control valve 506 is conditioned in the energized position "M" in response to receiving a signal from the control unit 100 via the signal path 592. The control valve 506 also is connected to the control unit 100 via a conductor 594 and the control valve 506 is conditioned in the energized position "N" in response to receiving a signal from the control unig 100 via the conductor 594.

The control valve 508 is connected to the control unit 100 via a conductor 596 and the control valve 508 is conditioned in the energized position "O" in response to receiving a signal from the control unit 100 via the conductor 596. The control valve 508 also is connected to the control unit 100 via a conductor 598 and the control valve 508 is conditioned in the energized position "P" in response to receiving the signal from the control unit 100 via the conductor 598.

The control valve 510 is connected to the control unit 100 via a conductor 600 and the control valve 510 is conditioned in the energized position "Q" in response to receiving a signal from the control unit 100 via the conductor 600. The control valve 510 also is connected to the control unit 100 via a conductor 602 and the control valve 510 is conditioned in the energized position "R" in response to receiving a signal from the control unit 100 via the conductor 602.

The control valve 548 is connected to the control unit 100 via a conductor 604 and the control valve 548 is conditioned in the energized position "S" in response to receiving a signal from the control unit 100 via the conductor 604. The control valve 548 also is connected to the control unit 100 via a conductor 606 and the control valve 548 is conditioned in the energized position "T" in response to receiving a signal from the control unt 100 via the conductor 606.

The control valve 566 is connected to the control unit 100 via a conductor 608. The control valve 566 is conditioned in the energized position "Z" in response to receiving the signal from the control unit 100 vai the conductor 608.

In the embodiment of the invention shown in FIG. 17, the conductors 568, 570, 572, 574, 576, 578, 580, 582, 584, 586, 588, 590, 592, 594, 596, 598, 600, 602 and 608 each comprise the control line 60 connected between the control unit 100 and the forward cutter positioning assembly 58, as shown in FIGS. 1 and 2. Further, the conductors 604, 606 and 608 each comprise the control line 72 connected between the control unit 100 and the rearward cutter positioning assembly 70, as shown in FIGS. 1 and 2.

The signals provided by the control unit 100 on the conductors 568, 570, 572, 574, 576, 578, 580, 582, 584, 586, 588, 590, 592, 594, 596, 598, 600, 602 and 608 are provided in response to a signal or signals received by the control unit 100 from the sensor assembly 30 on the control line 32 for positioning the forward cutter frame 50 and the forward cutter 52 connected thereto in predetermined positions to guide and steer the miner 12 through the coal seam 26 along a predetermined path relative to the coal seam 26 interface, in the manner generally described before in connection with the mining apparatus 10 shown in FIGS. 1 and 2.

When the sensor assembly 30 output signal or signals on the control line 32 indicate that the forward cutter frame 50 and the forward cutter 52 connected thereto should be pitched upwardly or, in other words, moved in the direction 491, the control unit 100 provides output signals conditioning the control valves as follows: conditioning the control valve 494 in the energized position "A"; conditioning the control valve 496 in the energized position "D"; conditioning the control valve 498 in the energized position "F"; conditioning the control valve 500 in the energized position "G"; conditioning the control valve 502 in the energized position "I"; conditioning the control valve 504 in the energized position "L"; conditioning the control valve 506 in the energized position "N"; conditioning the control valve 508 in the energized position "O"; and conditioning the control valve 566 in the energized position "Z". In this operating mode of the forward cutter positioning assembly 58, the pump 512 provides pressurized fluid to the control valves of the forward cutter positioning assembly 58 via the conduit 556 sense the control valve 566 is conditioned in the energized position "Z" thereby interrupting fluidic communication through the bypass conduit 564. Further, in this operating mode of the forward cutter positioning assembly 58, the first steering cylinder 264 is connected to the reservoir 514 via the conduit 516 and to the pump 512 via the conduit 518, thereby causing the first steering cylinder 246 to apply the force 414 to the rearward end 232 of the forward cutter frame 50; the second steering cylinder 248 is connected to the pump 512 via the conduit 520 and to the reservoir 514 via the conduit 522, thereby causing the second steering cylinder 248 to apply the force 428 to the rearward end 232 of the forward cutter frame 50; the third steering cylinder 250 is connected to the pump 512 via the conduit 526 and to the reservoir 514 via the conduit 524, thereby causing the force 446 to be applied to the rearward end 232 of the forward cutter frame 50; the fourth steering cylinder 252 is connected to the pump 512 via the conduit 528 and to the reservoir 514 via the conduit 580, thereby causing the force 460 to be applied to the rearward end 46 of the forward cutter frame 50; and since the roll cylinder 254 is not connected to either the pump 512 or the reservoir 514, the roll cylinder 254 does not operate to apply a force to the forward cutter frame 50 in this operating mode. In summary, in this operating mode of the forward cutter positioning assembly 58 the forces 414, 428, 466 and 460 are applied to the rearward end 46 of the forward cutter frame 50 thereby causing the cutter frame 50 to be pitched upwardly or, in other words, to be moved in the direction 491. After the forward cutter frame 50 has been moved in the direction 490 through an angle determined via the signal or signals received from the sensor assembly 30 via the control line 32, the control valves of the forward cutter positioning assembly 58 are each de-energized and the forward cutter frame 50 and the forward cutter 52 connected thereto are each held in this predetermined position via the steering cylinders 246, 248, 250 and 252, until the signal or signals received from the sensor assembly 30 via the control line 32 indicate that the forward cutter positioning assembly 58 should be activated to move the forward cutter frame 50 to some other position for steering and guiding the miner 12 through the coal seam 26.

When the signal or signals from the sensor assembly 30 on the control line 32 indicate that the forward cutter frame 50 and the forward cutter 52 connected thereto should be pitched downwardly or, in other words, moved in the direction 490, the control unit 100 provides output signals for conditioning the control valves of the forward cutter positioning assembly 58 as follows: conditioning the control valve 494 in the energized position "B"; conditioning the control valve 496 in the energized position "C"; conditioning the control valve 498 in the energized position "E"; conditioning the control valve 500 in the energized position "H" conditioning the control valve 502 in the energized position "J"; conditioning the control valve 504 in the energized position "K"; conditioning the control valve 506 in the energized position "M"; conditioning the control valve 508 in the energized position "P"; and conditioning the control valve 566 in the energized position "Z". In this operating mode of the forward cutter positioning assembly 58, the first steering cylinder 246 is connected to the pump 512 via the conduit 516 and to the reservoir 514 via the conduit 518, thereby causing the first steering cylinder 246 to apply the force 412 to the rearward end 232 of the forward cutter frame 50; the second steering cylinder 248 is connected to the pump 512 via the conduit 522 and to the reservoir 514 via the conduit 520, thereby causing the second steering cylinder 248 to apply the force 430 to the rearward end 232 of the forward cutter frame 50; the third steering cylinder 250 is connected to the pump 512 via the conduit 524 and to the reservoir 514 via the conduit 526, thereby causing the third steering cylinder 250 to apply the force 444 to the rearward end 232 of the forward cutter frame 50; the fourth steering cylinder 252 is connected to the pump 512 via the conduit 530 and to the reservoir 514 via the conduit 528, thereby causing the fourth steering cylinder 252 to apply the force 562 to the rearward end 232 of the forward cutter frame 50; and the roll cylinder 254 is not connected to the pump 512 or the reservoir 514 unless the roll cylinder 254 does not apply a force to the forward cutter frame 50 in this operating mode of the forward cutter positioning assembly 58. In summary, in this operating position of the forward cutter positioning assembly 58 when it is desired to move the forward cutter frame in the direction 490, the control valves of the forward cutter positioning assembly 58 are each conditioned such that the steering cylinders 240, 248, 250 and 252 apply the forces 412, 430, 444 and 462 to the rearward end 232 of the forward cutter frame 50 thereby causing the forward cutter frame 50 and the forward cutter 52 connected thereto to be pitched downwardly or, in other words, to be moved in the direction 490. The control unit 100 continues to provide the output signals for maintaining the control valves of the forward cutter positioning assembly 58 in the energized positions just described until the forward cutter frame 50 has been moved through a predetermined angle in the direction 490, the particular angular movement of the forward cutter frame 50 in the direction 490 being determined via the signal or signals received on the control line 32 from the sensor assembly 30. When the signal or signals on the control line 32 provided by the sensor assembly 30 indicate that the forward cutter frame 50 has been moved through a sufficient angular distance in the direction 490, the control unit 100 provides output signals de-energizing the control valves of the forward cutter positioning assembly 58 and, in the deenergized position of the control valves of the forward cutter positioning assembly 58, the steering cylinders 246, 248, 250 and 252 each cooperate to hold the forward cutter frame 50 and the forward cutter 52 connected thereto in a stationary position until the signals provided via the control unit 100 indicate the necessity of moving the forward cutter frame 50.

When the signal or signals provided by the sensor assembly 30 on the control line 30 indicate that the forward cutter frame 50 and the forward cutter 52 connected thereto should be moved through a predetermined angle in the direction 488, the control unit 100 provides output signals for conditioning the control valves of the forward cutter positioning assembly 58 in the following conditions: conditioning the control valve 494 in the energized position "B"; conditioning the control valve 496 in the energized position "C"; conditioning the control valve 498 in the energized position "F"; conditioning the control valve 500 in the energized position "G"; conditioning the control valve 502 in the energized position "I"; conditioning the control valve 504 in the energized position "L"; conditioning the control valve 506 in the energized position "M"; conditioning the control valve 508 in the energized position "P"; and for conditioning the control valve 566 in the energized position "Z". In this operating mode of the forward cutter positioning assembly 58 for moving the forward cutter frame 50 in the direction 488, the first steering cylinder 246 is connected to the pump 512 via the conduit 516 and to the reservoir 514 via the conduit 518, thereby causing the first steering cylinder 246 to apply the force 412 to the rearward end 232 of the forward cutter frame 50; the second steering cylinder 248 is connected to the pump 512 via the conduit 520 and to the reservoir 514 via the conduit 522, thereby causing the second steering cylinder 248 to apply the force 428 to the rearward end 232 of the forward cutter frame 50; the third steering cylinder 250 is connected to the pump 512 via the cconduit 524 and to the reservoir 514 via the conduit 526, thereby causing the third steering cylinder 30 to apply the force 446 to the rearward end 232 of the forward cutter frame 50; the fourth steering cylinder 252 is connected to the pump 512 via the conduit 528 and to the reservoir 514 via the conduit 530, thereby causing the fourth steering cylinder 252 to apply the force 462 to the rearward end 232 of the forward cutter frame 50; and the roll cylinder 254 is not connected to the pump 12 or to the reservoir 514 and thus the roll cylinder 254 does not apply a force to the forward cutter frame 50 in this particular operating mode of the forward cutter positioning assembly 58. Thus, in this operating mode of the forward cutter positioning assembly 58 wherein it is desired to move the forward cutter frame 50 through a predetermined angle in a direction 488, the control unit 100 provides output signals for energizing the control valves of the forward cutter positioning assembly 58 such that the steering cylinders 246, 248, 250 and 252 apply the forces 412, 428, 446, and 462 to the rearward end 232 of the forward cutter frame 50, thereby causing the forward cutter frame 50 to be rotated in the direction 488. The forward cutter positioning assembly 58 will continue to cause the forward cutter frame 50 to be moved in the direction 488 unitl the output signal or signals from the sensor assembly 30 on the control line 32 indicate that the forward cutter frame 50 has been moved through a sufficient angle in the direction 488 and, in response to receiving a signal or signals from the sensor assembly 30 indicating that the forward cutter frame 50 has been moved through a sufficient angle in the direction 488, the control unit 100 provides output signals de-energizing the control valves of the forward cutter positioning assembly 58. In the de-energized position of the control valves of the forward cutter positioning assembly 58, the steering cylinders 246, 248, 250, and 252 cooperate to hold the forward cutter frame 50 and the forward cutter 52 connected thereto in a predetermined position until signals are provided via the control unit 100 indicating some further movement of the forward cutter frame 50 is desired in some direction.

When the control unit 100 receives a signal of signals from the sensor assembly 30 on the control line 32 indicating that the forward cutter frame 50 and the forward cutter 52 connected thereto should be moved in the direction 486, the control unit 100 provides signals for conditioning the control valves of the forward cutter positioning assembly 58 in the following conditions: the control valve 494 is conditioned in the energized position "A"; the control valve 496 is conditioned in the energized position "D"; the control valve 498 is conditioned in the energized position "E"; the control valve 500 is conditioned in the energized position "H"; the control valve 502 is conditioned in the energized position "J"; the control valve 504 is conditioned in the energized position "K"; the control valve 506 is conditioned in the energized position "N"; the control valve 508 is conditioned in the energized position "O"; and the control valve 566 is conditioned in the energized position "Z". In this operating mode of the forward cutter positioning assembly 58, the first steering cylinder 246 is connected to the pump 512 via the conduit 518 and to the reservoir 514 via the conduit 516, thereby causing the first steering cylinder 246 to apply the force 414 to the rearward end 232 of the forward cutter frame 50; the second steering cylinder 248 is connected to the pump 512 via the conduit 522 and to the reservoir 514 via the conduit 520, thereby causing the second steering cylinder 248 to apply the force 430 to the rearward end 232 of the forward cutter frame 50; the third steering cylinder 250 is connected to the pump 512 via the conduit 524 and to the reservoir 514 via the conduit 526, thereby causing the third steering cylinder 250 to apply the force 444 to the rearward end 232 of the forward cutter frame 50; the fourth steering cylinder 252 is connected to the pump 512 via the conduit 528 and to the reservoir 514 via the conduit 530, thereby causing the fourth steering cylinder 252 to apply the force 560 to the rearward end 232 of the forward cutter frame 50; and the roll cylinder 254 is not connected to the pump 512 or to the reservoir 514 and thus the roll cylinder 254 does not apply force to the forward cutter frame in this particular operating mode of the forward cutter positioning assembly 58.

In this operative mode wherein the forward cutter positioning assembly 58 is conditioned for causing the forward cutter frame 50 to be moved in the direction 486, the control valves of the forward cutter positioning assembly 58 are conditioned such that the steering cylinders 246, 248, 250 and 252 cause the forces 414, 430, 444 and 460 to be applied to the rearward end 232 of the forward cutter frame 50 thereby causing the forward cutter frame 50 to be moved in the direction 486. The control unit 100 provides the output signals for conditioning the forward cutter positioning assembly 58 in the operating mode for moving the forward cutter frame 50 in the direction 486 until the control unit 100 receives a signal or signals from the sensor assembly 30 via the control line 32 indicating that the forward cutter frame 50 has been moved through a sufficient angle in the direction 486 and the control unit 100 provides the output signals for conditioning the control valves of the forward cutter positioning assembly 58 in the de-energized position in response to receiving this signal or signals from the sensor assembly 30. In the de-energized position of the control valves of the forward cutter positioning assembly 58, the steering cylinders 246, 248, 250 and 252 cooperate to maintain the forward cutter frame 50 and a relatively stationary position until the operating mode of the forward cutter positioning assembly 58 is changed in response to signals received from the control unit 100.

When the control unit 100 receives a signal or signals from the sensor assembly 30 via the control line 32 indicating that the forward cutter frame 50 and the forward cutter 52 connected thereto should be moved in the direction 492, the control unit 100 provides output signals to the forward cutter positioning assembly 58 for conditioning the control valve 510 in the energized position "R" and for conditioning the control valve 566 in the energized position "Z". In the energized position "R" of the control valve 510, the roll cylinder 254 is connected to the pump 512 via the conduit 532 and the roll cylinder 254 is connected to the reservoir 514 via the conduit 534, thereby causing the roll cylinder 254 to apply the force 478 to the rearward end 232 of the forward cutter frame 50. When the force 478 is applied to the forward cutter frame 50 via the roll cylinder 254 the forward cutter frame 50 is rotated in the direction 492 until the signal or signals received from the sensor assembly 30 by the control line 32 indicate that the forward cutter frame 50 has been moved a sufficient distance or, more particularly, through a sufficient angle in the direction 492, the control unit 100 conditioning the control valve 510 in the de-energized position in response to this received signal or signals from the sensor assembly 30. In this particular operating mode of the forward cutter positioning assembly 58 wherein the forward cutter frame 50 is caused to be moved in the direction 492, the control valves 494, 496, 498, 500, 502, 504, 506 and 508 are each conditioned in the de-energized position via the control unit 100 and the roll cylinder 254 is the only portion of the forward cutter positioning assembly 58 applying a force to the forward cutter frame 50.

When a signal or signals are received from the sensor assembly 30 via the control line 32 indicating that the forward cutter frame 50 should be moved in the direction 493, the control unit 100 provides output signals causing the control valve 510 to be conditioned in the energized position "Q" and for conditioning the control valve 556 in the energized position "Z". In the energized position "Q" of the control valve 510, the roll cylinder 254 is connected to the pump 512 via the conduit 534 and the roll cylinder 254 is connected to the reservoir 514 via the conduit 532 thereby causing the roll cylinder 254 to apply the force 476 to the rearward end 232 of the forward cutter frame 50. When the force 476 is applied to the forward cutter frame 50 by the roll cylinder 254, the forward cutter frame 50 is caused to be rotated in the direction 493 and the roll cylinder 50 will continue to cause the forward cutter frame 50 to be rotated in the direction 493 until the control unit receives a signal or signals from the sensor assembly 30 indicating that the forward cutter frame 50 has been moved through a sufficient angle in the direction 488, the control unit 100 providing output signals for de-energizing the control valve 510 in the control valve 566 in response to a signal or signals received from the sensor assembly 30 indicating that the forward cutter frame 50 has been moved through a sufficient angle in the direction 493.

When the miner 12 is to be withdrawn through the coal seam in the withdrawal direction 126, the control unit 100 provides an output signal via the conductor 604 for conditioning the control valve 548 in the energized position "S" and the control unit 100 provides an output signal via the conductor 608 for conditioning the control valve 566 in the energized position "Z". In the energized position "S" of the control valve 548, the rear cylinders 316 and 318 are each connected to the pump 512 via the conduit 552 and the rear cylinders 316 and 318 are each connected to the reservoir 514 via the conduit 550, the rear cylinders 316 and 318 causing the rearward cutter frame 62 and the rearward cutter 64 connected thereto to be moved generally toward the material engaging position when the control valve 548 is conditioned in the energized position "S".

When it is desired to move the rearward cutter frame 62 and the rearward cutter 64 connected thereto to the storage position, the control unit 100 provides a signal on the conductor 606 for energizing the control valve 548 and conditioning the control valve 548 and the energized position "T", the rear cylinders 316 and 318 each being connected to the pump 412 via the conduit 550 and the rear cylinders 316 and 318 each being connected to the reservoir 514 via the conduit 552 in the energized position "T" of the control valve 548. In the energized position "T" of the control valve 548, the rear cylinders 316 and 318 caused the rearward frame 62 and the rearward cutter 64 connected thereto to be moved in a direction toward the material storage position.

As mentioned before, the valves 38 and 42 are each hydraulically actuated type of valves. In one preferred embodiment, a control valve 610 is interposed in the control lines 102 and 104, the control valves 610 being connected to the control unit 100 via a pair of conductors 612 and 614 in one preferred embodiment, shown in FIG. 17. The control valve 610 has a de-energized position wherein neither the control line 102 nor the control line 104 is connected to the pump 512 via the control valve 610, and the control valve 610 has an energized position (designated in FIG. 17 via the reference "X") wherein the control line 104 is connected to the pump 512 and the control line 102 is connected to the reservoir 514, the control valve 610 having one other energized position (designated in FIG. 17 via the reference "Y") wherein the control line 102 is connected to the pump 512 and the control line 104 is connected to the reservoir 514.

During the mode of operation of the mining apparatus 10 wherein the forward cutter assembly 16 is excavatingly engaging the material (coal) to be mined as the miner 12 is being moved through the coal seam in the direction 124, the control unit 100 provides a signal on the signal path 614 for conditioning the control valve 610 in the energized position "X" wherein the control line 102 is connected to the pump 512. In this condition of the control valve 610, the valve 38 is positioned in the opened position establishing fluidic communication between the forward cutter assembly 16 and the mined material removal assembly 34 via the conduit 36, the control line 104 being connected to the reservoir 514 in the energized position "X" of the control valve 610 thereby positioning the valve 42 in the closed position for interrupting fluidic communication between the rearward cutter assemblfy 20 and the mined material removal assembly 34.

When the rearward cutter assembly 20 is moved to the material engaging position and the miner 12 is withdrawn through the borehole 88 in the withdrawl direction 126, the control unit 100 provides a signal on the conductor 612 for conditioning the control valve 610 in the energized position "Y". In the energized position "Y" of the control valve 610, the control line 104 is connected to the pump 512 via the control valve 610 and the control line 102 is connected to the reservoir 514 via the control valve 610. Thus, in the energized position "Y" of the control valve 610, the control valve 42 is positioned in the opened position for establishing fluidic communication between the rearward cutter assembly 20 and the mined material removal assembly 34 via the conduit 42 and the control valve 38 is positioned in the closed position for interrupting fluidic communication between the forward cutter assembly 16 in the mined material removal assembly 34.

The various gear reducers, hydraulic motors, portions of any electric motor housings, hydraulic cylinders and all other apparatus cavities located within the miner 12 are provided hydraulic fluid from the reservoir 514 (some of the apparatus being shown in FIG. 17 and described above, and some of the apparatus being shown in FIG. 18 and described below). In one embodiment, a hydraulic cylinder 620 is connected to the reservoir 514 via a conduit 622. The hydraulic cylinder 620 includes a piston 624 movably disposed within the cylinder base, a portion of the hydraulic cylinder 620 on one side of the piston 624 being in fluidic communication with the hydraulic fluid in the reservoir 514 and another portion of the hydraulic cylinder 620 on the opposite side of the piston 624 being in fluidic communication with the working fluid environment in the borehole 88 near the miner 12. A spring 626 is connected to the piston 624 in a manner such that the spring 626 biases the piston 624 with a predetermined bias force in one direction within the hydraulic cylinder 620.

During the operation, the hydraulic cylinder 620 functions to maintain a constant, predetermined differential pressure between the pressure of the working fluid environment within the borehole 88 near the miner 12 (the pressure on one side of the piston 624) and the pressure of the hydraulic fluid supply within the reservoir 514 (the pressure on the opposite side of the piston 624) and the particular differential pressure is determined via the setting of the bias force provided via the spring 626. In this manner, standard shutoff components and less expensive seals can be utilized in the construction of the miner 12 since such components will be operated in a pressure compensated environment (the pressure of the hydraulic fluid within the reservoir 514 is controllingly adjusted and balanced with the pressure of the working fluid within the borehole 88 near the miner 12, the hydraulic fluid pressure of the fluid within the reservoir 514 being adjustingly controlled to compensate for the depth of the miner 12 in the borehole 88), and thus, if there is a loss of hydraulic fluid, for example, which would result in a pressure loss, such pressure loss is compensated for via the utilization of the hydraulic cylinder 620. In addition, the pressure compensated system just described permits the miner 12 to be operated at greater depths within the borehole 88.

Figure 18:
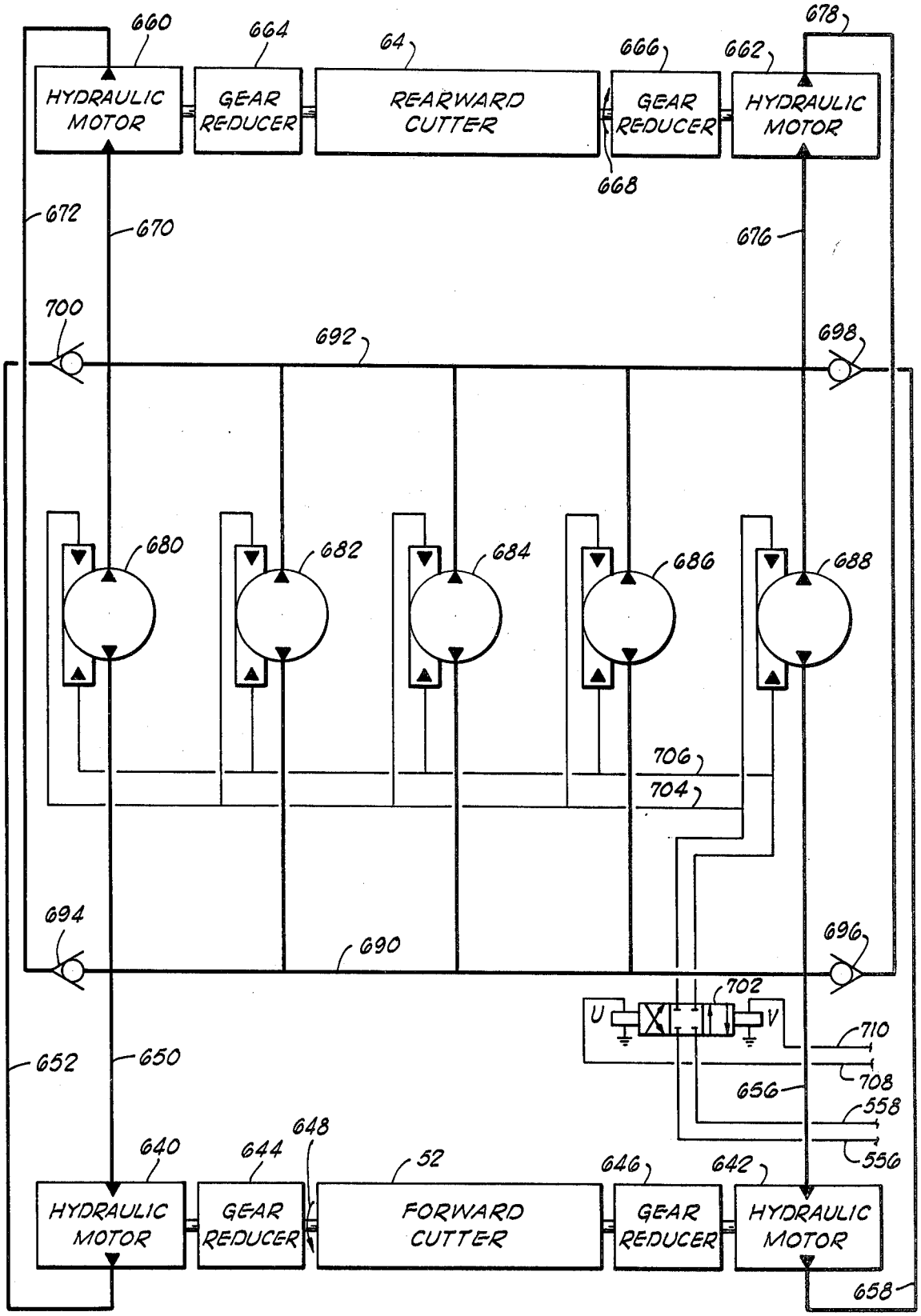
FIG. 18 is a diagrammatic, schematic view showing the apparatus for rotatingly driving the forward cutter and the rearward cutter of the miner of the present invention.

The forward cutter 52 preferably is rotatingly driven via a pair of hydraulic motors 640 and 642, as shown in FIG. 18. One of the hydraulic motors 640 is drivingly connected to one end of the cutter shaft 264 via a gear reducer 644 and the other hydraulic motor 642 is drivingly connected to the opposite end of the cutter shaft 264 via another gear reducer 646. The hydraulic motor 640 is constructed to rotatingly drive the forward cutter 52 in a first direction 648 of rotation when receiving hydraulic fluid via a conduit 650, the hydraulic fluid being passed from the hydraulic motor 640 via a conduit 652 in this operating mode, and the hydraulic motor 642 is constructed to rotatingly drive the forward cutter 52 in the first direction 648, when receiving hydraulic fluid via the conduit 656, the hydraulic fluid being passed from the hydraulic motor 642 via the conduit 658 in this operating mode.

The rearward cutter 64 preferably is rotatingly driven via a pair of hydraulic motors 660 and 662, as shown in FIG. 18. One of the hydraulic motors 660 is drivingly connected to one end of the rearward cutter 65 via a gear reducer 664 and the other hydraulic motor 662 is drivingly connected to the opposite end of the rearward cutter 64 via another gear reducer 666. The hydraulic motor 660 is constructed to rotatingly drive the rearward cutter 64 in a first direction 668 of rotation when receiving hydraulic fluid via a conduit 670, the hydraulic fluid being passed from the hydraulic motor 660 via a conduit 672 in this operating mode, and the hydraulic motor 662 is constructed to rotatingly drive the rearward cutter 64 in the first direction 668 of rotation when receiving hydraulic fluid via a conduit 676, the hydraulic fluid being passed from the hydraulic motor 662 via a conduit 678 in this operating mode.

The hydraulic fluid is supplied to the hydraulic motors 640, 642, 660 and 662 via a plurality of electric motor driven, variable volume pumps 680, 682, 684, 686 and 688. Each of the pumps 680, 682, 684, 686 and 688 are connected to the conduits 652 and 658 via a conduit 690, and each of the pumps 680, 682, 684, 686 and 688 are connected to the conduits 672 and 678 via a conduit 692. A pair of check valves 694 and 696 are interposed in the conduit 690 and a pair of check valves 698 and 700 are interposed in the conduit 692, the check valves 694, 696, 698 and 700 controlling the flow of the hydraulic fluid during the operation of mining apparatus 10.

The pump 512 (shown in FIG. 17) is connected to each of the pumps 680, 682, 684, 686 and 688 via the conduit 556 and the reservoir 514 (shown in FIG. 17) is connected to each of the pumps 680, 682, 684, 686 and 688 via the conduit 558. A control valve 702 is interposed between the pump 512 and the reservoir 514 and each of the pumps 680, 682, 684, 686 and 688. The control valve 702 is a solenoid-operated type of control valve having a de-energized position, one energized position (designated via the reference "U" in FIG. 18) wherein fluidic communication is established between each of the pumps 680, 682, 684, 686 and 688 and the reservoir 514 via conduit 704 and wherein fluidic communication is established between each of the pumps 680, 682, 684, 686 and 688 and the pump 512 via a conduit 704. In this operating mode, each of the pumps 680, 682, 684, 686 and 688 is conditioned to supply hydraulic fluid via the conduits 690, 652 and 658 for rotatingly driving the forward cutter 52. The control valve 702 has one other energized position (designated via the reference "V" in FIG. 18) wherein fluidic communication is established between each of the pumps 680, 682, 684, 686 and 688 and the reservoir 514 via the conduit 706 and wherein fluidic communication is established between each of the pumps 680, 682, 684, 686 and 688 and the pump 512 via the conduit 702 for rotatingly driving the rearward cutter 64. Thus, in the energized "U" position of the control valve 702, the pumps 680, 682, 684, 686 and 688 are conditioned to supply hydraulic fluid to the hydraulic motors 640 and 642 for rotatingly driving the forward cutter 52 and, in the energized "V" position of the control valve 702, the pumps 680, 682, 684, 686 and 688 are conditioned to supply hydraulic fluid to the hydraulic motors 660 and 662 for rotatingly driving the rearward cutter 64.

The control valve 702 is energized in the "U" position via a signal on a conductor 708 which is connected to the control unit 100 and to the control valve 702, as shown in FIGS. 17 and 18. The control valve 702 is energized in the "V" position via a signal on a conductor 710 which is connected to the control unit 100 and the control valve 702, as shown in FIGS. 17 and 18. Thus, the forward cutter 52 and the rearward cutter 64 are each controlled via the control unit 100 and the control unit 100 supplies the signals on the conductors 708 and 710 for alternatingly driving the forward cutter 52 or the rearward cutter 64 during the operation of the mining apparatus 10.

In one embodiment FIG. 11, the forward cutter 52, more particularly, includes: a middle forward cutter 720; a first side forward cutter 722, which is disposed generally adjacent one side of the middle forward cutter 720; and a second side forward cutter 724, which is disposed generally adjacent the opposite side of the middle forward cutter 720. The first side forward cutter 722 is oriented and has cutting teeth shaped and oriented to excavatingly engage portions of the coal seam 26 generally near the first side 238 of the forward cutter frame 50, and the second side forward cutter 724 is oriented and has cutting teeth shaped and oriented to excavatingly engage portions of the coal seam 26 generally near the second side 240 of the forward cutter frame 50, the first and the second side forward cutters 722 and 724 each cooperating with the middle forward cutter 720 to excavatingly engage portions of the coal seam 26 to form the borehole 88. It should be noted that the cutting teeth on the forward cutter 52 are not specifically shown in FIGS. 10, 11, 12 and 13; however, the outer peripheral area defined via the outermost edges of such cutting teeth is indicated in FIGS. 10, 11, 12 and 13 via a dashed-line which is designated via the reference numeral 726 for clarity. The cutting length of the forward cutter 52 is defined via the length between the opposite ends of the area defined via the outermost edges of the cutting teeth, and a cutting length 728 has been shown in FIG. 11, for example. The cutting diameter of the forward cutter 52 is defined via the diameter of the area defined via the outermost edges of the cutting teeth and a cutter diameter 730 has been shown in FIG. 10, for example.

In one embodiment FIG. 11, the rearward cutter 64, more particularly, includes: a middle rearward cutter 732; a first side rearward cutter 734, which is disposed generally adjacent one side of the middle rearward cutter 732; and a second side rearward cutter 736, which is disposed generally adjacent the opposite side of the middle rearward cutter 732. The first side rearward cutter 734 is oriented and has cutting teeth shaped and oriented to excavatingly engage portions of the coal seam 26 generally near the first side 302 of the rearward cutter frame 62, and the second side rearward cutter 736 is oriented and has cutting teeth shaped and oriented to excavatingly engage portions of the coal seam 26 generally near the second side 304 of the rearward cutter frame 62, the first and the second side rearward cutters 734 and 736 each cooperating with the middle rearward cutter 732 to excavatingly engage portions of the coal seam 26 to form the borehole 88. It should be noted that the cutting teeth on the rearward cutter are not specifically shown in FIGS. 10, 11, 12 and 13; however, the outer peripheral area defined via the outermost edges of such cutting teeth is indicated in FIGS. 10, 11, 12 and 13 via a dashed-line which is designated via the reference numeral 738 for clarity. The cutting length of the rearward cutter 64 is defined via the length between the opposite ends of the area defined via the outermost edges of the cutting teeth and a cutting length 740 has been shown in FIG. 11, for example. The cutting diameter of the rearward cutter 64 is defined via the diameter of the area defined via the outermost edges of the cutting teeth and a cutting diameter 742 has been shown in FIG. 14, for example.

A pair of pads 744 and 746 are secured to the upper side 234 of the forward cutter frame 50, the pad 744 being disposed generally near the first side 238 and the other pad 746 being disposed generally near the second side 240, as shown in FIGS. 10, 11, 12 and 13. A pair of pads 748 and 750 are secured to the lower side 236 of the forward cutter frame 50, the pad 748 being disposed generally near the first side 238 and the pad 746 being disposed generally near the second side 240. A pad 760 is secured to the first side 238 of the forward cutter frame 50 and a pad 762 is secured to the second side 240 of the forward cutter frame 50. Each of the pads 744, 746, 748, 750, 760 and 762 has a portion forming an engaging surface and each pad 744, 746, 748, 750, 760 and 762 is oriented such that each engaging surface slidingly engages an adjacent portion of the coal seam 26 via the borehole 88 as the miner 12 is moved into and withdrawn from the coal seam 26. The forces at each pad 744, 746, 748, 750, 760 and 762 created as a result of the engagement between the engaging surfaces and the coal seam 26 assist the forming and maneuvering of the miner 12 through the coal seam 26, such forces on the pads 744, 746, 748, 750, 760 and 762 reducing the force applied to the universal connection 244 or, in other words, reducing the load on the universal connection 244 during the turning of the miner 12 in various directions as the miner 12 is guidingly moved through the coal seam 26 in a manner described before.

Figure 19:
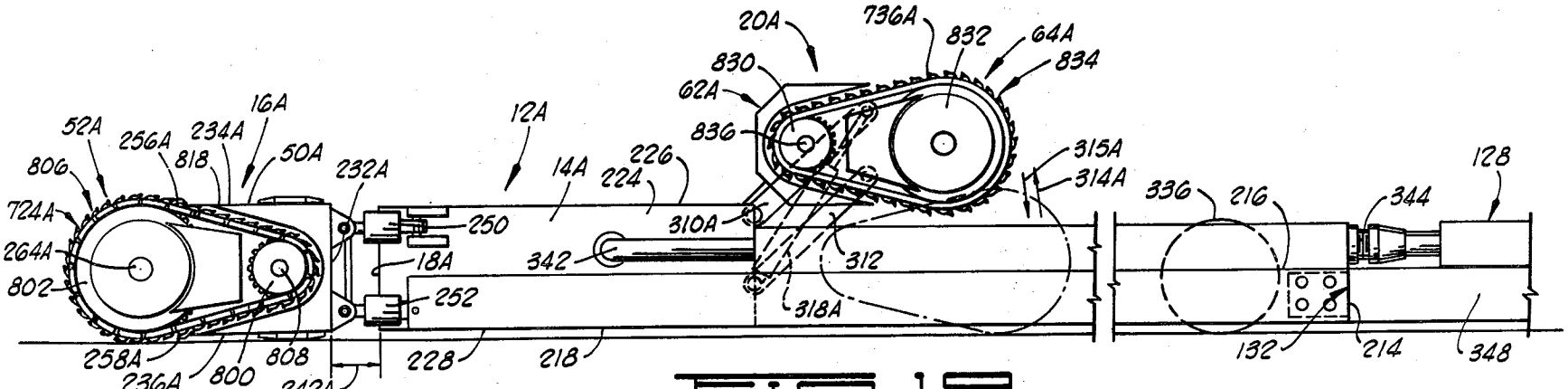
FIG. 19 is a side elevatonal similar to FIG. 10, but showing a modified miner.
Figure 20:
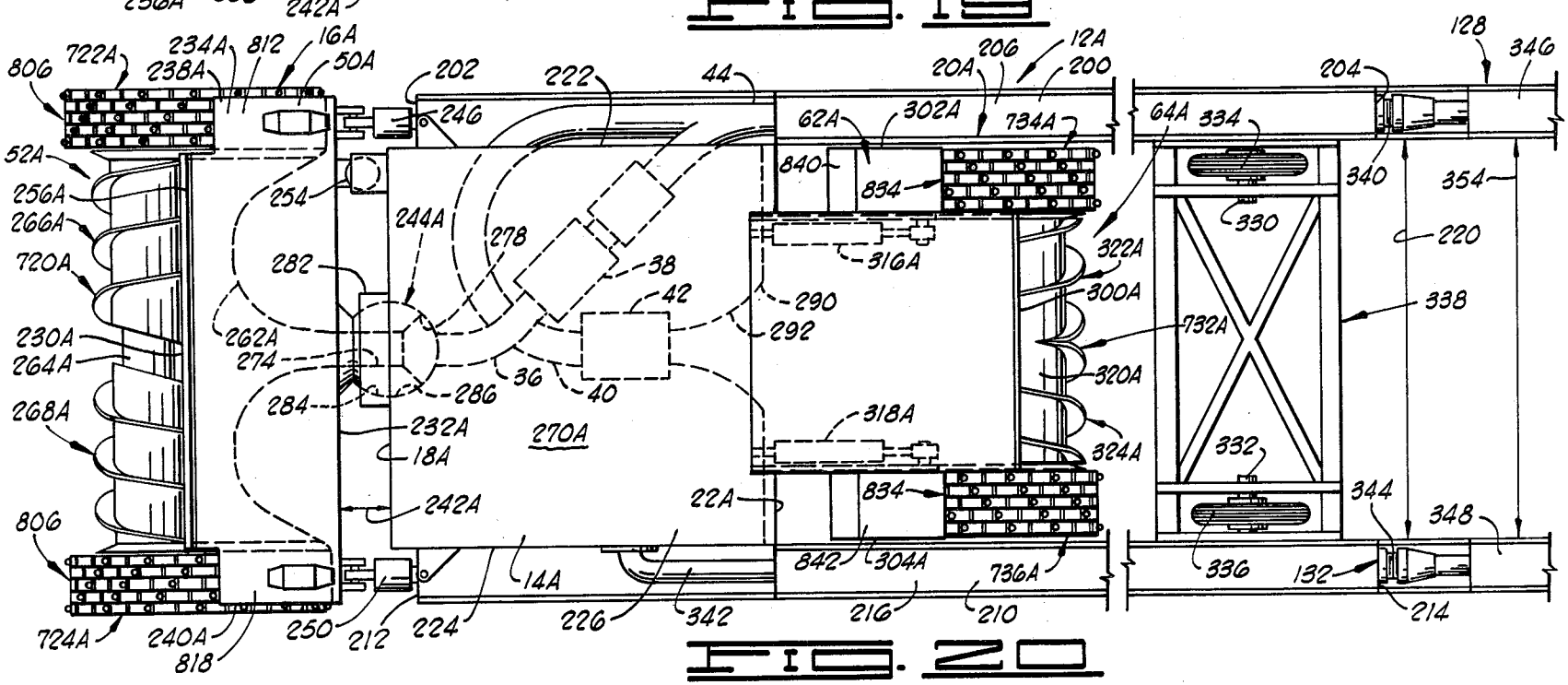
FIG. 20 is a plan view of the modified miner shown in FIG. 19.

Embodiment of FIGS. 19 and 20

Shown in FIGS. 19 and 20 is a modified miner 12A which is constructed exactly like the miner 12, shown in FIGS. 10, 11, 12 and 13 and described before, except the miner 12A includes a modified forward cutter assembly 16A and a modified rearward cutter assembly 20A.

The forward cutter assembly 12A includes: a middle forward cutter 720A which is constructed similar to the middle forward cutter 720, shown in FIGS. 10, 11, 12 and 13 and described before; a modified first side forward cutter 722A; and a modified second side forward cutter 724A.

The first and the second side forward cutters 722A and 724A are constructed in a similar manner and each includes: a first sprocket 800 (only the first sprocket 800 of the second side forward cutter 724A being shown in FIG. 19) which is journally supported within the enclosure defined via the forward cutter frame 50A; a second sprocket 802 (only the second sprocket 802 of the second side forward cutter 724A being shown in FIG. 19) which is journally supported on the forward cutter frame 50A (the second sprocket 802 of the first side forward cutter 722A being disposed generally near one end of the middle forward cutter 720A and the second sprocket 802 of the second side forward cutter 724A being disposed generally near the opposite end of the middle forward cutter 720A); and an endless belt cutter 806 extending between the first and the second sprockets 800 and 802, the first and the second sprockets 800 and 802 each having portions engaging portions of the belt cutter 806 in a manner such that, when either the first or the second sprocket 800 or 802 is rotatingly driven, the belt cutter 806 is rotatingly driven about the sprockets 800 and 802.

The first sprocket 800 of the second side forward cutter 724A is rotatingly supported via a shaft 808 and the first sprocket 800 of the first side forward cutter 722A is rotatingly supported via a shaft (not shown) in a similar manner. The second sprocket 802 of the second side forward cutter 724A is rotatingly supported on a portion of the cutter shaft 264A of the forward cutter 52A and the second sprocket 802 of the second side forward cutter 724A is rotatingly supported on a portion of the cutter shaft 264A. The cutter shaft 264A rotatingly supports the middle forward cutter 720A and the two second sprockets 802 with one of the second sprockets 802 being disposed on one side of the middle forward cutter 720A and the other second sprocket 802 being disposed on the opposite side of the middle forward cutter 720A. Thus, when the cutter shaft 264A of the forward cutter 52A is rotatingly driven the second sprockets 802 are each rotatingly driven, thereby rotatingly driving the belt cutters 806.

The upper and the lower moldboards 256A and 258A are disposed about the middle forward cutter 720A in a manner similar to that described before with respect to the forward cutter 52 and the moldboards 256 and 258, shown in FIGS. 9, 10, 11 and 12. In addition, the moldboards 256A and 258A include a first moldboard extension 812 which is connected to the forward cutter frame 50A and extends about a portion of the belt cutter 806 of the first side forward cutter 722A. More particularly, the first moldboard extension 812 extends generally about the portion of the belt cutter 806 which extends about the first sprocket 800. The first moldboard extension 812 is sized and shaped such that spaces exist between portions of the first moldboard extension 812 and portions of the coal seam 26 found via the borehole 88 in a manner and for reasons similar to that described before in connection with the spaces 269 and 271 shown in FIG. 10.

In addition, the upper and the lower moldboards 256A and 258A include a second moldboard extension 818 which is connected to the forward cutter frame 50A and extends about a portion of the belt cutter 806 of the second side forward cutter 724A. More particularly, the second moldboard extension 820 extends generally about the portion of the belt cutter 806 which extends about the first sprocket 800. The second moldboard extension 820 is sized and shaped such that spaces exist between portions of the second moldboard extension 818 and portions of the second moldboard extension 818 and portions of the coal seam 26 formed via the borehole 88 in a manner and for reasons similar to that described before in connection with the spaces 291 and 271 shown in FIG. 10.

The rearward cutter assembly 20A includes: a middle rearward cutter 732A which is constructed similar to the middle rearward cutter 732, shown in FIGS. 10, 11, 12 and 13 and described before; a modified first side rearward cutter 734A; and a modified second side rearward cutter 736A.

The first and the second side rearward cutters 734A and 736A are constructed in a similar manner and each of the side rearward cutters 734A and 736A is constructed in a manner similar to the side forward cutters 722A and 724A. The first and the second side cutters 734A and 736A each includes: a first sprocket 830 (only the first sprocket 830 of the second side rearward cutter 736A being shown in FIG. 19) which is journally supported on the rearward cutter frame 62A; a second sprocket 832 (only the second sprocket 832 of the second rearward cutter 736A being shown in FIG. 19) which is journally supported on the rearward cutter frame 62A (the second sprocket 832 of the first side rearward cutters 734A being disposed generally near one end of the middle rearward cutter 732A and the second sprocket 832 of the second side rearward cutter 736A being disposed generally near the opposite end of the middle rearward cutter 732A); an endless belt cutter 834 extending between the first and the second sprockets 830 and 832, the first and the second sprockets 830 and 832 each having portions engaging portions of the belt cutter 834 in a manner such that, when either the first or the second sprocket 800 or 802 is rotatingly driven, the belt cutter 834 is rotatingly driven about the sprockets 830 and 832.

The first sprocket 832 of the second side rearward cutter 736A is rotatingly supported via a shaft 836 and the first sprocket 832 of the second side rearward cutter 736A is rotatingly supported via a shaft 838 (not shown) in a similar manner. The second sprocket 832 of the second side rearward cutter 736A is rotatingly supported on a portion of the cutter shaft 320A of the rearward cutter 64A and the second sprocket 832 of the second side rearward cutter 736A is rotatingly supported on a portion of the cutter shaft 320A. The cutter shaft 320A rotatingly supports the middle rearward cutter 732A and the two second sprockets 832 with one of the second sprockets 832 being disposed on one side of the middle rearward cutter 732A and the other second sprocket 832 being disposed on the opposite side of the middle rearward cutter 732A. Thus, when the cutter shaft 320A of the rearward cutter 64A is rotatingly driven, the second sprockets 832 are each rotatingly driven, thereby rotatingly driving the belt cutters 834.

The rearward cutter assembly 20A includes a first rearward cutter frame extension 840 which is connected to the rearward cutter frame 62A and extends about a portion of the belt cutter 834 of the first side rearward cutter 734A. More particularly, the first rearward cutter frame extension 840 extends generally about the portion of the belt cutter 834 which extends about the first sprocket 830. The first rearward cutter frame extension 840 is sized and shaped such that a space exists between a portion of the first rearward cutter frame extension 840 and portions of the coal seam 26 formed via the borehole 88 in the material engaging position of the rearward cutter 64A and in a manner and for reasons described before in connection with the rearward cutter 64 shown in FIGS. 10, 11, 12 and 13.

Further, the rearward cutter assembly 20A includes a second rearward cutter frame extension 846 which is connected to the rearward cutter frame 62A and extends about a portion of the belt cutter 834 of the second side rearward cutter 736A. More particularly, the second rearward cutter frame extension 846 extends generally about the portion of the belt cutter 834 which extends about the first sprocket 830. The second side rearward cutter frame extension 846 is sized and shaped such that a space exists between portions of the second cutter frame extension 846 and portions of the coal seam 26 formed via the borehole 88 in a material engaging position of the rearward cutter 64A and in a manner and for reasons described before in connection witht the rearward cutter 64 shown in FIGS. 10, 11, 12 and 13.

The endless belt cutters 806 and 834 each are preferably of a chain link type of construction and each belt cutter 806 and 834 includes a plurality of cutting teeth (not designated via reference numerals in the drawings) for cuttingly and excavatingly engaging portions of the coal seam 26, such belt cutters including the cutting teeth being commercially available from such manufacturers as The Cincinnati Mine Machinery Co. of Cinn., Ohio and designated via the part number 734, for example.

Changes may be made in the construction and the operation of the various components and assemblies described herein and in the various steps and in the sequence of steps of the methods described herein without departing from the spirit and the scope of the invention as defined in the following claims.

What is claimed is:

1. A mining apparatus for forming a borehole in an earth formation utilizing a working fluid comprising:

a miner, comprising:

a frame, having a forward end, a rearward end, a first side and a second side; and a forward cutter assembly movably connected to the forward end of the frame for excavatingly engaging the earth formation, the mined material being suspended in a working fluid thereby forming a slurry comprising the working fluid in the mined material excavated via the forward cutter assembly comprising:

a forward cutter;

a forward cutter frame having a forward end, a rearward end, a first side and a second side, the rearward end of the forward cutter frame being disposed near and spaced a distance from the forward end of the frame, the forward cutter being rotatably mounted on the forward end of the forward cutter frame for excavatingly engaging the material to be mined;

a forward cutter positioning assembly connected to the forward cutter for movably positioning the forward cutter about horizontal and vertical axes to guidingly steer the miner through portions of the earth formation;

a forward cutter drive assembly connected to the forward cutter for driving the forward cutter to excavatingly engage the materials to be mined;

a rearward cutter assembly connected to the rearward end of the frame, comprising:

a rearward cutter frame having a forward end and a rearward end, movably connected to the rearward end of the frame;

a rearward cutter rotatably mounted on the rearward cutter frame for excavatingly engaging the material to be mined;

a rearward cutter drive assembly connected to the rearward cutter for driving the rearward cutter to excavatingly engage the material to be mined; and a rearward cutter positioning assembly connected to the rearward cutter frame for movably positioning the rearward cutter frame and the rearward cutter connected thereto in a storage position and in a material engaging position, the rearward cutter being positioned to excavatingly engage the material to be mined in the material engaging position;

means for moving the working fluid into the borehole to maintain the miner substantially submerged in the working fluid during the operation of the miner to excavate a portion of the earth formation thereby forming the borehole;

a control unit connected to the forward cutter positioning assembly, the control unit operating the forward cutter positioning assembly to position the forward cutter in predetermined positions for guidingly steering the miner through portions of the earth formation as the miner is being moved in one direction through the earth formation via the positioning of the forward cutter; and a launching assembly for moving the miner into the earth formation and withdrawing the miner from the earth formation.

2. The mining apparatus of claim 1 wherein the borehole extends through a surface highwall into the earth formation and wherein the means for passing the working fluid into the borehole is defined further to include:

a caisson having one portion sealingly engaging a portion of the surface highwall generally about the borehole for substantially sealing the working fluid within the borehole and a portion of the caisson during the operation of the miner.

3. The mining apparatus of claim 2 wherein the launching assembly is defined further as being disposed near the caisson for moving the miner through the caisson, through the surface highwall and through the earth formation, the caisson being maintained in sealing engagement with the surface highwall while moving the miner through the caisson.

4. The apparatus of claim 1 wherein the working fluid is maintained in the borehole under a hydrostatic pressure, the hydrostatic pressure of the working fluid acting against the walls formed in the earth formation via the borehole and cooperating to support the walls formed via the borehole against falls and collapse and the like during the operation of the miner.

5. The mining apparatus of claim 1 wherein the means for passing the working fluid into the borehole is defined further to include:

a working fluid supply connected to the borehole, the working fluid being passed from the working fluid supply into the borehole.

6. The mining apparatus of claim 5 wherein the mined material excavated via the miner is suspended in the working fluid thereby forming a slurry comprising the mined material and the working fluid, and wherein the miner is defined further to include:

a mined material removal assembly connected to the frame for receiving the slurry comprising the mined material and the working fluid and passing the slurry from the miner.

7. The mining apparatus of claim 6 defined further to include:

a compressed gas supply connected to the mined material removal assembly for supplying compressed gas to the mined material removal assembly, the compressed gas being passed into the slurry comprising the mined material and the working fluid for reducing the weight of the mined material in the slurry and creating a pressure differential between the mined material in the slurry being passed from the miner via the mined material removal assembly and the working fluid and the mined material in the borehole generally near the miner thereby facilitating the moving of the slurry from the mined material removal assembly.

8. The assembly of claim 7 defined further to include:

means connected to the mined material removal assembly for receiving the slurry comprising the mined material, the working fluid and the compressed gas, and separating the mined material, the compressed gas and the working fluid;

means receiving the compressed gas separated from the slurry comprising the compressed gas, the working fluid and mined material, for supplying the compressed gas to the compressed gas supply; and means receiving the working fluid separated from the slurry comprising the compressed gas, the working fluid and the mined material, for supplying the working fluid to the working fluid supply.

9. The mining apparatus of claim 1 wherein the forward cutter frame includes an opening formed therein and a passageway is disposed within the forward cutter frame with one end of the passageway being connected to the forward end of the forward cutter frame and encompassing the opening formed in the forward end of the forward cutter frame, the passageway having an opposite end connected to and extending through the rearward end of the forward cutter frame, and the slurry comprising the mined material excavated via the forward cutter assembly and the working fluid being moved into and through the passageway disposed in the forward cutter frame.

10. The apparatus of claim 9 defined further to include:

means for receiving the slurry passing through the passageway disposed in the forward cutter frame and passing the slurry from the miner.

11. The mining apparatus of claim 9 wherein the forward cutter is defined to include:

a cutter shaft journally mounted on the forward cutter frame, having a first flight of vanes extending a distance radially from the cutter shaft and helically about the cutter shaft in a generally clockwise direction, and a second flight of vanes extending a distance generally radially from the cutter shaft and helically about the cutter shaft in a generally counterclockwise direction, the first and the second flights of vanes cooperating to engage and move the mined material excavated via the forward cutter assembly generally toward the opening in the forward end of the forward cutter frame thereby facilitating the moving of the slurry comprising the working fluid and the mined material into and through the passageway disposed in the forward cutter frame.

12. The mining apparatus of claim 9 wherein the forward cutter frame is defined further to include: a plurality of spaced bars connected to the forward cutter frame and extending across the opening formed in the forward cutter frame, the bars forming a filter for restricting the size of the particles of the mined material passing through the passageway formed in the forward cutter frame.

13. The mining apparatus of claim 9 wherein the miner is defined further to include:

a universal connection disposed between the rearward end of the forward cutter frame and the forward end of the frame, a portion of the universal connection being connected to the forward cutter frame and a portion of the universal connection being connected to the frame, the forward cutter frame being movably positionable with respect to the frame about axes defined generally via centerlines extending through the pivotal connection between the frame and the forward cutter frame provided via the universal connection; and means connected to the frame and the forward cutter frame for movably positioning the forward cutter frame generally about the pivotal connection provided via the universal connection.

14. The mining apparatus of claim 9 wherein the universal connection is defined further to include:

a spherically shaped member secured to the rearward end of the forward cutter frame; and a housing connected to the forward end of the frame having an opening formed in a portion thereof, a portion of the spherically shaped member being disposed in a portion of the opening in the housing and the opening in the housing providing a surface for journally engaging a portion of the outer surface of the spherically shaped member.

15. The mining apparatus of claim 14 wherein the spherically shaped member includes a passageway formed therethrough, the spherically shaped member being disposed on the rearward end of the forward cutter frame such that the passageway through the spherically shaped member is aligned with the passageway disposed in the forward cutter frame, and wherein the housing includes an opening formed through a portion thereof, the opening in the housing being aligned with the opening in the spherically shaped member, and the openings in the housing and the spherically shaped member being in fluidic communication during the movement of the spherically shaped member within the housing as the forward cutter frame is pivotally moved about the connectin provided via the universal connection.

16. The mining apparatus of claim 15 wherein the miner is defined further to include:

a conduit disposed within a portion of the frame with one end of the conduit being in fluidic communication with the opening formed in the spherically shaped member for receiving the slurry comprising the mined material excavated via the forward cutter assembly and the working fluid; and means for receiving the slurry comprising the mined material excavated via the forward cutter assembly and the working fluid from the conduit and passing said slurry from the miner.

17. The mining apparatus of claim 1 wherein the material excavated via the forward cutter and via the rearward cutter is suspended in the working fluid thereby forming a slurry comprising the mined material and the working fluid, and wherein the miner is defined further to include:

a mined material removal assembly for receiving the slurry comprising the mined material and the working fluid from the forward cutter assembly in one position and for receiving the slurry comprising the working fluid and the mined material from the rearward cutter assembly in one other position, the slurry received from the forward cutter assembly and the slurry received from the rearward cutter assembly being passed from the miner.

18. The mining apparatus of claim 1 wherein the forward cutter is defined further to include:

a middle forward cutter for excavatingly engaging the material to be mined and having opposite ends;

a first side cutter for excavatingly engaging the material to be mined and disposed generally adjacent one end of the middle forward cutter; and a second side cutter for excavatingly engaging the material to be mined and disposed generally adjacent one end of the middle forward cutter, opposite the end of the middle forward cutter disposed generally adjacent the first side cutter.

19. The mining apparatus of claim 18 wherein the middle forward cutter is defined further to include:

a cutter shaft having opposite ends; and wherein the first side cutter is defined further to include:

a first sprocket journally supported via the forward cutter frame;

a second sprocket connected to one end of the cutter shaft of the middle forward cutter; and an endless belt cutter extending between the first and the second sprockets, the first and the second sprockets each having portions engaging the endless belt cutter and the endless belt cutter being rotatingly driven when rotatingly driving one of the first and the second sprockets; and wherein the second side cutter is defined further to include:

a first sprocket journally supported via the forward cutter frame;

a second sprocket connected to one end of the cutter shaft of the middle forward cutter; and an endless belt cutter extending between the first and the second sprockets, the first and the second sprockets each having portions engaging the endless belt cutter and the endless belt cutter being rotatingly driven when rotatingly driving one of the first and the second sprockets.

20. The mining apparatus of claim 1 wherein the rearward cutter is defined further to include:

a middle rearward cutter for excavatingly engaging the material to be mined and having opposite ends;

a first side cutter for excavatingly engaging the material to be mined and disposed generally adjacent one end of the middle rearward cutter; and a second side cutter for excavatingly engaging the material to be mined and disposed generally adjacent one end of the middle rearward cutter, opposite the end of the middle rearward cutter disposed generally adjacent the first side cutter.

21. The mining apparatus of claim 20 wherein the middle rearward cutter is defined further to include:

a cutter shaft having opposite ends; and wherein the first side cutter is defined further to include:

a first sprocket journally supported via the rearward cutter frame;

a second sprocket connected to one end of the cutter shaft of the middle rearward cutter; and an endless belt cutter extending between the first and the second sprockets, the first and the second sprockets each having portions engaging the endless belt cutter and the endless belt cutter being rotatingly driven when rotatingly driving one of the first and the second sprockets; and wherein the second side cutter is defined further to include:

a first sprocket journally supported via the rearward cutter frame;

a second sprocket connected to one end of the cutter shaft of the middle rearward cutter; and an endless belt cutter extending between the first and the second sprockets, the first and the second sprockets each having portions engaging the endless belt cutter and the endless belt cutter being rotatingly driven when rotatingly driving one of the first and the second sprockets.

22. The mining apparatus of claim 1 wherein the rearward cutter positioning assembly is defined further to include:

at least two pivot arms, each pivot arm having one end pivotally connected to the frame and an opposite end pivotally connected to the rearward cutter frame, the pivot arms pivotally connecting the rearward cutter frame to the frame for pivotally moving the rearward cutter frame and the rearward cutter connected thereto in one direction generally toward a storage position and in another direction generally toward a material engaging position; and at least two rear cylinders, each rear cylinder being pivotally connected to the frame and pivotally connected to the rearward cutter frame for moving the rearward cutter frame and the rearward cutter connected thereto to the storage position in one actuated condition of the rear cylinders and for moving the rearward cutter frame and the rearward cutter connected thereto to the material engaging position in one other actuated condition.

23. The mining apparatus of claim 22 defined further to include:

means remotely located with respect to the miner and connected to the rear cylinders for remotely conditioning the rear cylinders in the one condition for moving the rearward cutter frame and the rearward cutter connected thereto to the storage position and for remotely conditioning the rear cylinders in the other conditions for moving the rearward cutter frame and the rearward cutter connected thereto to the material engaging position.

24. The mining apparatus of claim 1 wherein the forward cutter has a cutting length, and wherein the rearward cutter has a cutting length, the cutting length of the rearward cutter being less than the cutting length of the forward cutter to facilitate the movement of the miner through the earth formation.

25. The mining apparatus of claim 1 wherein the miner is defined further to include:

a first beam connected to the frame generally near the first side of the frame, having a forward end and a rearward end; and a second beam connected to the frame generally near the second side of the frame, having a forward end and a rearward end.

26. The mining apparatus of claim 25 wherein the first beam is spaced a distance from the second beam such that the first beam is disposed near one of the walls formed in the earth formation via the borehole and the second beam is disposed near another wall formed in the earth formation during the movement of the miner through the earth formation to protect the first and the second beams from roof falls and the like occurring near the mid-portion of the borehole roof.

27. The mining apparatus of claim 25 wherein the miner is defined further to include:

means connected to the first and the second beams, generally near the rearward ends of the first and the second beams for movingly supporting the rearward end portion of the miner.

28. The mining apparatus of claim 1 defined further to include:

at least one carrier, each carrier, having a forward end and a rearward end, the forward end of one of the carriers being removably connectable to the miner and the forward end of the other carriers each being removably connectable to the rearward end of one other carrier; and means connected to the carrier to movingly support the carrier for movement through the earth formation.

29. The mining apparatus of claim 28 wherein each carrier is defined further to include:

a first carrier beam having a forward end and a rearward end;

a second carrier beam having a forward end and a rearward end, the second carrier beam being spaced a distance from the first carrier beam, and the forward ends of the first and the second carrier beams forming the forward end of the carrier and the rearward ends of the first and the second carrier beams forming the rearward end of the carrier; and means for supporting the first and the second carrier beams in the spaced-apart relationship.

30. The mining apparatus of claim 28 wherein the miner is defined further to include:

a mined material removal assembly connected to the frame for receiving the slurry comprising the mined material excavated via the forward cutter assembly and the working fluid and passing the slurry from the miner; and wherein each carrier is defined further to include:

means for receiving and passing the slurry comprising the mined material excavated via the forward cutter assembly and the working fluid, said means on one of the carriers receiving the slurry from the miner and said means on each of the other carriers receiving the slurry from one of the other carriers.

31. The mining apparatus of claim 28 wherein the launching assembly is defined further as being removably engageable with the miner and removably engageable with each of the carriers, the launching assembly engaging and moving the miner through the earth formation and engaging and moving the carriers and the miner connected to the carriers through the earth formation.

32. The mining apparatus of claim 1 wherein the forward cutter frame includes an upper side and a lower side and wherein the miner is defined further to include:

a plurality of pads, at least one of the pads being connected to the upper side of the forward cutter frame, at least one of the pads being connected to the lower side of the forward cutter frame, at least one of the pads being connected to the first side of the forward cutter frame, and at least one of the pads being connected to the second side of the forward cutter frame, the pads each having an engaging surface, the engaging surfaces of the pads slidingly engaging adjacent portions of the earth formation formed via the borehole during the movement of the miner through the earth formation thereby creating a force generally at each pad resulting from the engagement between the pads and the adjacent portions of the earth formation formed via the borehole, said forces assisting the maneuvering of the miner through the earth formation.

33. The mining apparatus of claim 32 wherein the miner is defined further to include:

a universal connection disposed between the rearward end of the forward cutter frame and the forward end of the frame, a portion of the universal connection being connected to the forward cutter frame and a portion of the universal connection being connected to the frame, the forward cutter frame being movably positionable with respect to the frame about axes defined generally via centerlines extending through the pivotal connection between the frame and the forward cutter frame provided via the universal connection, the forces created as a result of the engagement between the pads and the portions of the earth formation acting to reduce the load on the universal connection during the turning of the miner as the miner is guided through the earth formation.

34. The mining apparatus of claim 1 wherein the mining apparatus excavatingly removes mined material from a coal seam, and wherein the miner is defined further to include:

a sensor assembly connected to the miner for detecting the coal seam and providing an output signal indicating the detected position of the coal seam;

and wherein the means for movably positioning the forward cutter frame is defined further to include a portion receiving the sensor assembly output signal and producing an output signal in response thereto for movably positioning the forward cutter frame and the forward cutter connected thereto to guide the miner through the coal seam.

35. The mining apparatus of claim 1 wherein the control unit is disposed at a remote location with respect to the miner for remotely controlling the miner, and wherein the mining apparatus excavatingly removes mined material from a coal seam, and wherein the miner is defined further to include:

a sensor assembly connected to the miner for detecting the coal seam and providing an output signal indicating the detected position of the coal seam;

and wherein the control unit is defined further as receiving the sensor assembly output signal and produces an output signal in response thereto for movably positioning the forward cutter assembly to guide the miner through the coal seam.

36. A mining apparatus for forming a borehole in an earth formation comprising:

a frame having a forward end, a rearward end, and upper side, a lower side, a first side and a second side;

a forward cutter assembly connected to the forward end of the frame comprising:

a forward cutter frame, having an upper side, a lower side, a forward end, a rearward end, a first side and a second side, the rearward end of the forward cutter frame being disposed near and spaced a distance from the forward end of the frame; and a forward cutter rotatably mounted on the forward end of the forward cutter frame for excavatingly engaging the material to be mined;

a universal connection disposed between the rearward end of the forward cutter frame and the forward end of the frame, a portion of the universal connection being connected to the forward cutter frame and a portion of the universal connection being connected to the frame, the universal connection being for movably positioning the forward cutter frame with respect to the frame about horizontal and vertical axes defined generally via centerlines extending through the pivotal connection between the frame and the forward cutter frame provided by the universal connection;

a first steering cylinder pivotally connected to the frame generally near the forward end and generally near the upper side and the first side of the frame, and pivotally connected to the forward cutter frame generally near the rearward end and generally near the first side and generally near the upper side of the forward cutter frame;

a second steering cylinder pivotally connected to the frame generally near the forward end and generally near the first side and generally near the lower side of the frame, and pivotally connected to the forward cutter frame generally near the first side and generally near the lower side and generally near the rearward end of the forward cutter frame;

a third steering cylinder pivotally connected to the frame generally near the second side and generally near the forward end and generally near the upper side of the frame, and pivotally connected to the forward cutter frame generally near the rearward end and generally near the second side and generally near the upper side of the forward cutter frame;

a fourth steering cylinder pivotally connected to the frame generally near the lower side and generally near the forward end and generally near the second side of the frame, and pivotally connected to the forward cutter frame generally near the rearward end and generally near the lower side and generally near the second side of the forward cutter frame, the first, the second, the third and the fourth steering cylinders being actuatable to move the forward cutter frame generally about the pivotal connection provided via the universal connection for movably positioning the forward cutter frame;

means to actuate the first, the second, the third and the fourth steering cylinders for moving the forward cutter frame and the forward cutter connected thereto about the pivotal connection provided via the universal connection for movably positioning the forward cutter frame to predetermined positions to steeringly guide the miner through the earth formation;

a roll cylinder connected to the frame generally near the forward end and generally near the first side and generally between the upper and the lower sides of the frame, and connected to the forward cutter frame generally near the first side and generally near the rearward end and generally between the upper and the lower side of the forward cutter frame; and means to actuate the roll cylinder for moving the forward cutter frame and the forward cutter connected thereto about the pivotal connection provided via the universal connection for movably positioning the forward cutter frame, the roll cylinder cooperating with the first, the second, the third and the fourth steering cylinders to steeringly guide the miner through the earth formation.

37. The mining apparatus of claim 36 wherein the universal connection is defined further to include:

a spherically shaped member secured to the rearward end of the forward cutter frame; and a housing connected to the forward end of the frame having an opening formed in a portion thereof, a portion of the spherically shaped member being disposed in a portion of the opening in the housing and the opening in the housing providing a surface for journally engaging a portion of the outer surface of the spherically shaped member.

38. The apparatus of claim 36 wherein the frame includes an upper side, a lower side, a first side and a second side, and wherein the forward cutter frame includes an upper side and a lower side, and wherein the universal connection is defined further as being disposed between the rearward end of the forward cutter frame and the forward end of the frame, a portion of the universal connection being connected to the forward cutter frame and a portion of the universal connection being connected to the frame, the forward cutter frame being movably positionable with respect to the frame about axes defined generally via centerlines extending through the pivotal connection between the frame and the forward cutter frame provided via the universal connection; and wherein the forward cutter positioning assembly is defined further to include:

a first steering cylinder pivotally connected to the frame generally near the forward end and generally near the upper side and the first side of the frame, and pivotally connected to the forward cutter frame generally near the rearward end and generally near the first side and generally near the upper side of the forward cutter frame;

a second steering cylinder pivotally connected to the frame generally near the forward end and generally near the first side and generally near the lower side of the frame, and pivotally connected to the forward cutter frame generally near the first side and generally near the lower side and generally near the rearward end of the forward cutter frame;

a third steering cylinder pivotally connected to the frame generally near the second side and generally near the forward end and generally near the upper side of the frame, and pivotally connected to the forward cutter frame generally near the rearward end and generally near the second side and generally near the upper side of the forward cutter frame;

a fourth steering cylinder pivotally connected to the frame generally near the lower side and generally near the forward end and generally near the second side of the frame, and pivotally connected to the forward cutter frame generally near the rearward end and generally near the lower side and generally near the second side of the forward cutter frame, the first, the second, the third and the fourth steering cylinders being actuatable to move the forward cutter frame generally about the pivotal connection provided via the universal connection; and means to actuate the first, the second, the third and the fourth steering cylinders for moving the forward cutter frame and the forward cutter connected thereto about the pivotal connection provided via the universal connection to predetermined positions to steeringly guide the miner through the earth formation.

39. The mining apparatus of claim 36 wherein the forward cutter frame includes an upper side and a lower side and wherein the miner is defined further to include:

a plurality of pads, at least one of the pads being connected to the upper side of the forward cutter frame, at least one of the pads being connected to the lower side of the forward cutter frame, at least one of the pads being connected to the first side of the forward cutter frame, and at least one of the pads being connected to the second side of the forward cutter frame, the pads each having an engaging surface, the engaging surfaces of the pads slidingly engaging adjacent portions of the earth formation formed via the borehole during the movement of the miner through the earth formation thereby creating a force generally at each pad resulting from the engagement between the pads and the adjacent portions of the earth formation formed via the borehole, said forces assisting the maneuvering of the miner through the earth formation.

40. The mining apparatus of claim 36 wherein the miner is defined further to include:

a reservoir having a supply of fluid; and a pump in fluidic communication with the reservoir for supply fluid; and wherein one portion of the first steering cylinder is connected to the pump and another portion of the first steering cylinder is connected to the reservoir, and wherein one portion of the second steering cylinder is connected to the pump and another portion of the second steering cylinder is connected to the reservoir, and wherein one portion of the third steering cylinder is connected to the pump and another portion of the third steering cylinder is connected to the reservoir, and wherein one portion of the fourth steering cylinder is connected to the pump and another portion of the fourth steering cylinder is connected to the reservoir, and wherein one portion of each roll cylinder is connected to the pump and another portion of each roll cylinder is connected to the reservoir, and wherein the miner is defined further to include:

a control valve interposed between the first steering cylinder and the pump and the reservoir having one position establishing fluidic communication between one portion of the first steering cylinder and the pump for applying a force to the forward cutter frame in one direction generally at the connection of the first steering cylinder to the forward cutter frame, and another position establishing fluidic communication between another portion of the first steering cylinder for applying a force in the opposite direction to the forward cutter frame generally at the connection of the first steering cylinder to the forward cutter frame;

a control valve interposed between the second steering cylinder and the pump and the reservoir having one position establishing fluidic communication between one portion of the second steering cylinder and the pump for applying a force to the forward cutter frame in one direction generally at the connection of the second steering cylinder to the forward cutter frame, and another position establishing fluidic communication between another portion of the second steering cylinder for applying a force in the opposite direction to the forward cutter frame generally at the connection of the second steering cylinder to the forward cutter frame;

a control valve interposed between the third steering cylinder and the pump and the reservoir having one position establishing fluidic communication between one portion of the third steering cylinder and the pump for applying a force to the forward cutter frame in one direction generally at the connection of the third steering cylinder to the forward cutter frame, and another position establishing fluidic communication between another portion of the third steering cylinder for applying a force in the opposite direction to the forward cutter frame generally at the connection of the third steering cylinder to the forward cutter frame;

a control valve interposed between the fourth steering cylinder and the pump and the reservoir having one position establishing fluidic communication between one portion of the fourth steering cylinder and the pump for applying a force to the forward cutter frame in one direction generally at the connection of the fourth steering cylinder to the forward cutter frame, and another position establishing fluidic communication between another portion of the fourth steering cylinder for applying a force in the opposite direction to the forward cutter frame generally at the connection of the fourth steering cylinder to the forward cutter frame;

a control valve interposed between the roll cylinder and the pump and the reservoir having one position establishing fluidic communication between one portion of the roll cylinder and the pump for applying a force to the forward cutter frame in one direction generally at the connection of the roll cylinder to the forward cutter frame, and another position establishing fluidic communication between another portion of the roll cylinder for applying a force in the opposite direction to the forward cutter frame generally at the connection of the roll cylinder to the forward cutter frame; and a control unit disposed at a remote location with respect to the location of the miner and connected to the control valve interposed between the first steering cylinder and the pump and the reservoir for remotely positioning the control valve to apply the force in the one direction and in the opposite direction to the forward cutter frame, and connected to the forward cutter frame, and connected to the control valve interposed between the second steering cylinder and the pump and the reservoir for remotely positioning the control valve to apply the force in the one direction and in the opposite direction, and connected to the control valve interposed between the third steering cylinder and the pump and the reservoir for remotely positioning the control valve to apply the force in the one direction and in the opposite direction, and connected to the control valve interposed between the fourth steering cylinder and the pump and the reservir to apply the force in the one direction and in the opposite direction to the forward cutter frame, and connected to the control valve interposed between the roll cylinder and the pump and the reservoir for remotely positioning the control valve to apply the force in the one direction and in the opposite direction, the control unit operating to remotely position the forward cutter frame in predetermined positions relative to the frame for guidingly steering the miner through the earth formation.

41. The mining apparatus of claim 36 wherein the means to actuate the first, the second, the third and the fourth steering cylinders is defined further as being located at a remote position with respect to the location of the miner for steeringly guiding the miner from a remote location.

42. A mining apparatus for forming a borehole in an earth formation utilizing a working fluid comprising:

a miner, comprising:

a frame, having a forward end, a rearward end, a first side, a second side, and an opening formed through the rearward end of the frame;

a forward cutter assembly connected to the forward end of the frame for excavatingly engaging the earth formation, the mined material being suspended in a working fluid thereby forming a slurry comprising the working fluid and the mined material excavated via the forward cutter assembly, the forward cutter assembly comprising:

a forward cutter frame having a forward end, a rearward end, a first side and a second side, the rearward end of the forward cutter frame being disposed near and spaced a distance from the forward end of the frame, the forward cutter frame having an opening formed therein and a passageway disposed within the forward cutter frame with one end of the passageway being connected to the forward end of the forward cutter fame and encompassing the opening formed in the forward end of the forward cutter frame, the passageway having an opposite end connected to and extending through the rearward end of the forward cutter frame, and the slurry comprising the mined material excavated via the forward cutter assembly and the working fluid being moved into and through the passageway disposed in the forward cutter frame;

a forward cutter rotatably mounted on the forward end of the forward cutter frame for excavatingly engaging the material to be mined;

a forward cutter drive assembly connected to the forward cutter for driving the forward cutter to excavatingly engage the material to be mined; and a forward cutter positioning assembly connected to the forward cutter frame for movably positioning the forward cutter frame and the forward cutter connected thereto;

a universal connection disposed between the rearward end of the forward cutter frame and the forward end of the frame, a portion of the universal connection being connected to the forward cutter frame and a portion of the universal connection being connected to the frame, the forward cutter frame being movably positionable with respect to the frame about axes defined generally via centerlines extending through the pivotal connection between the frame and the forward cutter frame provided via the universal connection, the universal connection comprising:

a spherically shaped member secured to the rearward end of the forward cutter frame, the spherically shaped member being disposed on the rearward end of the forward cutter frame with the passageway through the spherically shaped member being aligned with the passageway disposed in the forward cutter frame; and a housing connected to the forward end of the frame having an opening formed in a portion thereof, a portion of the spherically shaped member being disposed in a portion of the opening in the housing and the opening in the housing providing a surface for journally engaging a portion of the outer surface of the spherically shaped member, the housing having an opening formed through a portion thereof, the opening in the housing being aligned with the opening in the spherically shaped member, and the openings in the housing and the spherically shaped member being in fluidic communication during the movement of the spherically shaped member within the housing as the forward cutter frame is pivotally moved about the connection provided via the universal connection;

means connected to the frame and the forward cutter frame for movably positioning the forward cutter frame generally about the pivotal connection provided via the universal connection;

a conduit disposed within a portion of the frame with one end of the conduit being in fluidic communication with the opening formed in the spherically shaped member for receiving the slurry comprising the mined material excavated via the forward cutter assembly and the working fluid;

means for receiving the slurry comprising the mined material excavated via the forward cutter assembly and the workind fluid from the conduit and passing said slurry from the miner;

a rearward cutter assembly connected to the rearward end of the frame for excavatingly engaging the earth formation, the mined material being suspended in the working fluid thereby forming a slurry comprising the working fluid and the mined material excavated via the rearward cutter assmembly;

a conduit disposed within a portion of the frame with one end of the conduit being in fluidic communication with the opening formed in the rearward end of the frame for receiving the slurry comprising the working fluid and the mined material excavated via the rearward cutter assembly; and means for receiving the slurry comprising the mined material excavated via the rearward cutter assembly and the working fluid from the conduit and passing said slurry from the miner; and means for passing the working fluid into the borehole to maintain the miner substantially submerged in the working fluid during the operation of the miner to excavate a portion of earth formation thereby forming the borehole.

43. The mining apparatus of claim 42 wherein the miner is defined further to include:

a valve interposed in the conduit receiving the slurry comprising the working fluid and the mined material excavated via the forward cutter assembly;

a valve interposed in the conduit receiving the slurry comprising the working fluid and the mined material excavated via the rearward cutter assembly; and means remotely located with respect to the miner connected to the valve interposed in the conduit receiving the slurry comprising the working fluid and the mined material excavated via the forward cutter assembly for positioning said valve in the opened position during the operation of the forward cutter assembly excavating the material to be mined, and connected to the valve interposed in the conduit receiving the slurry comprising the working fluid and the mined material excavated via the rearward cutter assembly for positioning said valve in the opened position during the operation of the rearward cutter assembly excavating the material to be mined.

44. A mining apparatus for forming a borehole in a earth formation utilizing a working fluid comprising:

a miner, comprising:

a frame, having a forward end, a rearward end, a first side and a second side;

a forward cutter assembly connected to the forward end of the frame for excavatingly engaging the earth formation, the mined material being suspended in a working fluid thereby forming a slurry comprising the working fluid and the mined material excavated via the forward cutter assembly, the forward cutter assembly comprising:

a forward cutter frame having a forward end, a rearward end, a first side and a second side, the rearward end of the forward cutter frame being disposed near and spaced a distance from the forward end of the frame;

a forward cutter rotatably mounted on the forward end of the forward cutter frame for excavatingly engaging the material to be mined;

a forward cutter drive assembly connected to the forward cutter for driving the forward cutter to excavatingly engage the material to be mined; and a forward cutter positioning assembly connected to the forward cutter frame for movably positioning the forward cutter frame and the forward cutter connected thereto;

a rearward cutter assembly connected to the rearward end of the frame, comprising:

a rearward cutter frame, having a forward end and a rearward end, movably connected to the rearward end of the frame and having an opening formed through the rearward end for receiving a slurry comprising the mined material excavated via the rearward cutter assembly;

a rearward cutter rotatably mounted on the rearward cutter frame for excavatingly engaging the material to be mined, comprising:

a cutter shaft journally mounted on the rearward end of the rearward cutter frame, having a first flight of vanes extending a distance radially from the cutter shaft and helically about the cutter shaft in a generally clockwise direction, and a second flight of vanes extending a distance generally radially from the cutter shaft and helically about the cutter shaft in a generally counterclockwise direction, the first and the second flights of vanes cooperating to engage and move the mined material excavated via the rearward cutter assembly generally toward the opening in the rearward end of the rearward cutter frame thereby facilitating the moving of the slurry comprising the working fluid and the mined material into and through the opening in the rearward cutter frame;

a rearward cutter drive assembly connected to the rearward cutter for driving the rearward cutter to excavatingly engage the material to be mined; and a rearward cutter positioning assembly connected to the rearward cutter frame for movably positioning the rearward cutter frame and the rearward cutter connected thereto in a storage position and in a material engaging position, the rearward cutter being positioned to excavatingly engage the material to be mined in the material engaging position; and means for passing the working fluid into the borehole to maintain the miner substantially submerged in the working fluid during the operation of the miner to excavate a portion of earth formation thereby forming the borehole.

45. A mining apparatus for forming a borehole in an earth formation utilizing a working fluid comprising:

a miner, comprising:

a frame, having a forward end and a rearward end; and a forward cutter assembly connected to the forward end of the frame for excavatingly engaging the earth formation, the mined material being suspended in a working fluid thereby forming a slurry comprising the working fluid and the mined material excavated via the forward cutter assembly;

means for passing the working fluid into the borehole to maintain the miner substantially submerged in the working fluid during the operation of the miner to excavate a portion of earth formation thereby forming the borehole;

at least one carrier, each carrier having a forward end and a rearward end, the forward end of one of the carriers being removably connectable to the miner and the forward end of the other carriers each being removably connectable to the rearward end of one other carrier, each carrier comprising:

a first carrier beam having a forward end and a rearward end;

a second carrier beam having a forward end and a rearward end, the second carrier beam being spaced a distance from the first carrier beam, and the forward ends of the first and the second carrier beams forming the forward end of the carrier and the rearward ends of the first and the second carrier beams forming the rearward end of the carrier;

means for supporting the first and the second carrier beams in the spaced-apart relationship; and a cutting bar connected to the first and the second carrier beams generally near the rearward ends of the first and the second carrier beams, having a cutting edge formed on a portion thereof for facilitating the moving of the miner and the carriers connected thereto through the earth formation in the event a portion of the earth formation formed via the borehole collapses; and means connected to the carrier to movingly support the carrier for movement through the earth formation.

46. A mining apparatus for forming a borehole in an earth formation utilizing a working fluid comprising:

a miner, comprising:

a frame, having a forward end, a rearward end, a first side, a second side, an upper side, and a lower side;

a reservoir having a supply of fluid;

a pump in fluidic communcation with the reservoir for supply fluid;

a universal connection having a portion connected to the frame;

a forward cutter assembly connected to the forward end of the frame for excavatingly engaging the earth formation; the mined material being suspended in a working fluid thereby forming a slurry comprising the working fluid and the mined material excavated via the forward cutter assembly, the forward cutter assembly comprising:

a forward cutter frame having a forward end, a rearward end, a first side a second side, an upper side and a lower side, the rearward end of the forward cutter frame being disposed near and spaced a distance from th4 forward end of the frame, the universal connection being disposed between the forward end of the frame and the rearward end of the forward cutter frame and the universal connection being connected to the forward cutter frame, the forward cutter frame being movably positionable with respect to the frame about axes defined generally via centerlines extending through the pivotal connection between the frame and the forward cutter frame provided via the universal connection;

a forward cutter rotatably mounted on the forward end of the forward cutter frame for excavatingly engaging the material to be mined;

a forward cutter drive assembly connected to the forward cutter for driving the forward cutter to excavatingly engage the material to be mined; and a forward cutter positioning assembly connected to the forward cutter frame for movably positioning the forward cutter frame and the forward cutter connected thereto, the forward cutter positioning assembly comprising:

a first steering cylinder pivotally connected to the frame generally near the forward end and generally near the upper side and the first side of the frame, and pivotally connected to the forward cutter frame generally near the rearward end and generally near the first side and generally near the upper side of the forward cutter frame, one portion of the first steering cylinder being connected to the pump and another portion of the first steering cylinder being connected to the reservoir;

a second steering cylinder pivotally connected to the frame generally near the forward end and generally near the first side and generaly near the lower side of the frame, and pivotally connected to the forward cutter frame generally near the first side and generally near the lower side and generally near the rearward end of the forward cutter frame, one portion of the second steering cylinder being connected to the pump and another portion of the second steering cylinder being connected to the reservoir;

a third steering cylinder pivotally connected to the frame generally near the second side and generally near the forward end and generally near the upper side of the frame, and pivotally connected to the forward cutter frame generally near the rearward end and generally near the second side and generally near the upper side of the forward cutter frame, one portion of the third steering cylinder being connected to the pump and another portion of the third steering cylinder being connected to the reservoir;

a fourth steering cylinder pivotally connected to the frame generally near the lower side and generally near the forward end and generally near the second side of the frame, and pivotally connected to the forward cutter frame generally near the rearward end and generally near the lower side and generally near the second side of the forward cutter frame, the first, the second, the third and the fourth steering cylinders being actuatable to move the forward cutter frame generally about the pivotal connection provided via the universal connection, one portion of the fourth steering cylinder being connected to the pump and another portion of the fourth steering cylinder being connected to the reservoir; and means to actuate the first, the second, the third and the fourth steering cylinders for moving the forward cutter frame and the forward cutter connected thereto about the pivotal connection provided via the universal connection to predetermined positions to steeringly guide the miner through the earth formation;

a roll cylinder connected to the frame generally near the forward end and generally near the first side and generally between the upper and the lower sides of the frame, and connected to the forward cutter frame generally near the first side and generally near the rearward end and generally between the upper and the lower side of the forward cutter frame, one portion of the roll cylinder being connected to the pump and another portion of the roll cylinder being connected to the reservoir;

means to actuate the roll cylinder for moving the forward cutter frame and the forward cutter connected thereto about the pivotal connection provided via the universal connection, the roll cylinder cooperating with the first, the second, the third and the fourth steering cylinders to steeringly guide the miner through the earth formation;

a control valve interposed between the first steering cylinder and the pump and the reservoir having one position establishing fluidic communication between one portion of the first steering cylinder and the pump for applying a force to the forward cutter frame in one direction generally at the connection of the first steering cylinder to the forward cutter frame, and another position establishing fluidic communication between another portion of the first steering cylinder for applying a force in the opposite direction to the forward cutter frame generally at the connection of the first steering cylinder to the forward cutter frame a control valve interposed between the second steering cylinder and the pump and the reservoir having one position establishing fluidic communication between one portion of the second steering cylinder and the pump for applying a force to the forward cutter frame in one direction generally at the connection of the second steering cylinder to the forward cutter frame, and another position establishing fluidic communication between another portion of the second steering cylinder for applying a force in the opposite direction to the forward cutter frame generally at the connection of the second steering cylinder to the forward cutter frame;

a control valve interposed between the third steering cylinder and the pump and the reservoir having one position establishing fluidic communication between one portion of the third steering cylinder and the pump for applying a force to the forward cutter frame in one direction generally at the connection of the third steering cylinder to the forward cutter frame, and another position establishing fluidic communication between another portion of the third steering cylinder for applying a force in the opposite direction to the forward cutter frame generally at the connection of the third steering cylinder to the forward cutter frame;

a control valve interposed between the fourth steering cylinder and the pump and the reservoir having one position establishing fluidic communication between one portion of the fourth steering cylinder and the pump for applying a force to the forward cutter frame in one direction generally at the connection of the fourth steering cylinder to the forward cutter frame, and another position establishing fluidic communication between another portion of the fourth steering cylinder for applying a force in the opposite direction to the forward cutter frame generally at the connection of the fourth steering cylinder to the forward cutter frame;

a control valve interposed between the roll cylinder and the pump and the reservoir having one position establishing fluidic communication between one portion of the roll cylinder and the pump for applying a force to the forward cutter frame in one direction generally at the connection of the roll cylinder to the forward cutter frame, and another position establishing fluidic communication between another portion of the roll cylinder for applying a force in the opposite direction to the forward cutter frame generally at the connection of the roll cylinder to the forward cutter frame;

a control unit disposed at a remote location with respect to the location of the miner and connected to the control valve interposed between the first steering cylinder and the pump and the reservoir for remotely positioning the control valve to apply the force in the one direction and in the opposite direction to the forward cutter frame, and connected to the control valve interposed between the second steering cylinder and the pump and the reservoir for remotely positioning the control valve to apply the force in the one direction and in the opposite direction, and connected to the control valve interposed between the third steering cylinder and the pump and the reservoir for remotely positioning the control valve to apply the force in the one direction and in the opposite direction, and connected to the control valve interposed between the fourth steering cylinder and the pump and the reservoir to apply the force in the one direction and in the opposite direction to the forward cutter frame, and connected to the control valve interposed between the roll cylinder and the pump and the reservoir for remotely positioning the control valve to apply the force in the one direction and in the opposite direction, the control unit operating to remotely position the forward cutter frame in predetermined positions relative to the frame for guidingly steering the miner through the earth formation; and means in fluidic communication with the reservoir and in fluidic communication with the working fluid in the borehole near the location of the miner for maintaining a relatively constant, predetermined differential pressure between the working fluid in the borehole near the miner and fluid in the reservoir, the pressure of the fluid in the reservoir being thereby adjustingly controlled to compensate for the depth of the miner in the borehole; and means for passing the working fluid into the borehole to maintain the miner substantially submerged in the working fluid during the operation of the miner to excavate a portion of earth formation thereby forming the borehole.

47. The mining apparatus of claim 46 wherein the means for maintaining a constant differential pressure between the working fluid and the fluid in the reservoir is defined further to include:

a hydraulic cylinder, having a cylinder base and a piston slidingly disposed in the cylinder base, a portion of the hydraulic cylinder on one side of the piston being in fluidic communication with the reservoir and another position of the hydraulic cylinder being in fluidic communication with the working fluid in the borehole near the miner; and a spring connected to the piston applying a predetermined bias force on the piston in one direction, the bias force determining the differential pressure.

48. A mining apparatus for forming a borehole in an earth formation utilizing a working fluid comprising:

a miner, comprising:

a frame having a forward end, a rearward end, a first side, a second side, an upper side, and a lower side;

a universal connection having a portion connected to the frame;

a reservoir having a supply of fluid;

a pump in fluidic communication with the reservoir for supply fluid;

a forward cutter assembly connected to the forward end of the frame for excavatingly engaging the earth formation, the mined material being suspended in a working fluid thereby forming a slurry comprising the working fluid and the mined material excavated via the forward cutter assembly, the forward cutter assembly comprising:

a forward cutter frame having a forward end, a rearward end, a first side and a second side, the rearward end of the forward cutter frame being disposed near and spaced a distance from the forward end of the frame, the universal connection being disposed between the rearward end of the forward cutter frame and the forward end of the frame and of the universal connection being connected to the forward cutter frame, the forward cutter frame being movably positionable with respect to the frame about axes defined generally via centerlines extending through the pivotal connection between the frame and the forward cutter frame provided via the universal connection;

a forward cutter rotatably mounted on the forward end of the forward cutter frame for excavatingly engaging the material to be mined;

a forward cutter drive assembly connected to the forward cutter for driving the forward cutter to excavatingly engage the material to be mined;

a forward cutter positioning assembly connected to the forward cutter frame for movably positioning the forward cutter frame and the forward cutter connected thereto, comprising:

a first steering cylinder pivotally connected to the frame generally near the forward end and generally near the upper side and the first side of the frame, and pivotally connected to the forward cutter frame generally near the rearward end and generally near the first side and generally near the upper side of the forward cutter frame, one portion of the first steering cylinder being connected to the pump and another portion of the first steering cylinder being connected to the reservoir;

a second steering cylinder pivotally connected to the frame generally near the forward end and generally near the first side and generally near the lower side of the frame, and pivotally connected to the forward cutter frame generally near the first side and generally near the lower side and generally near the rearward end of the forward cutter frame, one portion of the second steering cylinder being connected to the pump and another portion of the second steering cylinder being connected to the reservoir;

a third steering cylinder pivotally connected to the frame generally near the second side and generally near the forward end and generally near the upper side of the frame, and pivotally connected to the forward cutter frame generally near the rearward end and generally near the second side and generally near the upper side of the forward cutter frame, one portion of the third steering cylinder being connected to the pump and another portion of the third steering cylinder being connected to the reservoir;

a fourth steering cylinder pivotally connected to the frame generally near the lower side and generally near the forward end and generally near the second side of the frame, and pivotally connected to the forward cutter frame generally near the rearward end and generally near the lower side and generally near the second side of the forward cutter frame, the first, the second, the third and the fourth steering cylinders being actuatable to move the forward cutter frame generally about the pivotal connection provided via the universal connection, one portion of the fourth steering cylinder being connected to the pump and another portion of the fourth steering cylinder being connected to the reservoir; and means to actuate the first, the second, the third and the fourth steering cylinders for moving the forward cutter frame and the forward cutter connected thereto about the pivotal connection provided via the universal connection to predetermined positions to steeringly guide the miner through the earth formation;

a roll cylinder connected to the frame generally near the forward end and generally near the first side and generally between the upper and the lower sides of the frame, and connected to the forward cutter frame generally near the first side and generally near the rearward end and generally between the upper and the lower side of the forward cutter frame, one portion of the roll cylinder being connected to the pump and another portion of the roll cylinder being connected to the reservoir;

means to actuate the roll cylinder for moving the forward cutter frame and the forward cutter connected thereto about the pivotal connection provided via the universal connection, the roll cylinder cooperating with the first, the second, the third and the fourth steering cylinders to steeringly guide the miner through the earth formation;

a control valve interposed between the first steering cylinder and the pump and the reservoir having one position establishing fluidic communication between one portion of the first steering cylinder and the pump for applying a force to the forward cutter frame in one direction generally at the connection of the first steering cylinder to the forward cutter frame, and another position establishing fluidic communication between another portion of the first steering cylinder for applying a force in the opposite direction to the forward cutter frame generally at the connection of the first steering cylinder to the forward cutter frame;

a control valve interposed between the second steering cylinder and the pump and the reservoir having one position establishing fluidic communication between one portion of the second steering cylinder and the pump for applying a force to the forward cutter frame in one direction generally at the connection of the second steering cylinder to the forward cutter frame, and another position establishing fluidic communication between another portion of the second steering cylinder for applying a force in the opposite direction to the forward cutter frame generally at the connection of the second steering cylinder to the forward cutter frame;

a control valve interposed between the third steering cylinder and the pump and the reservoir having one position establishing fluidic communication between one portion of the third steering cylinder and the pump for applying a force to the forward cutter frame in one direction generally at the connection of the third steering cylinder to the forward cutter frame, and another position establishing fluidic communication between another portion of the third steering cylinder for applying a force in the opposite direction to the forward cutter frame generally at the connection of the third steering cylinder to the forward cutter frame;

a control valve interposed between the fourth steering cylinder and the pump and the reservoir having one position establishing fluidic communication between one portion of the fourth steering cylinder and the pump for applying a force to the forward cutter frame in one direction generally at the connection of the fourth steering cylinder to the forward cutter frame, and another position establishing fluidic communication between another portion of the fourth steering cylinder for applying a force in the opposite direction to the forward cutter frame generally at the connection of the fourth steering cylinder to the forward cutter frame;

a control valve interposed between the roll cylinder and the pump and the reservoir having one position establishing fluidic communication between one portion of the roll cylinder and the pump for applying a force to the forward cutter frame in one direction generally at the connection of the roll cylinder to the forward cutter frame, and another position establishing fluidic communication between another portion of the roll cylinder for applying a force in the opposite direction to the forward cutter frame generally at the connection of the roll cylinder to the forward cutter frame;

a control unit disposed at a remote location with respect to the location of the miner and connected to the control valve interposed between the first steering cylinder and the pump and the reservoir for remotely positioning the control valve to apply the force in the one direction and in the opposite direction to the forward cutter frame, and connected to the control valve interposed between the second steering cylinder and the pump and the reservir for remotely positioning the control valve to apply the force in the one direction and in the opposite direction, and connected to the control valve interposed between the third steering cylinder and the pump and the reservoir for remotely positioning the control valve to apply the force in the one direction and in the opposite direction, and connected to the control valve interposed between the fourth steering cylinder and the pump and the reservoir to apply the force in the one direction and in the opposite direction to the forward cutter frame, and connected to the control valve interposed between the roll cylinder and the pump and the reservoir for remotely positioning the control valve to apply the force in the one direction and in the opposite direction, the control unit operating to remotely position the forward cutter frame in predetermined positions relative to the frame for guidingly steering the miner through the earth formation;

a rearward cutter assembly connected to the rearward end of the frame, comprising:

a rearward cutter frame, having a forward end and a rearward end, movably connected to the rearward end of the frame;

a rearward cutter rotatably mounted on the rearward cutter frame for excavatingly engaging the material to be mined;

a rearward cutter drive assembly connected to the rearward cutter for driving the rearward cutter to excavatingly engage the material to be mined; and a rearward cutter positioning assembly connected to the rearward cutter frame for movably positioning the rearward cutter frame and the rearward cutter connected thereto in a storage position and in a material engaging position, the rearward cutter being positioned to excavatingly engage the material to be mined in the material engaging position, the rearward cutter positioning assembly is connected to the pump and the reservoir;

a control valve interposed between the rearward cutter positioning assembly and the pump and the reservoir having one position connecting a portion of the rearward cutter positioning assembly to the pump for movably positioning the rearward cutter frame and the rearward cutter connected thereto in the storage position, and another position connecting another portion of the rearward cutter positioning assembly to the pump for movably positioning the rearward cutter frame and the rearward cutter connected thereto in the material engaging position, the control unit being connected to the control valve interposed between the rearward cutter positioning assembly and the pump and the reservoir for remotely positioning the control valve thereby remotely positioning the rearward cutter frame and the rearward cutter connected thereto in the storage position and in the material engaging position; and means for passing the working fluid into the borehole to maintain the miner substantially submerged in the working fluid during the operation of the miner to excavate a portion of earth formation thereby forming the borehole.

49. The mining apparatus of claim 48 wherein the forward cutter assembly is defined further to include:

means connected to the forward cutter and to the pump for rotatingly driving the forward cutter; and a control valve interposed between the means for rotatingly driving the forward cutter and the pump, having one position establishing fluidic communication between the pump and the means for rotatingly driving the forward cutter causing the forward cutter to be rotatingly driven; and wherein the control unit is connected to the control valve interposed between means for rotatingly driving the forward cutter and the pump for remotely positioning the control valve thereby remotely conditioning the means for rotatingly driving the forward cutter to rotatingly drive the forward cutter; and wherein the rearward cutter assembly is defined further to include:

means connected to the rearward cutter and to the pump for rotatingly driving the rearward cutter; and a control valve interposed between the means for rotatingly driving the rearward cutter and the pump, having one position establishing fluidic communication between the pump and the means for rotatingly driving the rearward cutter for causing the rearward cutter to be rotatingly driven; and wherein the control unit is connected to the control valve interposed between the means for rotatingly driving the rearward cutter and the pump for remotely positioning the control valve thereby remotely conditioning the means for rotatingly driving the rearward cutter to rotatingly drive the rearward cutter.

50. The mining machine of claim 48 wherein the mined material excavated via the forward cutter and via the rearward cutter is suspended in the working fluid thereby forming a slurry comprising the mined material and the working fluid, and wherein the miner is defined further to include:

a mined material removal assembly for receiving the slurry comprising the mined material and the working fluid from the forward cutter assembly in one position and for receiving the slurry comprising the working fluid and the mined material from the rearward cutter assembly in one other position, the slurry received from the forward cutter assembly and the slurry received from the rearward cutter assembly being passed from the miner; and wherein the miner is defined further to include:

a valve interposed between the forward cutter assembly and the mined material removal assembly having one position establishing fluidic communication between the forward cutter assembly and the mined material removal assembly for passing the slurry from the forward cutter assembly to the mined material removal assembly; and a valve interposed between the rearward cutter assembly and the mined material removal assembly having one position establishing fluidic communication between the forward cutter assembly and the mined material removal assembly for passing the slurry from the rearward cutter assembly to the mined material removal assembly; and wherein the control unit is defined further as being connected to the valve interposed between the forward cutter assembly and the mined material removal assembly for remotely positioning the valve to establish fluidic communication therebetween, and wherein the control unit is connected to the valve interposed between the rearward cutter assembly and the mined material removal assembly for remotely positioning the valve to establish fluidic communication therebetween.

51. A mining apparatus for forming a borehole in an earth formation utilizing a working fluid comprising:

means for passing a working fluid into the borehole, comprising:

a working fluid supply connected to the borehole, the working fluid being passed from the working fluid supply into the borehole;

a miner comprising:

a frame, having a forward end, a rearward end, a first side and a second side;

a forward cutter assembly connected to the frame for excavatingly engaging the earth formation, the mined material being suspended in the working fluid thereby forming a slurry comprising the mined material excavated via the forward cutter assembly and the working fluid, comprising:

a forward cutter frame having a forward end, a rearward end, a first side and a second side, the rearward end of the forward cutter frame being disposed near and spaced a distance from the forward end of the frame, the forward cutter frame having an opening formed therein and a passageway being disposed within the forward cutter frame with one end of the passageway being connected to the forward end of the forward cutter frame and encompassing the opening formed in the forward end of the forward cutter frame, the passageway having an opposite end connected to and extending through the rearward end of the forward cutter frame, and the slurry comprising the mined material excavated via the forward cutter assembly and the working fluid being moved into and through the passageway disposed in the forward cutter frame;

a forward cutter rotatably mounted on the forward end of the forward cutter frame for excavatingly engaging the material to be mined;

a forward cutter drive assembly connected to the forward cutter for driving the forward cutter to excavatingly engage the material to be mined; and a forward cutter positioning assembly connected to the forward cutter frame for movably positioning the forward cutter frame and the forward cutter connected thereto; and a mined material removal assembly connected to the frame for receiving the slurry comprising the mined material and the working fluid and passing the slurry from the miner.

52. The apparatus of claim 51 defined further to include:

means for receiving the slurry passing through the passageway disposed in the forward cutter frame and passing the slurry from the miner.

53. The mining apparatus of claim 51 wherein the miner is defined further to include:

a universal connection disposed between the rearward end of the forward cutter frame and the forward end of the frame, a portion of the universal connection being connected to the forward cutter frame and a portion of the universal connection being connected to the frame, the forward cutter frame being movably positionable with respect to the frame about axes defined generally via centerlines extending through the pivotal connection between the frame and the forward cutter frame provided via the universal connection; and means connected to the frame and the forward cutter frame for movably positioning the forward cutter frame generally about the pivotal connection provided via the universal connection.

54. The mining apparatus of claim 53 wherein the universal connection is defined further to include:

a spherically shaped member secured to the rearward end of the forward cutter frame; and a housing connected to the forward end of the frame having an opening formed in a portion thereof, a portion of the spherically shaped member being disposed in a portion of the opening in the housing and the opening in the housing providing a surface for journally engaging a portion of the outer surface of the spherically shaped member.

55. The mining apparatus of claim 54 wherein the spherically shaped member includes a passageway formed therethrough, the spherically shaped member being disposed on the rearward end of the forwrd cutter frame such that the passageway through the spherically shaped member is aligned with the passageway in the forward cutter frame, and wherein the housing includes an opening formed through a portion thereof, the opening in the housing being aligned with the opening in the spherically shaped member, and the openings in the housing and the spherically shaped member being in fluidic communication during the movement of the spherically shaped member within the housing as the forward cutter frame is pivotally moved about the connection provided via the universal connection.

56. The mining apparatus of claim 55 wherein the miner is defined further to include:

a conduit disposed within a portion of the frame with one end of the conduit being in fluidic communication with the opening formed in the spherically shaped member for receiving the slurry comprising the mined material excavated via the forward cutter assembly and the working fluid; and means for receiving the slurry comprising the mined material excavated via the forward cutter assembly and the working fluid from the conduit and passing said slurry from the miner.

57. The apparatus of claim 56 wherein the miner is defined further to include:

a rearward cutter assembly connected to the rearward end of the frame for excavatingly engaging the earth formation, the mined material being suspended in the working fluid thereby forming a slurry comprising the working fluid and the mined material excavated via the rearward cutter assembly; and wherein an opening is formed through the rearward end of the frame for receiving the slurry comprising the working fluid and the mined material excavated via the rearward cutter assembly; and wherein the miner is defined further to include:

a conduit disposed within a portion of the frame with one end of the conduit being in fluidic communication with the opening formed in the rearward end of the frame for receiving the slurry comprising the working fluid and the mined material excavated via the rearward cutter assembly; and means for receiving the slurry comprising the mined material excavated via the rearward cutter assembly and the working fluid from the conduit and passing said slurry from the miner.

58. The mining apparatus of claim 57 wherein the miner is defined further to include:

a valve interposed in the conduit receiving the slurry comprising the working fluid and the mined material excavated via the forward cutter assembly;

a valve interposed in the conduit receiving the slurry comprising the working fluid and the mined material excavated via the rearward cutter assembly; and means remotely located with respect to the miner connected to the valve interposed in the conduit receiving the slurry comprising the working fluid and the mined material excavated via the forward cutter assembly for positioning said valve in the opened position during the operation of the forward cutter assembly excavating the material to be mined, and connected to the valve interposed in the conduit receiving the slurry comprising the working fluid and the mined material excavated via the rearward cutter assembly for positioning said valve in the opened position during the operation of the rearward cutter assembly excavating the material to be mined.

59. A mining apparatus for forming a borehole in an earth formation utilizing a working fluid comprising:

means for passing a working fluid into the borehole, comprising:

a working fluid supply connected to the borehole, the working fluid being passed from the working fluid supply into the borehole;

a miner comprising:

a frame, having a forward end, a rearward end, a first side and a second side;

a forward cutter assembly connected to the frame for excavatingly engaging the earth formation, the mined material being suspended in the working fluid thereby forming a slurry comprising the mined material excavated via the forward cutter assembly and the working fluid, the forward cutter assembly comprising:

a forward cutter frame having a forward end, a rearward end, a first side and a second side, the rearward end of the forward cutter frame being disposed near and spaced a distance from the forward end of the frame;

a forward cutter rotatably mounted on the forward end of the forward cutter frame for excavatingly engaging the material to be mined;

a forward cutter drive assembly connected to the forward cutter for driving the forward cutter to excavatingly engage the material to be mined; and a forward cutter positioning assembly connected to the forward cutter frame for movably positioning the forward cutter frame and the forward cutter connected thereto;

a rearward cutter assembly connected to the rearward end of the frame, comprising:

a rearward cutter frame, having a forward end and a rearward end, movably connected to the rearward end of the frame, an opening being formed through the rearward end of the rearward cutter frame for receiving the slurry comprising the mined material excavated via the rearward cutter assembly;

a rearward cutter rotatably mounted on the rearward cutter frame for excavatingly engaging the material to be mined, comprising:

a cutter shaft journally mounted on the rearward end of the rearward cutter frame, having a first flight of vanes extending a distance radially from the cutter shaft and helically about the cutter shaft in a generally clockwise direction, and a second flight of vanes extending a distance generally radially from the cutter shaft and helically about the cutter shaft in a generally counterclockwise direction, the first and the second flights of vanes cooperating to engage and move the mined material excavated via the rearward cutter assembly generally toward the opening in the rearward end of the rearward cutter frame thereby facilitating the moving of the slurry comprising the working fluid and the mined material into and through the opening in the rearward cutter frame;

a rearward cutter drive assembly connected to the rearward cutter for driving the rearward cutter to excavatingly engage the material to be mined; and a rearward cutter positioning assembly connected to the rearward cutter frame for movably positioning the rearward cutter frame and the rearward cutter connected thereto in a storage position and in a material engaging position, the rearward cutter being positioned to excavatingly engage the material to be mined in the material engaging position; and a mined material removal assembly connected to the frame for receiving the slurry comprising the mined material and the working fluid and passing the slurry from the miner.

60. A mining apparatus for forming a borehole in an earth formation comprising:

a miner, comprising:

a frame, having a forward end, a rearward end, a first side, a second side, an upper side and a lower side;

a universal connection having a portion connected to the frame;

a forward cutter assembly movably connected to the frame for excavatingly engaging the earth formation in one condition, comprising:

a forward cutter frame having a forward end, a rearward end, a first side and a second side, an upper side and a lower side, the rearward end of the forward cutter frame being disposed near and spaced a distance from the forward end of the frame, the universal connection being disposed between the rearward end of the forward cutter frame and the forward end of the frame, a portion of the universal connection being connected to the forward cutter frame and a portion of the universal connection being connected to the frame, the forward cutter frame being movably positionable with respect to the frame about axes defined generally via centerlines extending through the pivotal connection between the frame and the forward cutter frame provided via the universal connection;

a forward cutter rotatably mounted on the forward end of the forward cutter frame for excavatingly engaging the material to be mined; and a forward cutter drive assembly connected to the forward cutter for driving the forward cutter to excavatingly engage the material to be mined;

a forward cutter positioning assembly connected to the forward cutter frame for movably positioning the forward cutter assembly to guidingly steer the miner through portions of the earth formation, comprising:

a first steering cylinder pivotally connected to the frame generally near the forward end and generally near the upper side and the first side of the frame, and pivotally connected to the forward cutter frame generally near the rearward end and generally near the first side and generally near the upper side of the forward cutter frame;

a second steering cylinder pivotally connected to the frame generally near the forward end and generally near the first side and generally near the lower side of the frame, and pivotally connected to the forward cutter frame generally near the first side and generally near the lower side and generally near the rearward end of the forward cutter frame;

a third steering cylinder pivotally connected to the frame generally near the second side and generally near the forward end and generally near the upper side of the frame, and pivotally connected to the forward cutter frame generally near the rearward end and generally near the second side and generally near the upper side of the forward cutter frame;

a fourth steering cylinder pivotally connected to the frame generally near the lower side and generally near the forward end and generally near the second side of the frame, and pivotally connected to the forward cutter frame generally near the rearward end and generally near the lower side and generally near the second side of the forward cutter frame, the first, the second, the third and the fourth steering cylinders being actuatable to move the forward cutter frame generally about the pivotal connection provided via the universal connection; and means to actuate the first, the second, the third and the fourth steering cylinders for moving the forward cutter frame and the forward cutter connected thereto about the pivotal connection provided via the universal connection to predetermined positions to steeringly guide the miner through the earth formation;

a rearward cutter assembly movably connected to the frame and movably positionable in a storage position and in a material engaging position, the rearward cutter assembly excavatingly engaging the earth formation in the material engaging position, comprising:

a rearward cutter frame, having a forward end and a rearward end, movably connected to the rearward end of the frame;

a rearward cutter rotatably mounted on the rearward cutter frame for excavatingly engaging the material to be mined; and a rearward cutter drive assembly connected to the rearward cutter for driving the rearward cutter to excavatingly engage the material to be mined;

rearward cutter positioning assembly connected to the rearward cutter frame for positioning the rearward cutter assembly in the storage position and in the material engaging position, the rearward cutter being positioned to excavatingly engage the material to be mined in the material engaging position, comprising:

at least two pivot arms, each pivot arm having one end pivotally connected to the frame and an opposite end pivotally connected to the rearward cutter frame, the pivot arms pivotally connecting the rearward cutter frame to the frame for pivotally moving the rearward cutter frame and the rearward cutter connected thereto in one direction generally toward a storage position and in another direction generally toward a material engaging position; and at least two rear cylinders, each rear cylinder being pivotally connected to the frame and pivotally connected to the rearward cutter frame for moving the rearward cutter frame and the rearward cutter connected thereto to the storage position in one actuated condition of the rear cylinders and for moving the rearward cutter frame and the rearward cutter connected thereto to the material engaging position in one other actuated condition;

means remotely located with respect to the miner and connected to the rear cylinders for remotely conditioning the rear cylinders in the one condition for moving the rearward cutter frame and the rearward cutter connected thereto to the storage position and for remotely conditioning the rear cylinders in the other conditions for moving the rearward cutter frame and the rearward cutter connected thereto to the material engaging position;

a launching assembly for moving the miner into a portion of the earth formation and withdrawing the miner from a portion of the earth formation; and a control unit disposed at a remote location with respect to the location of the miner, the control unit being connected to the means for movably positioning the forward cutter assembly and to the means for movably positioning the rearward cutter assembly for remotely conditioning the forward cutter assembly to excavatingly engage the earth formation while moving the miner into the earth formation and for remotely positioning the rearward cutter assembly in the storage position while moving the miner into the earth formation and for remotely positioning the rearward cutter assembly in the material engaging position while withdrawing the miner from the earth formation.

61. The mining apparatus of claim 60 wherein the miner is defined further to include:

a roll cylinder connected to the frame generally near the forward end and generally near the first side and generally between the upper and the lower sides of the frame, and connected to the forward cutter frame generally near the first side and generally near the rearward end and generally between the upper and the lower side of the forward cutter frame; and means to actuate the roll cylinder for moving the forward cutter frame and the forward cutter connected thereto about the pivotal connection provided via the universal connection, the roll cylinder cooperating with the first, the second, the third and the fourth steering cylinders to steeringly guide the miner through the earth formation.

62. A mining apparatus for forming a borehole in an earth formation comprising:

a miner, comprising:

a frame, having a forward end and a rearward end; and a forward cutter assembly connected to the forward end of the frame for excavatingly engaging the earth formation;

at least one carrier, each carrier having a forward end and a rearward end, the forward end of one of the carriers being removably connectable to the miner and the forward end of the other carriers each being removably connectable to the rearward end of one other carrier, each carrier comprising:

a first carrier beam having a forward end and a rearward end;

a second carrier beam having a forward end and a rearward end, the second carrier beam being spaced a distance from the first carrier beam, and the forward ends of the first and the second carrier beams forming the forward end of the carrier and the rearward ends of the first and the second carrier beams forming the rearward end of the carrier;

means for supporting the first and the second carrier beams in the spaced-apart relationship; and a cutting bar connected to the first and the second carrier beams generally near the rearward ends of the first and the second carrier beams, having a cutting edge formed on a portion thereof for facilitating the moving of the miner and the carriers connected thereto through the earth formation in the event a portion of the earth formation formed via the borehole collapses; and means connected to the carrier to movingly support the carrier for movement through the earth formation.

63. A mining apparatus for forming a borehole in an earth formation comprising:

a miner, comprising:

a frame having a forward end, a rearward end, a first side, a second side, an upper side, and a lower side;

a universal connection having a portion connected to the frame;

a reservoir having a supply of fluid;

a pump in fluidic communication with the reservoir for supply fluid;

a forward cutter assembly connected to the forward end of the frame for excavatingly engaging the earth formation comprising:

a forward cutter frame having a forward end, a rearward end, a first side and a second side, the rearward end of the forward cutter frame being disposed near and spaced a distance from the forward end of the frame, the universal connection being disposed between the rearward end of the forward cutter frame and the forward end of the frame and of the universal connection being connected to the forward cutter frame, the forward cutter frame being movably positionable with respect to the frame about axes defined generally via centerlines extending through the pivotal connection between the frame and the forward cutter frame provided via the universal connection;

a forward cutter rotatably mounted on the forward end of the forward cutter frame for excavatingly engaging the material to be mined;

a forward drive assembly connected to the forward cutter for driving the forward cutter to excavatingly engage the material to be mined;

a forward cutter positioning assembly connected to the forward cutter frame for movably positioning the forward cutter frame and the forward cutter connected thereto, comprising:

a first steering cylinder pivotally connected to the frame generally near the forward end and generally near the upper side and the first side of the frame, and pivotally connected to the forward cutter frame generally near the rearward end and generally near the first side and generally near the upper side of the forward cutter frame, one portion of the first steering cylinder being connected to the pump and another portion of the first steering cylinder being connected to the reservoir;

a second steering cylinder pivotally connected to the frame generally near the forward end and generally near the first side and generally near the lower side of the frame, and pivotally connected to the forward cutter frame generally near the first side and generally near the lower side and generally near the rearward end of the forward cutter frame, one portion of the second steering cylinder being connected to the pump and another portion of the second steering cylinder being connected to the reservoir;

a third steering cylinder pivotally connected to the frame generally near the second side and generally near the forward end and generally near the upper side of the frame, and pivotally connected to the forward cutter frame generally near the rearward end and generally near the second side and generally near the upper side of the forward cutter frame, one portion of the third steering cylinder being connected to the pump and another portion of the third steering cylinder being connected to the reservoir;

a fourth steering cylinder pivotally connected to the frame generally near the lower side and generally near the forward end and generally near the second side of the frame, and pivotally connected to the forward cutter frame generally near the rearward end and generally near the lower side and generally near the second side of the foward cutter frame, the first, the second, the third and the fourth steering cylinders being actuatable to move the forward cutter frame generally about the pivotal connection provided via the universal connection, one portion of the fourth steering cylinder being connected to the pump and another portion of the fourth steering cylinder being connected to the reservoir; and means to actuate the first, the second, the third and the fourth steering cylinders for moving the forward cutter frame and the forward cutter connected thereto about the pivotal connection provided via the universal connection to predetermined positions to steeringly guide the miner through the earth formation;

a roll cylinder connected to the frame generally near the forward end and generally near the first side and generally between the upper and the lower sides of the frame, and connected to the forward cutter frame generally near the first side and generally near the rearward end and generally between the upper and the lower side of the forward cutter frame, one portion of the roll cylinder being connected to the pump and another portion of the roll cylinder being connected to the reservoir;

means to actuate the roll cylinder for moving the forward cutter frame and the forward cutter connected thereto about the pivotal connection provided via the universal connection, the roll cylinder cooperating with the first, the second, the third and the fourth steering cylinders to steeringly guide the miner through the earth formation;

a control valve interposed between the first steering cylinder and the pump and the reservoir having one position establishing fluidic communication between one portion of the first steering cylinder and the pump for applying a force to the forward cutter frame in one direction generally at the connection of the first steering cylinder to the forward cutter frame, and another position establishing fluidic communication between another portion of the first steering cylinder for applying a force in the opposite direction to the forward cutter frame generally at the connection of the first steering cylinder to the forward cutter frame;

a control valve interposed between the second steering cylinder and the pump and the reservoir having one position establishing fluidic communication between one portion of the second steering cylinder and the pump for applying a force to the forward cutter frame in one direction generally at the connection of the second steering cylinder to the forward cutter frame, and another position establishing fluidic communication between another portion of the second steering cylinder for applying a force in the opposite direction to the forward cutter frame generally at the connection of the second steering cylinder to the forward cutter frame;

a control valve interposed between the third steering cylinder and the pump and the reservoir having one position establishing fluidic communication between one portion of the third steering cylinder and the pump for applying a force to the forward cutter frame in one direction generally at the connection of the third steering cylinder to the forward cutter frame, and another position establishing fluidic communication between another portion of the third steering cylinder for applying a force in the opposite direction to the forward cutter frame generally at the connection of the third steering cylinder to the forward cutter frame;

a control valve interposed between the fourth steering cylinder and the pump and the reservoir having one position establishing fluidic communication between one portion of the fourth steering cylinder and the pump for applying a force to the forward cutter frame in one direction generally at the connection of the fourth steering cylinder to the foward cutter frame, and another position establishing fluidic communication between another portion of the fourth steering cylinder for applying a force in the opposite direction to the forward cutter frame generally at the connection of the fourth steering cylinder to the forward cutter frame;

a control valve interposed between the roll cylinder and the pump and the reservoir having one position establishing fluidic communication between one portion of the roll cylinder and the pump for applying a force to the forward cutter frame in one direction generally at the connection of the roll cylinder to the forward cutter frame, and another position establishing fluidic communication between another portion of the roll cylinder for applying a force in the opposite direction to the forward cutter frame generally at the connection of the roll cylinder to the forward cutter frame;

a control unit disposed at a remote location with respect to the location of the miner and connected to the control valve interposed between the first steering cylinder and the pump and the reservoir for remotely positioning the control valve to apply the force in the one direction and in the opposite direction to the forward cutter frame, and connected to the control valve interposed between the second steering cylinder and the pump and the reservoir for remotely positioning the control valve to apply the force in the one direction and in the opposite direction, and connected to the control valve interposed between the third steering cylinder and the pump and the reservoir for remotely positioning the control valve to apply the force in the one direction and in the opposite direction, and connected to the control valve interposed between the fourth steering cylinder and the pump and the reservoir to apply the force in the one direction and in the opposite direction to the forward cutter frame, and connected to the control valve interposed between the roll cylinder and the pump and the reservoir for remotely positioning the control valve to apply the force in the one direction and in the opposite direction, the control unit operating to remotely position the forward cutter frame in predetermined positions relative to the frame for guidingly steering the miner through the earth formation;

a rearward cutter assembly connected to the rearward end of the frame, comprising:

a rearward cutter frame, having a forward end and a rearward end, movably connected to the rearward end of the frame;

a rearward cutter rotatably mounted on the rearward cutter frame for excavatingly engaging the material to be mined;

a rearward cutter drive assembly connected to the rearward cutter for driving the rearward cutter to excavatingly engage the material to be mined; and a rearward cutter positioning assembly connected to the rearward cutter frame for movably positioning the rearward cutter frame and the rearward cutter connected thereto in a storage position and in a material engaging position, the rearward cutter being positioned to excavatingly engage the material to be mined in the material engaging position, the rearward cutter positioning assembly is connected to the pump and the reservoir; and a control valve interposed between the rearward cutter positioning assembly and the pump and the reservoir having one position connecting a portion of the rearward cutter positioning assembly to the pump for movably positioning the rearward cutter frame and the rearward cutter connected thereto in the storage position, and another position connecting another portion of the rearward cutter positioning assembly to the pump for movably positioning the rearward cutter frame and the rearward cutter connected thereto in the material engaging position, the control unit being connected to the control valve interposed between the rearward cutter positioning assembly and the pump and the reservoir for remotely positioning the control valve thereby remotely positioning the rearward cutter frame and the rearward cutter connected thereto in the storage position and in the material engaging position.

64. A mining apparatus for forming a borehole in an earth formation utilizing a working fluid comprising:

a miner, comprising:

a frame having a forward end, a rearward end, a first side and a second side; and a forward cutter assembly movably connected to the forward end of the frame for excavatingly engaging the mined material being suspended in a working fluid thereby forming slurry comprising the working fluid and the mined material excavated via the forward cutter assembly, comprising:

a forward cutter;

a forward cutter frame having a forward end, a rearward end, a first side and a second side, the rearward end of the forward cutter frame being disposed near and spaced a distance from the forward end of the frame, the forward cutter being rotatably mounted on the forward end of the forward cutter frame for excavatingly engaging the material to be mined, and the forward cutter frame having an opening formed therein and a passageway disposed within the forward cutter frame with one end of the passageway being connected to the forward end of the forward cutter frame and encompassing the opening formed in the forward end of the forward cutter frame, the passageway having an opposite end connected to and extending through the rearward end of the forward cutter frame, and the slurry comprising the mined material excavated by the forward cutter assembly and the working fluid being moved into and through the passageway disposed in the forward cutter frame;

cutter shaft journally connected on the forward cutter frame, having a first flight of vanes extending a distance radially from the cutter shaft and helically about the cutter shaft in a generally clockwise direction, and a second flight of vanes extending a distance generally radially from the cutter shaft and helically about the cutter shaft in the generally counterclockwise direction, the first and the second flights of vanes cooperating to engage and move the mined material excavated by the forward cutter assembly generally toward the opening in the forward end of the forward cutter frame thereby facilitating the moving of the slurry comprising the working fluid and the mined material into and through the passageway disposed in the forward cutter frame; and a forward cutter drive assembly connected to the forward cutter for driving the forward cutter to excavatingly engage the material to be mined;

a forward cutter positioning assembly connected to the forward cutter for movably positioning the forward cutter about horizontal and vertical axes to guidingly steer the miner through portions of the earth formations;

an upper mold board connected to the forward end of the forward cutter frame and disposed between the forward cutter and the forward cutter frame;

a lower moldboard connected to the forward end of the forward cutter frame and disposed between the forward cutter and the forward cutter frame, the upper and the lower moldboards cooperating to encompass a portion of the forward cutters;

means for passing the working fluid into the borehole to maintain the miner substantially submerged in the working fluid during the operation of the miner to excavate a portion of the earth formation thereby forming the borehole;

a control unit connected to the forward cutter positioning assembly, the control unit operating the forward cutter positioning assembly to position the forward cutter in predetermined positions for guidingly steering the miner through portions of the earth formation as the miner is being moved in one direction through the earth formation via the positioning of the forward cutter; and a launching assembly for moving the miner into the earth formation and withdrawing the miner from the earth formation.

65. The mining apparatus of claim 64 wherein the upper and the lower moldboards are each defined further as being sized with respect to a diameter of the forward cutter such that a space exists between an outermost end of the upper moldboard and an adjacent portion of the earth formation formed via the borehole and such that a space exists between an outermost end of the lower moldboard and an adjacent portion of the earth formation formed via the borehole, the spaces forming orifices permitting the passage of the working fluid, and a differential pressure drop across said orifices resulting in a component of force acting against a portion of the earth formation formed via the borehole for facilitating the cutting of the material to be mined via the forward cutter assembly.

66. The mining apparatus of claim 64 wherein the upper and the lower moldboards are sized and shaped to cooperatingly retain a substantial portion of the mined material excavated via the forward cutter within a space generally defined via the forward end of the forward cutter frame and a portion of the earth formation being excavatingly engaged via the forward cutter.

67. A mining apparatus for forming a borehole in an earth formation utilizing a working fluid comprising:

a miner, comprising:

a frame, having a forward end, a rearward end, an upper side and a lower side, a first side and a second side; and a forward cutter assembly movably connected to the forward end of the frame for excavatingly engaging the earth formation, the mined material being suspended in a working fluid thereby forming a slurry comprising the working fluid in the mined material excavated via the forward cutter assembly comprising:

a forward cutter;

a forward cutter frame having a forward end, a rearward end, an upper side and a lower side, a first side and a second side, the rearward end of the forward cutter frame being disposed near and spaced a distance from the forward end of the frame, the forward cutter being rotatably mounted on the forward end of the forward cutter frame for excavatingly engaging the material to be mined;

a forward cutter drive assembly connected to the forward cutter for driving the forward cutter to excavatingly engage the materials to be mined;

a universal connection disposed between the rearward end of the forward cutter frame and the forward end of the frame, a portion of the universal connection being connected to the forward cutter frame and a portion of the universal connection being connected to the frame, the forward cutter frame being movably positionable with respect to the frame about axes defined generally via centerlines extending through the pivotal connection between the frame and the forward cutter frame provided by the universal connection;

a forward cutter positioning assembly connected to the forward cutter for movably positioning the forward cutter about horizontal and vertical axes to guidingly steer the miner through portions of the earth formation, the forward cutter positioning assembly comprising:

a first steering cylinder pivotally connected to the frame generally near the forward end and generally near the upper side and the first side of the frame, and pivotally connected to the forward cutter frame generally near the rearward end and generally near the first side and generally near the upper side of the forward cutter frame;

a second steering cylinder pivotally connected to the frame generally near the forward end and generally near the first side and generally near the lower side of the frame, and pivotally connected to the forward cutter frame generally near the first side and generally near the lower side and generally near the rearward end of the forward cutter frame;

a third steering cylinder pivotally connected to the frame generally near the second side and generally near the forward end and generally near the upper side of the frame, and pivotally connected to the forward cutter frame generally near the rearward end and generally near the second side and generally near the upper side of the forward cutter frame;

a fourth steering cylinder pivotally connected to the frame generally near the lower side and generally near the forward end and generally near the second side of the frame, and pivotally connected to the forward cutter frame generally near the rearward end and generally near the lower side and generally near the second side of the forward cutter frame, the first, the second, the third and the fourth steering cylinders being actuatable to move the forward cutter frame generally about the pivotal connection provided via the universal connection; and means to actuate the first, the second, the third and the fourth steering cylinders for moving the forward cutter frame and the forward cutter connected thereto about the pivotal connection provided via the universal connection to predetermined positions to steeringly guide the miner through the earth formation;

means for passing the working fluid into the borehole to maintain the miner substantially submerged in the working fluid during the operation of the miner;

a control unit connected to the forward cutter positioning assembly, the control unit operating the forward cutter positioning assembly to position the forward cutter in predetermined positions for guidingly steering the miner through portions of the earth formation as the miner is being moved in one direction through the earth formation via the positioning of the forward cutter; and a launching assembly for moving the miner into the earth formation and withdrawing the miner from the earth formation.

68. The mining apparatus of claim 67 wherein the means to actuate the first, the second, the third and the fourth steering cylinders is defined further as being located at a remote position with respect to the location of the miner for steeringly guiding the miner from a remote location.

69. The mining apparatus of claim 67 wherein the miner is defined further to include:

a roll cylinder connected to the frame generally near the forward end and generally near the first side and generally between the upper and the lower sides of the frame, and connected to the forward cutter frame generally near the first side and generally near the rearward end and generally between the upper and the lower side of the forward cutter frame; and means to actuate the roll cylinder for moving the forward cutter frame and the forward cutter connected thereto about the pivotal connection provided via the universal connection, the roll cylinder cooperating with the first, the second, the third and the fourth steering cylinders to steeringly guide the miner through the earth formation.

70. The mining apparatus of claim 69 wherein the miner is defined further to include:

a reservoir having a supply of fluid; and a pump in fluidic communication with the reservoir for supply fluid; and wherein one portion of the first steering cylinder is connected to the pump and another portion of the first steering cylinder is connected to the reservoir, and wherein one portion of the second steering cylinder is connected to the pump and another portion of the second steering cylinder is connected to the reservoir, and wherein one portion of the third steering cylinder is connected to the pump and another portion of the third steering cylinder is connected to the reservoir, and wherein one portion of the fourth steering cylinder is connected to the pump and another portion of the fourth steering cylinder is connected to the reservoir, and wherein one portion of each roll cylinder is connected to the pump and another portion of each roll cylinder is connected to the reservoir, and wherein the miner is defined further to include:

a control valve interposed between the first steering cylinder and the pump and the reservoir having one position establishing fluidic communication between one portion of the first steering cylinder and the pump for applying a force to the forward cutter frame in one direction generally at the connection of the first steering cylinder to the forward cutter frame, and another position establishing fluidic communication between another portion of the first steering cylinder for applying a force in the opposite direction to the forward cutter frame generally at the connection of the first steering cylinder to the forward cutter frame;

a control valve interposed between the second steering cylinder and the pump and the reservoir having one position establishing fluidic communication between one portion of the second steering cylinder and the pump for applying a force to the forward cutter frame in one direction generally at the connection of the second steering cylinder to the forward cutter frame, and another position establishing fluidic communication between another portion of the second steering cylinder for applying a force in the opposite direction to the forward cutter frame generally at the connection of the second steering cylinder to the forward cutter frame;

a control valve interposed between the third steering cylinder and the pump and the reservoir having one position establishing fluidic communication between one portion of the third steering cylinder and the pump for applying a force to the forward cutter frame in one direction generally at the connection of the third steering cylinder to the forward cutter frame, and another position establishing fluidic communication between another portion of the third steering cylinder for applying a force in the opposite direction to the forward cutter frame generally at the connection of the third steering cylinder to the forward cutter frame;

a control valve interposed between the fourth steering cylinder and the pump and the reservoir having one position establishing fluidic communication between one portion of the fourth steering cylinder and the pump for applying a force to the forward cutter frame in one direction generally at the connection of the fourth steering cylinder to the forward cutter frame, and another position establishing fluidic communication between another portion of the fourth steering cylinder for applying a force in the opposite direction to the forward cutter frame generally at the connection of the fourth steering cylinder to the forward cutter frame;

a control valve interposed between the roll cylinder and the pump and the reservoir having one position establishing fluidic communication between one portion of the roll cylinder and the pump for applying a force to the forward cutter frame in one direction generally at the connection of the roll cylinder to the forward cutter frame, and another position establishing fluidic communication between another portion of the roll cylinder for applying a force in the opposite direction to the forward cutter frame generally at the connection of the roll cylinder to the forward cutter frame; and wherein the control unit is defined further as being disposed at a remote location with respect to the location of the miner and connected to the control valve interposed between the first steering cylinder and the pump and the reservoir for remotely positioning the control valve to apply the force in the one direction and in the opposite direction to the forward cutter frame, and connected to the control valve interposed between the second steering cylinder and the pump and the reservoir for remotely positioning the control valve to apply the force in the one direction and in the opposite direction, and connected to the control valve interposed between the third steering cylinder and the pump and the reservoir for remotely positioning the control valve to apply the force in the one direction and in the opposite direction, and connected to the control valve interposed between the fourth steering cylinder and the pump and the reservoir to apply the force in the one direction and in the opposite direction to the forward cutter frame, and connected to the control valve interposed between the roll cylinder and the pump and the reservoir for remotely positioning the control valve to apply the force in the one direction and in the opposite direction the control unit operating to remotely position the forward cutter frame in predetermined positions relative to the frame for guidingly steering the miner through the earth formation.

71. A mining apparatus for forming a borehole in an earth formation utilizing working fluid comprising:

a miner, comprising:

a frame, having a forward end, a rearward end, a first side and a second side; and a forward cutter assembly connected to the frame for excavatingly engaging the earth formation, the mined material being suspended in the working fluid thereby forming a slurry comprising the mined material excavated via forward cutter assembly and the working fluid, comprising:

a forward cutter frame having a forward end, a first side and a second side, the rearward end to the forward cutter frame being disposed near and spaced a distance from the forward end of the frame, the forward cutter frame having a passageway formed through a portion thereof, and the slurry comprising the mined material excavated by the forward cutter assembly and the working fluid being moved into and through the passageway in the forward cutter frame;

a forward cutter rotatably mounted on the forward end of the forward cutter frame for excavatingly engaging the material to be mined;

a forward cutter drive assembly connected to the forward cutter for driving the forward cutter to excavatingly engage the material to be mined; and a forward cutter positioning assembly connected to the forward cutter frame for movably positioning the forward cutter frame and the forward cutter connected thereto;

a rearward cutter assembly connected to the rearward end of the frame for excavatingly engaging the earth formation, the mined material being suspended in the working fluid thereby forming a slurry comprising the working fluid and the mined material excavated by the rearward cutter assembly;

a mined material removal assembly connected to the frame for receiving the slurry passing from the passageway in the forward cutter frame and for passing the slurry from the miner, the mined material removal assembly receiving the slurry comprising the mined material and the working fluid from the forward cutter assembly in one position and for receiving the slurry comprising the working fluid and the mined material from the rearward cutter assembly in one other position, the slurry received from the forward cutter assembly and the slurry received from the rearward cutter assembly being passed from the miner; and a working fluid supply connected to the borehole, the working fluid being passed from the working fluid supply into the borehole.

72. A mining apparatus for forming a borehole in an earth formation utilizing the working fluid comprising: means for passing a working fluid into the borehole; and a miner, comprising:

a frame, having a forward end, a rearward end, a first side and a second side; and a forward cutter assembly connected to the frame for excavatingly engaging the earth formation, the mined material being suspended in the working fluid thereby forming a slurry comprising the mined material excavated via the forward cutter assembly and the working fluid, comprising:

a forward cutter frame having a forward end, a rearward end, a first side and a second side, the rearward end of the forward cutter frame being disposed near and spaced a distance from the forward end of the frame, the forward cutter frame having a passageway formed through a portion thereof, and the slurry comprising the mined material excavated via the forward cutter assembly and the working fluid being moved into and through the passageway in the forward cutter frame;

a forward cutter rotatably mounted on the forward end of the forward cutter frame for excavatingly engaging the material to be mined;

a forward cutter drive assembly connected to the forward cutter for driving the forward cutter to excavatingly engage the material to be mined; and a forward cutter positioning assembly connected to the forward cutter frame for movably positioning the forward cutter frame and the forward cutter connected thereto;

a rearward cutter assembly connected to the rearward end of the frame, comprising:

a rearward cutter frame, having a forward end and a rearward end, movably connected to the rearward end of the frame;

a rearward cutter rotatably mounted on the rearward cutter frame for excavatingly engaging the material to be mined;

a rearward cutter drive assembly connected to the rearward cutter for driving the rearward cutter to excavatingly engage the material to be mined; and a rearward cutter positioning assembly connected to the rearward cutter frame for movably positioning the rearward cutter frame and the rearward cutter connected thereto in a storage position and in a material engaging position, the rearward cutter being positioned to excavatingly engage the material to be mined and the material engaging position; and a mined material removal assembly connected to the frame for receiving the slurry passing from the passageway in the forward cutter frame and for passing the slurry from the miner.

73. The mining apparatus of claim 72 wherein the means for passing the working fluid into the borehole is defined further to include:

a working fluid supply connected to the borehole, the working fluid being passed from the working fluid supply into the borehole.

74. The mining apparatus of claim 73 defined further to include:

a compressed gas supply connected to the mined material removal assembly for supplying compressed gas to the mined material removal assembly, the compressed gas being passed into the slurry comprising the mined material and the working fluid for reducing the weight of the mined material in the slurry and creating a pressure differential between the mined material in the slurry being passed from the miner via the mined material removal assembly and the working fluid and the mined material in the borehole generally near the miner thereby facilitating the moving of the slurry from the mined material removal assembly.

75. The apparatus of claim 74 defined further to include:

means connected to the mined material removal assembly for receiving the slurry comprising the mined material, the working fluid and the compressed gas, and separting the mined material, the compressed gas and the working fluid;

means receiving the compressed gas separated from the slurry comprising the compressed gas, the working fluid and mined material, for supplying the compressed gas to the compressed gas supply; and means receiving the working fluid separated from the slurry comprising the compressed gas, the working fluid and the mined material, for supplying the working fluid to the working fluid supply.

76. A miner for forming a borehole in an earth formation comprising:

a frame having a forward end, a rearward end, a first side a second side, an upper side and a lower side;

a forward cutter frame having a forward end, a rearward end, a first side, a second side, an upper side and a lower side, the rearward end of the forward cutter frame being disposed near and spaced a distance from the forward end of the frame;

a forward cutter rotatably mounted on the forward cutter frame for excavatingly engaging the material to be mined;

a forward cutter drive assembly connected to the forward cutter for driving the forward cutter to excavatingly engage the material to be mined;

a universal connection disposed between the rearward end of the forward cutter frame and the forward end of the frame, a portion of the universal connection being connected to the forward cutter frame and a portion of the universal connection being connected to the frame, the forward cutter frame being movably positionable with respect to the frame about horizontal and vertical axes defined generally via centerlines extending through the pivotal connection between frame and the forward cutter frame provided via the universal connection;

means connected to the frame and the forward cutter frame for movably positioning the forward cutter frame generally about the pivotal connection provided by the universal connection, thereby movably positioning the forward cutter to guidingly steer the miner through portions of the earth formation, comprising:

a first steering cylinder pivotally connected to the frame generally near the forward end and generally near the upper side and the first side of the frame, and pivotally connected to the forward cutter frame generally near the rearward end and generally near the first side and generally near the upper side of the forward cutter frame;

a second steering cylinder pivotally connected to the frame generally near the forward end and generally near the first side and generally near the lower side of the frame, and pivotally connected to the forward cutter frame generally near the first side and generally near the lower side and generally near the rearward end of the forward cutter frame;

a third steering cylinder pivotally connected to the frame generally near the second side and generally near the forward end and generally near the upper side of the frame, and pivotally connected to the forward cutter frame generally near the rearward end and generally near the second side and generally near the upper side of the forward cutter frame;

a fourth steering cylinder pivotally connected to the frame generally near the lower side and generally near the forward end and generally near the second side of the frame, and pivotally connected to the forward cutter frame generally near the rearward end and generally near the lower side and generally near the second side of the forward cutter frame, the first, the second, the third and the fourth steering cylinders being actuable to move the forward cutter frame generally about the pivotal connection provided via the universal connection;

means to actuate the first, the second, the third and the fourth steering cylinders for moving the forward cutter frame and the forward cutter connected thereto about the pivotal connection provided via the universal connection to predetermined positions to steeringly guide the miner through the earth formation; and a launching assembly for moving the miner into the formation and withdrawing the miner from the earth formation.

77. The mining apparatus of claim 76 wherein the means to actuate the first, the second, the third and the fourth steering cylinders is defined further as being located at a remote position with respect to the location of the miner for steeringly guiding the miner from a remote location.

78. The mining apparatus of claim 76 wherein the miner is defined further to include:

a roll cylinder connected to the frame generally near the forward end and generally near the first side and generally between the upper and the lower sides of the frame, and connected to the forward cutter frame generally near the first side and generally near the rearward end and generally between the upper and the lower side of the forward cutter frame; and means to actuate the roll cylinder for moving the forward cutter frame and the forward cutter connected thereto about the pivotal connection provided via the universal connection, the roll cylinder cooperating with the first, the second, the third and the fourth steering cylinders to steeringly guide the miner through the earth formation.

79. The mining apparatus of claim 71 wherein the miner is defined further to include:

a reservoir having a supply of fluid; and a pump in fluidic communication with the reservoir for supply fluid; and wherein one portion of the first steering cylinder is connected to the pump and another portion of the first steering cylinder is connected to the reservoir, and wherein one portion of the second steering cylinder is connected to the pump and another portion of the second steering cylinder is connected to the reservoir, and wherein one portion of the third steering cylinder is connected to the pump and another portion of the third steering cylinder is connected to the reservoir, and wherein one portion of the fourth steering cylinder is connected to the pump and another portion of the fourth steering cylinder is connected to the reservoir, and wherein one portion of each roll cylinder is connected to the pump and another portion of each roll cylinder is connected to the reservoir, and wherein the miner is defined further to include:

a control valve interposed between the first steering cylinder and the pump and the reservoir having one position establishing fluidic communication between one portion of the first steering cylinder and the pump for applying a force to the forward cutter frame in one direction generally at connection of the first steering cylinder to the forward cutter frame, and another position establishing fluidic communication between another portion of the first steering cylinder for applying a force in the opposite direction to the forward cutter frame generally at the connection of the first steering cylinder to the forward cutter frame;

a control valve interposed between the second steering cylinder and the pump and the reservoir having one position establishing fluidic communication between one portion of the second steering cylinder and the pump for applying a force to the forward cutter frame in one direction generally at the connection of the second steering cylinder to the forward cutter frame, and another position establishing fluidic communication between another portion of the second steering cylinder for applying a force in the opposite direction to the forward cutter frame generally at the connection of the second steering cylinder to the forward cutter frame;

a control valve interposed between the third steering cylinder and the pump and the reservoir having one position establishing fluidic communication between one portion of the third steering cylinder and the pump for applying a force to the forward cutter frame in one direction generally at the connection of the third steering cylinder to the forward cutter frame, and another position establishing fluidic communication between another portion of the third steering cylinder for applying a force in the opposite direction to the forward cutter frame generally at the connection of the third steering cylinder to the forward cutter frame;

a control valve interposed between the fourth steering cylinder and the pump and the reservoir having one position establishing fluidic communication between one portion of the fourth steering cylinder and the pump for applying a force to the forward cutter frame in one direction generally at the connection of the fourth steering cylinder to the forward cutter frame, and another position establishing fluidic communication between another portion of the fourth steering cylinder for applying a force in the opposite direction to the forward cutter frame generally at the connection of the fourth steering cylinder to the forward cutter frame;

a control valve interposed between the roll cylinder and the pump and the reservoir having one position establishing fluidic communication between one portion of the roll cylinder and the pump for applying a force to the forward cutter frame in one direction generally at the connection of the roll cylinder to the forward cutter frame, and another position establishing fluidic communcation between another portion of the roll cylinder for applying a force in the opposite direction to the forward cutter frame generally at the connection of the roll cylinder to the forward cutter frame; and a control unit disposed at a remote location with respect to the location of the miner and connected to the control valve interposed between the first steering cylinder and the pump and the reservoir for remotely positioning the control valve to apply the force in the one direction and in the opposite direction to the forward cutter frame, and connected to the control valve interposed between the second steering cylinder and the pump and the reservoir for remotely positioning the control valve to apply the force in the one direction and in the opposite direction, and connected to the control valve interposed between the third steering cylinder and the pump and the reservoir for remotely positioning the control valve to apply the force in the one direction and in the opposite direction, and connected to the control valve interposed between the fourth steering cylinder and the pump and the reservoir to apply the force in the one direction and in the opposite direction to the forward cutter frame, and connected to the control valve interposed between the roll cylinder and the pump and the reservoir for remotely positioning the control valve to apply the force in the one direction and in the opposite direction, the control unit operating to remotely position the forward cutter frame in predetermined positions relative to the frame for guidingly steering the miner through the earth formation.

80. A mining apparatus for forming a borehole in an earth formation comprising:

a miner, comprising:

a frame, having a forward end, a rearward end, a first side and a second side;

a forward cutter assembly movably connected to the frame for excavatingly engaging the earth formation in one condition, comprising:

a forward cutter frame having a forward end, a rearward end, a first side and a second side, the rearward end of the forward cutter frame being disposed near and spaced a distance from the forward end of the frame;

a forward cutter rotatably mounted on the forward end of the forward cutter frame for excavatingly engaging the material to be mined; and a forward cutter drive assembly connected to the forward cutter to excavatingly engage the material to be mined;

a forward cutter positioning assembly connected to the forward cutter frame for movably positioning the forward cutter frame and the forward cutter connected thereto to guidingly steer the miner through portions of the earth formation;

a rearward cutter assembly movably connected to the frame and movably positionably in a storage position and in a material engaging position, the rearward cutter assembly comprising:

a rearward cutter frame, having a forward end and a rearward end movably connected to the rearward end of the frame;

a rearward cutter rotatably mounted on the rearward cutter frame for excavatingly engaging the material to be mined; and a rearward cutter drive assembly connected to the rearward cutter for driving the rearward cutter to excavatingly engage the material to be mined;

a rearward cutter positioning assembly connected to the rearward cutter frame for positioning the rearward cutter frame and the rearward cutter connected thereto in the storage position and in the material engaging position, the rearward cutter being positioned to excavatingly engage the material to be mined in the material engaging position;

a launching assembly for moving the miner into a portion of the earth formation and withdrawing the miner from a portion of the earth formation; and a control unit disposed at a remote location with respect to the location of the miner, the control unit being connected to the forward cutter positioning assembly and to the rearward cutter positioning assembly for remotely conditioning the forward cutter assembly to excavatingly engage the earth formation while moving the miner into the earth formation and for remotely positioning the rearward cutter assembly in the storage position while moving the miner into the earth formation and for remotely positioning the rearward cutting assembly in the material engaging position while withdrawing the miner from the earth formation.

81. The mining apparatus of claim 80 wherein the control unit is disposed at a remote location with respect to the miner for remotely controlling the miner, and wherein the mining apparatus excavatingly removes mined material from a coal seam, and wherein the miner is defined further to include:

a sensor assembly connected to the miner for detecting the coal seam and providing an output signal indicating the detected position of the coal seam;

and wherein the control unit is defined further as receiving the sensor assembly output signal and produces an output signal in response thereto for movably positioning the forward cutter assembly to guide the miner through the coal seam.

82. The mining apparatus of claim 80 wherein the miner is defined further to include:

a universal connection disposed between the rearward end of the forward cutter frame and the forward end of the frame, a portion of the universal connection being connected to the forward cutter frame and a portion of the universal connection being connected to the frame, the forward cutter frame being movably positionable with respect to the frame about axes defined generally via centerlines extending through the pivotal connection between the frame and the forward cutter frame provided via the universal connection, the forces created as a result of the engagement between the pads and the portions of the earth formation acting to reduce the load on the universal connection during the turning of the miner as the miner is guided through the earth formation.

83. The mining apparatus of claim 80 wherein the rearward cutter positioning assembly is defined further to include:

at least two pivot arms, each pivot arm having one end pivotally connected to the frame and an opposite end povotally connected to the rearward cutter frame, the pivot arms pivotally connecting the rearward cutter frame to the frame for pivotally moving the rearward cutter frame and the rearward cutter connected thereto in one direction generally toward a storage position and in another direction generally toward a material engaging position; and at least two rear cylinders, each rear cylinder being pivotally connected to the frame and pivotally connected to the rearward cutter frame for moving the rearward cutter frame and the rearward cutter connected thereto to the storage position in one actuated condition of the rear cylinders and for moving the rearward cutter frame and the rearward cutter connected thereto to the material engaging position in one other actuated condition.

84. The mining apparatus of claim 83 defined further to include:

means remotely located with respect to the miner and connected to the rear cylinders for remotely conditioning the rear cylinders in the one condition for moving the rearward cutter frame and the rearward cutter connected thereto to the storage position and for remotely conditioning the rear cylinders in the other conditions for moving the rearward cutter frame and the rearward cutter connected thereto to the material engaging position.

* * * * *